US008602198B2

(12) United States Patent
Coenen et al.

(10) Patent No.: US 8,602,198 B2
(45) Date of Patent: Dec. 10, 2013

(54) VACUUM ROLL AND METHOD OF USE

(75) Inventors: Joseph Daniel Coenen, Kaukauna, WI (US); Gregory J. Rajala, Neenah, WI (US); Walter Reynold Johnson, Greenville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 370 days.

(21) Appl. No.: 12/972,082

(22) Filed: Dec. 17, 2010

(65) Prior Publication Data

US 2012/0152695 A1 Jun. 21, 2012

(51) Int. Cl.
*B65G 13/00* (2006.01)

(52) U.S. Cl.
USPC ..... 193/37; 198/780

(58) Field of Classification Search
USPC ..... 198/780; 193/35 R, 37; 493/360; 100/121; 118/50, 319
See application file for complete search history.

(56) References Cited

U.S. PATENT DOCUMENTS

| | | | | | |
|---|---|---|---|---|---|
| 2,969,837 | A | * | 1/1961 | Reynar | 162/371 |
| 3,037,557 | A | * | 6/1962 | Faeber et al. | 162/370 |
| 3,142,428 | A | | 7/1964 | Faeber | |
| 3,533,618 | A | * | 10/1970 | Carstens | 271/276 |
| 3,669,064 | A | * | 6/1972 | Hoelzinger et al. | 118/39 |
| 4,053,150 | A | | 10/1977 | Lane | |
| 4,479,573 | A | * | 10/1984 | Ackley et al. | 198/399 |
| 4,519,596 | A | | 5/1985 | Johnson et al. | |
| 4,650,173 | A | | 3/1987 | Johnson et al. | |
| 4,681,215 | A | * | 7/1987 | Martin | 198/843 |
| 4,693,784 | A | | 9/1987 | Aula et al. | |
| 4,706,863 | A | | 11/1987 | Hirakawa et al. | |
| 4,773,522 | A | * | 9/1988 | Lenhart | 198/418.7 |
| 5,137,758 | A | * | 8/1992 | Kistner et al. | 427/350 |
| 5,205,398 | A | * | 4/1993 | Hart et al. | 198/780 |
| 5,224,405 | A | * | 7/1993 | Pohjola | 83/24 |
| 5,524,740 | A | * | 6/1996 | Conley | 193/37 |
| 6,131,214 | A | * | 10/2000 | Moenning et al. | 5/81.1 C |
| 6,247,861 | B1 | * | 6/2001 | Wotton | 400/636.3 |
| 6,264,743 | B1 | * | 7/2001 | Cucuzza | 118/50 |
| 6,488,194 | B1 | | 12/2002 | Couturier | |
| 6,585,139 | B1 | * | 7/2003 | Holtmann et al. | 226/95 |
| 6,630,096 | B2 | | 10/2003 | Venturino et al. | |
| 6,811,019 | B2 | * | 11/2004 | Christian et al. | 198/471.1 |
| 6,936,105 | B2 | * | 8/2005 | De Vroome | 118/264 |

(Continued)

FOREIGN PATENT DOCUMENTS

| | | | |
|---|---|---|---|
| DE | 9205154 | U1 | 6/1992 |
| WO | 9002840 | A1 | 3/1990 |
| WO | 9002841 | A1 | 3/1990 |
| WO | 2009083788 | A1 | 7/2009 |

OTHER PUBLICATIONS

International Search Report and Written Opinion for PCT/IB2011/054981 dated Aug. 22, 2012; 8 pages.

*Primary Examiner* — Douglas Hess
(74) *Attorney, Agent, or Firm* — Armstrong Teasdale LLP

(57) ABSTRACT

A vacuum roll has an inner cylinder defining an interior chamber. The interior chamber is fluidly connected to a vacuum source for applying a vacuum thereto. An outer cylinder is rotatable about the inner cylinder and has a plurality of apertures therein. An actuator is configured to move the inner cylinder between a first position and a second position. The vacuum roll has a first vacuum profile with the inner cylinder in the first position and a second vacuum profile with the inner cylinder in the second position.

23 Claims, 64 Drawing Sheets

(56) References Cited

U.S. PATENT DOCUMENTS

| | | | | |
|---|---|---|---|---|
| 7,367,264 | B2 * | 5/2008 | Beaudry | 101/409 |
| 7,399,266 | B2 | 7/2008 | Aiolfi et al. | |
| 7,846,082 | B2 | 12/2010 | Burns, Jr. et al. | |
| 8,029,430 | B2 * | 10/2011 | Neubauer et al. | 493/421 |
| 8,257,237 | B2 * | 9/2012 | Burns et al. | 493/424 |
| 2002/0129687 | A1 | 9/2002 | Eckstein et al. | |
| 2002/0140151 | A1 | 10/2002 | Couturier | |
| 2003/0042660 | A1 | 3/2003 | Venturino et al. | |
| 2003/0134559 | A1 | 7/2003 | Delzer et al. | |
| 2004/0176231 | A1 | 9/2004 | Pajunen | |
| 2004/0250706 | A1 | 12/2004 | De Matteis | |
| 2005/0073090 | A1 | 4/2005 | White | |
| 2008/0176729 | A1 | 7/2008 | Anelli et al. | |
| 2011/0003673 | A1 | 1/2011 | Piantoni et al. | |
| 2012/0157284 | A1 | 6/2012 | Coenen et al. | |
| 2012/0157286 | A1 | 6/2012 | Coenen et al. | |
| 2012/0157288 | A1 | 6/2012 | Coenen et al. | |

* cited by examiner

VACUUM ROLL AND METHOD OF USE

BACKGROUND

The field of the present invention relates generally to vacuum rolls, and more particularly to a vacuum roll for holding, controlling, transferring, folding, winding or otherwise handling flexible materials.

One known type of vacuum roll includes a rotatable outer cylindrical wall defining an interior space and a plurality of apertures extending through the cylindrical wall and in fluid communication with the interior space. One or more stationary vacuum manifolds are disposed within the interior space and operatively connected to a vacuum source. Vacuum can be selectively applied to one or more of the vacuum manifolds by operating the vacuum source.

As the outer cylindrical wall rotates relative to the manifolds, the apertures in the cylindrical wall move into and out of fluid communication with the manifolds. As a result, any vacuum applied to the manifold by the vacuum source is transferred to the apertures when the apertures are in fluid communication with the manifold. When the vacuum source is not applying vacuum to the manifold or when the apertures are out of fluid communication with the manifold, no vacuum is applied to the apertures in the cylindrical wall.

In another known type of vacuum roll, each of the vacuum manifolds is rotatable with the outer cylindrical wall. For example, a first plurality of apertures in the cylindrical wall is in fluid communication with one of the manifolds and a second plurality of apertures in the cylindrical wall is in fluid communication with another one of the manifolds. Vacuum can be selectively applied to the first plurality of apertures and/or the second plurality of apertures at any location about the rotation of the outer cylinder by regulating the vacuum applied by the vacuum source to the respective manifold. Regulation of the vacuum source is most commonly preformed using one or more valves (e.g., solenoid valves). In other words, the vacuum applied to each of the manifolds can be selectively turned "on" and "off" by opening and closing a valve.

One disadvantage of these known vacuum rolls is their slow response time. As a result, these prior art vacuum rolls limit the line speed at which materials can be handled. Moreover, another disadvantage of these known vacuum rolls is that they are limited in their ability to change the vacuum profile (i.e., vacuum pattern) applied by the vacuum roll to the material especially at high line speeds.

Thus, there is a need for a vacuum roll capable of handling materials at high line speeds. There is a further need for a vacuum roll capable of easily changing its vacuum profile even while the vacuum roll is handling a material at a high line speed.

BRIEF DESCRIPTION

In one aspect, a vacuum roll generally comprises an inner cylinder defining an interior chamber. The interior chamber is fluidly connected to a vacuum source for applying a vacuum thereto. An outer cylinder is rotatable about the inner cylinder and has a plurality of apertures therein. An actuator is configured to move the inner cylinder between a first position and a second position. The vacuum roll has a first vacuum profile with the inner cylinder in the first position and a second vacuum profile with the inner cylinder in the second position.

In another aspect, a vacuum roll generally comprises an inner cylinder defining an interior chamber. The interior chamber is fluidly connected to a vacuum source for applying a vacuum thereto. An outer cylinder is rotatable about the inner cylinder and has a plurality of apertures therein. The vacuum roll has a first vacuum profile and a second vacuum profile. The inner cylinder is moveable relative to the outer cylinder to change the profile of the vacuum roll from the first vacuum profile to the second vacuum profile.

In yet another aspect, a method of handling a material generally comprises directing a material to a vacuum roll. The vacuum roll comprises an inner cylinder and an outer cylinder rotatable about the inner cylinder. The inner cylinder defines an interior chamber and the outer cylinder has a plurality of apertures therein. A vacuum is applied to the interior chamber of the inner cylinder. At least some of the plurality of apertures in the outer cylinder are fluidly connected with the interior chamber of the inner cylinder to define a first vacuum profile. At least a portion of the material is in contact with the outer cylinder while the at least some of the plurality of apertures in the outer cylinder are fluidly connected with the interior chamber so that the vacuum applied thereto grasps and holds the portion of the material to the outer cylinder. The inner cylinder is moved relative to the outer cylinder to change the vacuum profile of the vacuum roll from the first vacuum profile to a second vacuum profile.

BRIEF DESCRIPTION OF THE DRAWINGS

Corresponding reference characters indicate corresponding parts throughout the drawings.

DETAILED DESCRIPTION OF THE DRAWINGS

Figure 1:
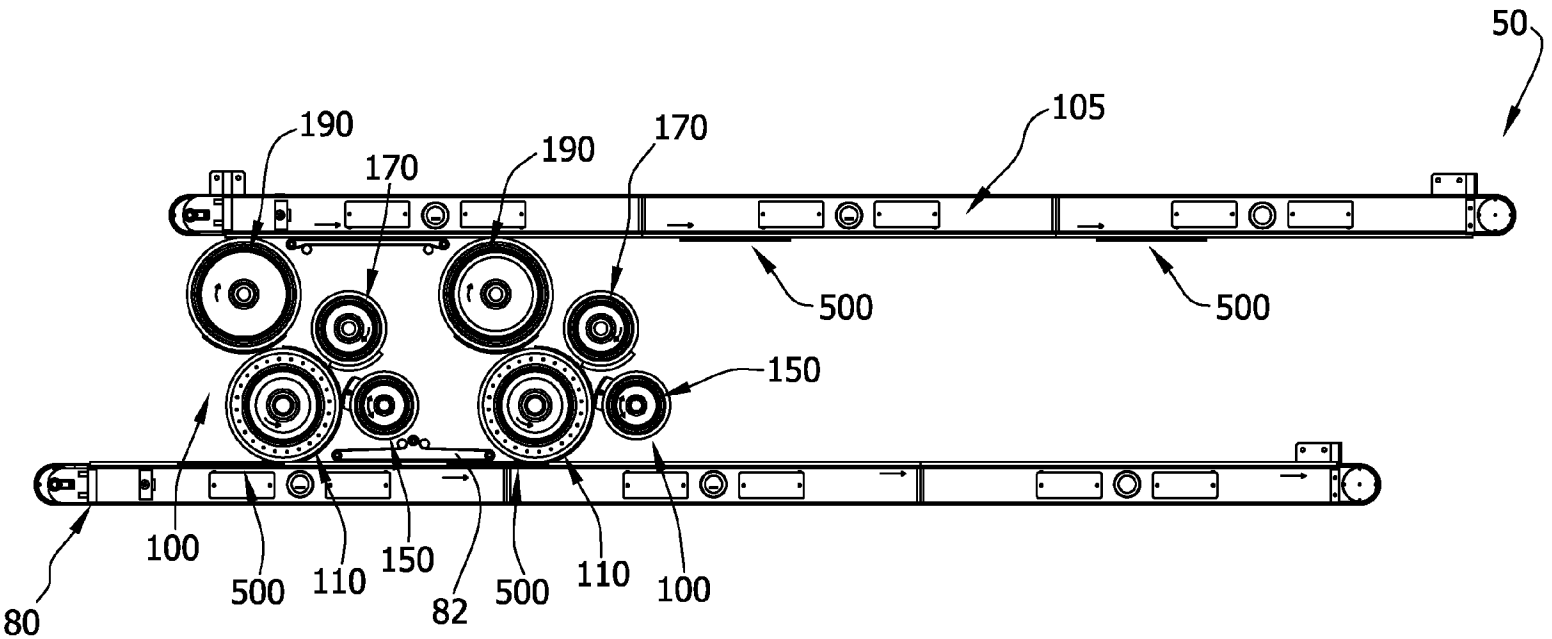
FIG. 1 is a schematic of a portion of a manufacturing system for manufacturing products, the manufacturing system having two folding apparatus of one suitable embodiment.

FIG. 1 is a schematic of a portion of a manufacturing system, indicated generally at 50, for manufacturing products (such as personal care products) having one embodiment of a folding apparatus, indicated generally at 100. The illustrated configuration of the manufacturing system 50 has two folding apparatus 100 but it is contemplated that the system could have fewer (i.e., one) or more folding apparatus. The folding apparatus 100 is capable of maintaining accurate control of the product while it is being folded at high line speeds. As a result, the products being manufactured by the illustrated system 50 are folded more precisely, with greater repeatability, and with less force (and thus less product damage and deformation) than prior art folding apparatus, such as blade folding apparatus. As used herein, the term "high line speed" refers to product manufacturing rates of 400 products per minute (ppm) or greater, such as 400 ppm to 4000 ppm, or 600 ppm to 3000 ppm, or 900 ppm to 1500 ppm. However, it is understood that the product manufacturing rate is directly dependent on the product begin manufactured. Thus, the term "high line speed" is relative and can differ from one product to another.

For exemplary purposes only, the illustrated manufacturing system 50 and thus, the folding apparatus 100 will be described herein as a disposable training pant manufacturing system and folding apparatus. It is understood, however, that the manufacturing system and folding apparatus 100 can be configured to manufacture and fold numerous other products, including but not limited to, other types of personal care products, foil products, film products, woven products, packaging products, industrial products, food products, etc., whether disposable or non-disposable, and whether absorbent or non-absorbent, without departing from the scope of the invention. Other suitable personal care products that could be manufactured by the system 50 and folded by the folding apparatus 100 include, but are not limited to, diapers, adult incontinence garments, panty liners, and feminine pads.

As illustrated in FIG. 1, a plurality of discrete training pants 500 are fed along a first conveying member, indicated generally at 80. The first conveying member 80 delivers each of the training pants 500 (broadly, "a material") in a pre-folded configuration to one of the two folding apparatus 100 for folding the training pants from the pre-folded configuration to a folded configuration. The folded training pants 500 are conveyed from the respective folding apparatus 100 by a second conveying member, indicated generally at 105, to other components (not shown) of the system 50. Since both of the folding apparatus 100 illustrated in FIG. 1 are substantially the same, the detailed description of only one is provided herein.

Figure 2:
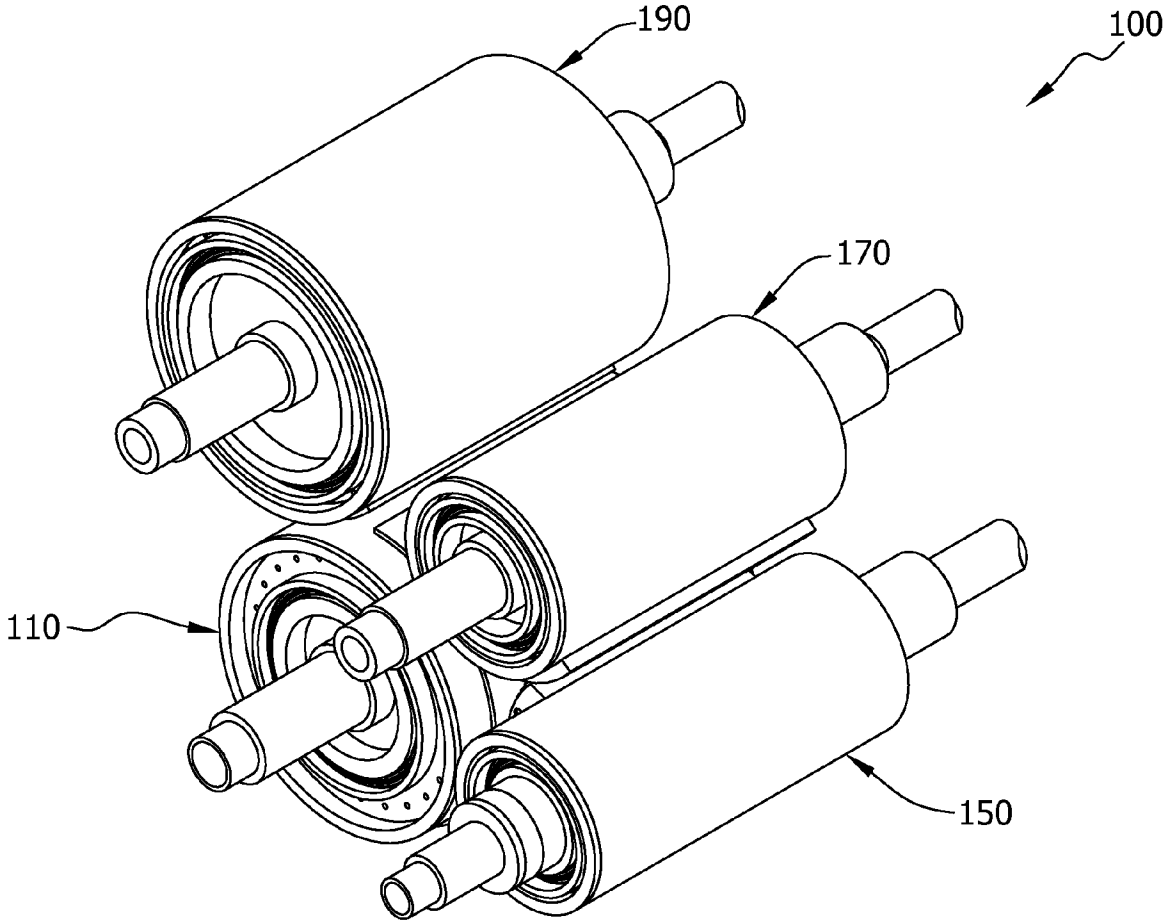
FIG. 2 is a perspective of one of the folding apparatus removed from the manufacturing system, the folding apparatus having a receiving roll, an oscillating member, a folding roll, and a transferring roll.
Figure 3:
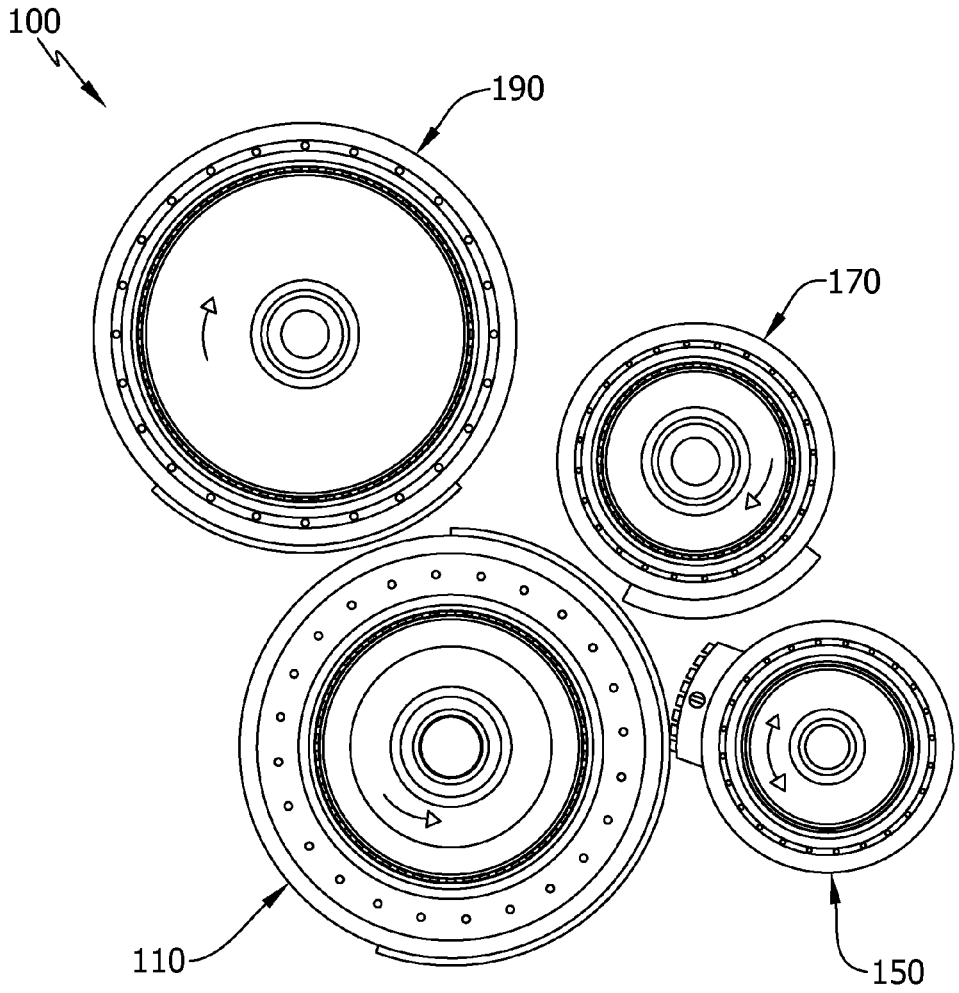
FIG. 3 is an end view of the folding apparatus of FIG. 2.
Figure 4:
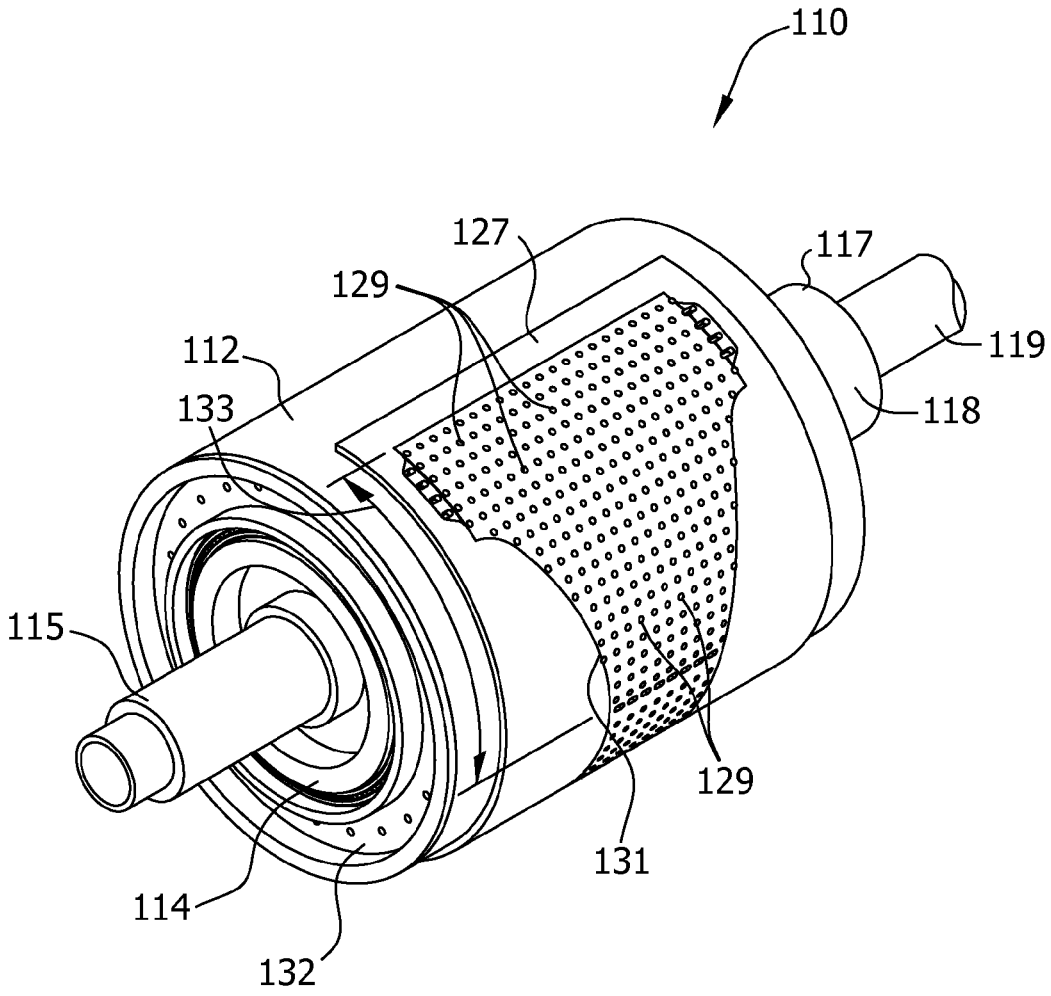
FIG. 4 is a perspective of the receiving roll of the folding apparatus.

As illustrated in FIGS. 2 and 3, the folding apparatus 100 comprises a receiving roll 110, an oscillating member 150 (broadly, a "vacuum roll"), a folding roll 170, and a transferring roll 190. Each of the receiving roll 110, the oscillating member 150, the folding roll 170, and the transferring roll 190 is indicated generally by their respective reference number.

Figure 5:
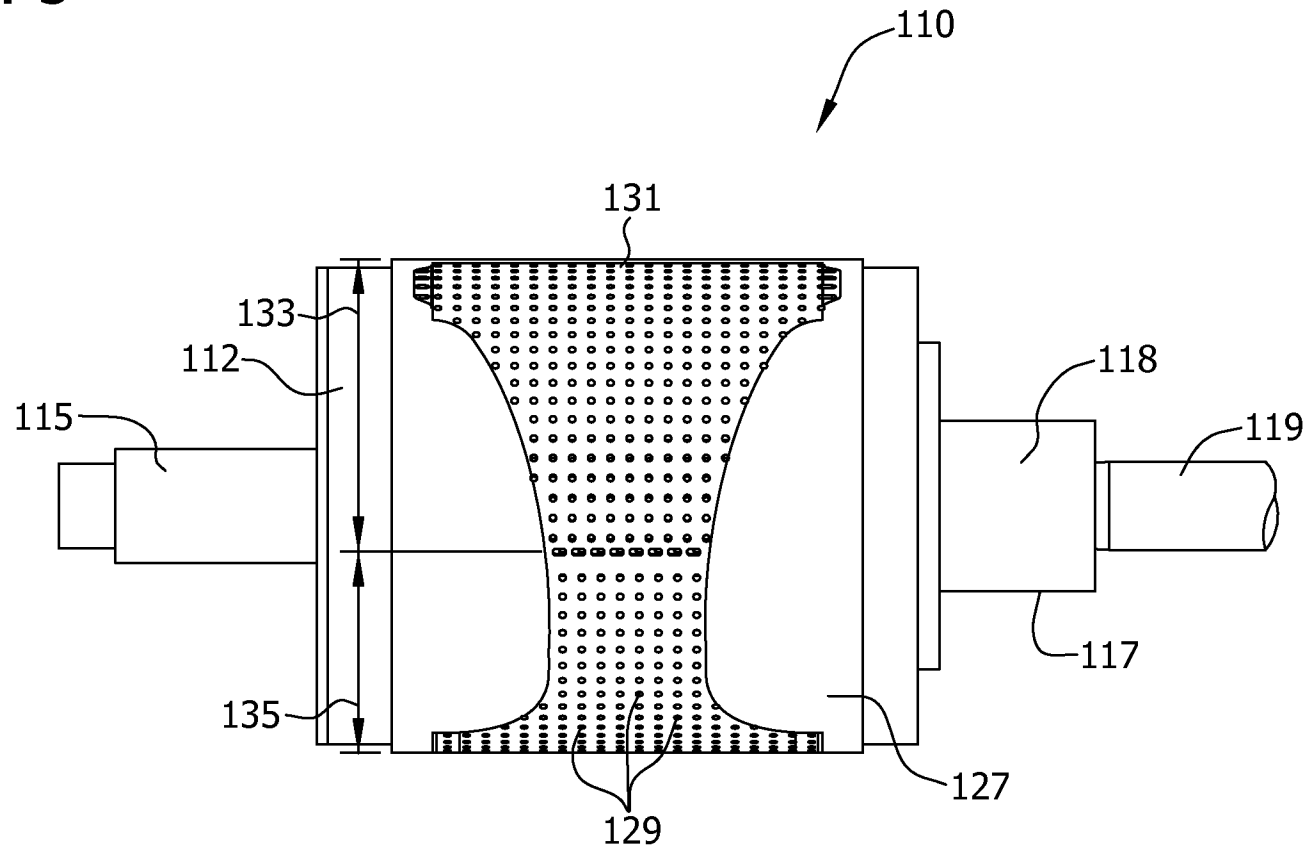
FIG. 5 is a right side view of the receiving roll as seen in FIG. 4.
Figure 6:
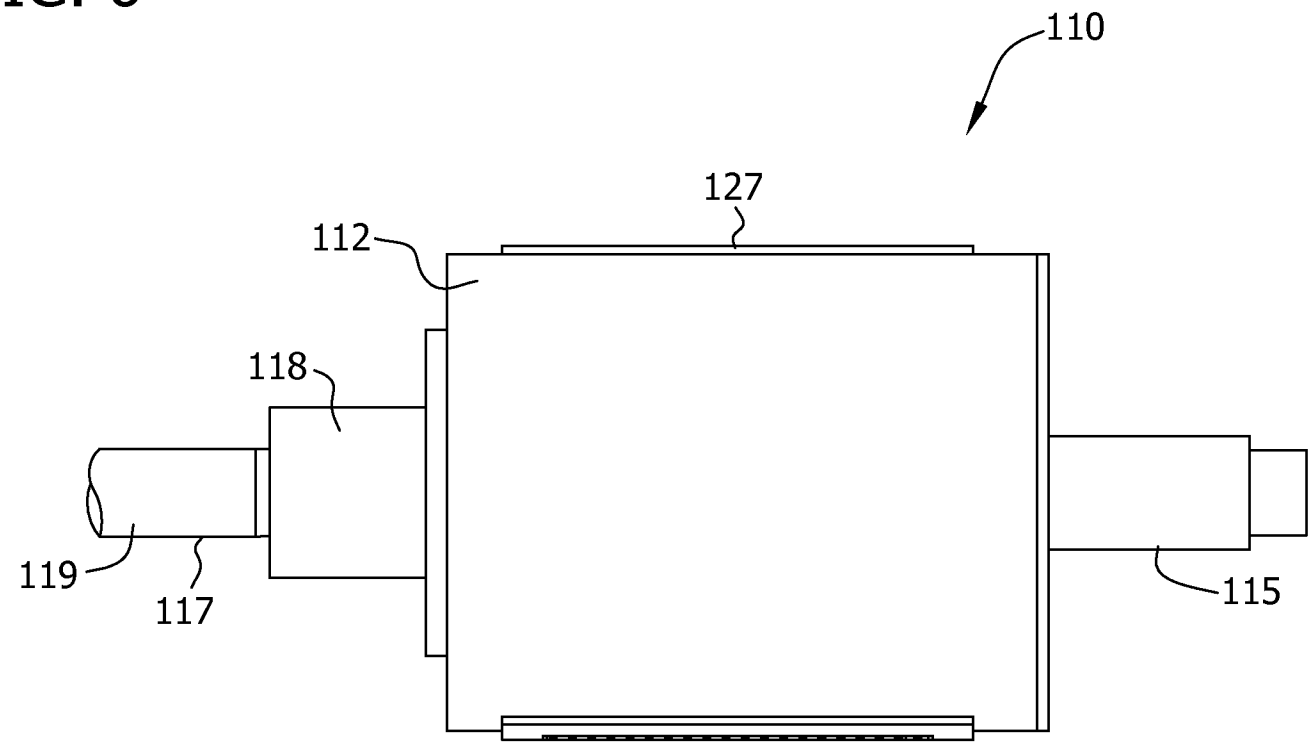
FIG. 6 is a left side view of the receiving roll.
Figure 7:
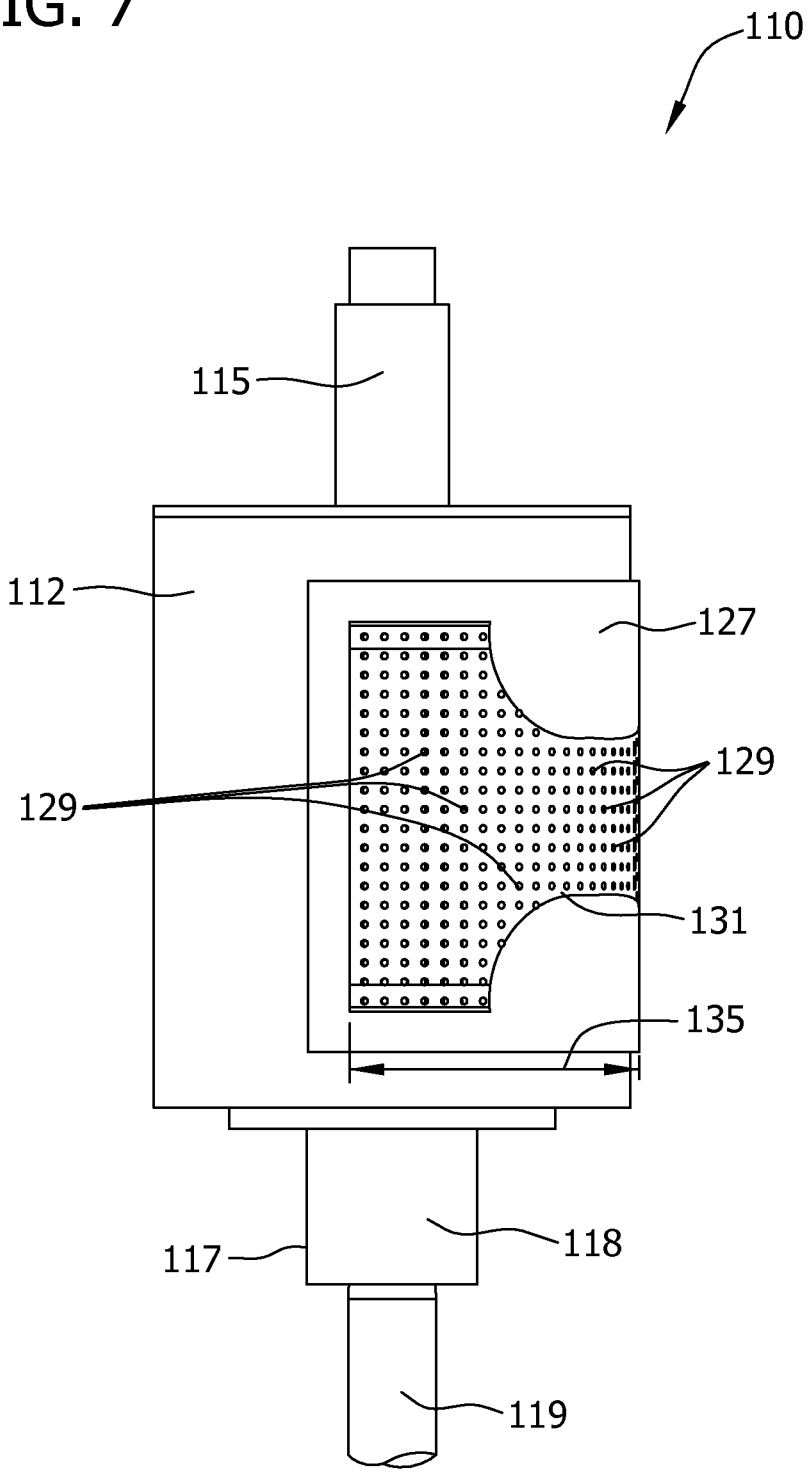
FIG. 7 is a bottom view of the receiving roll.
Figure 8:
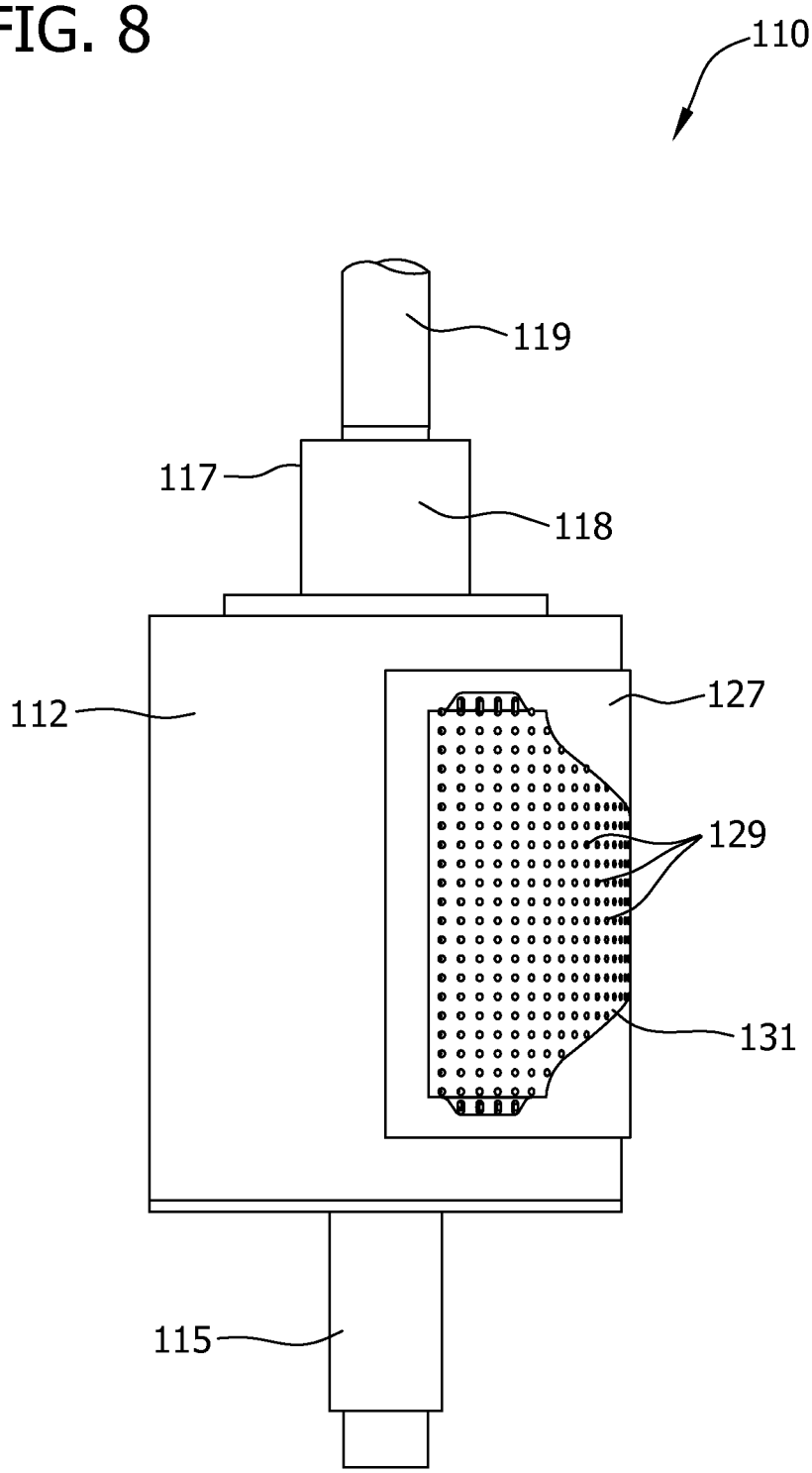
FIG. 8 is a top view of the receiving roll.

The receiving roll 110 comprises an inner cylinder 111 (FIGS. 9-11) and an outer cylinder 112 (FIGS. 4-9) that is rotatable about the inner cylinder. With reference to FIGS. 4-8, the outer cylinder 112 comprises a raised engagement member 127 adapted to receive, hold, and feed the training pant 500 through the folding apparatus 100. The raised engagement member 127 includes a plurality of circular apertures 129 arranged to generally match the profile of the pre-folded configuration of the training pant 500. The engagement member 127 includes a first zone 133 and a second zone 135. The apertures 129 in the second zone 135 are offset from the apertures in the first zone 133. More specifically, the apertures 129 in the first and second zones 133, 135 are generally aligned in columns about the circumference of the receiving roll 110 and in rows, which extend in the cross-direction of the receiving roll. As seen in FIG. 5, the apertures 129 defining the columns in the second zone 135 are laterally off-set from the apertures defining the columns in the first zone 133. The outer cylinder 112 is closed by a pair of end plates 132 (FIG. 9).

The illustrated receiving roll 110 is adapted to receive and hold one training pant 500 per revolution. It is understood, however, that the receiving roll 110 can be adapted to receive and hold a plurality of training pants 500 per revolution. It is also understood that the raised engagement member 127 can be flush with the remainder of the outer cylinder 112 (i.e., not raised). It is further understood that the apertures 129 in the engagement member 127 of the outer cylinder 112 can be arranged differently, that there can be more or fewer apertures than illustrated in the accompanying drawings, and that the apertures can have different shapes and sizes than those illustrated.

Figure 9:
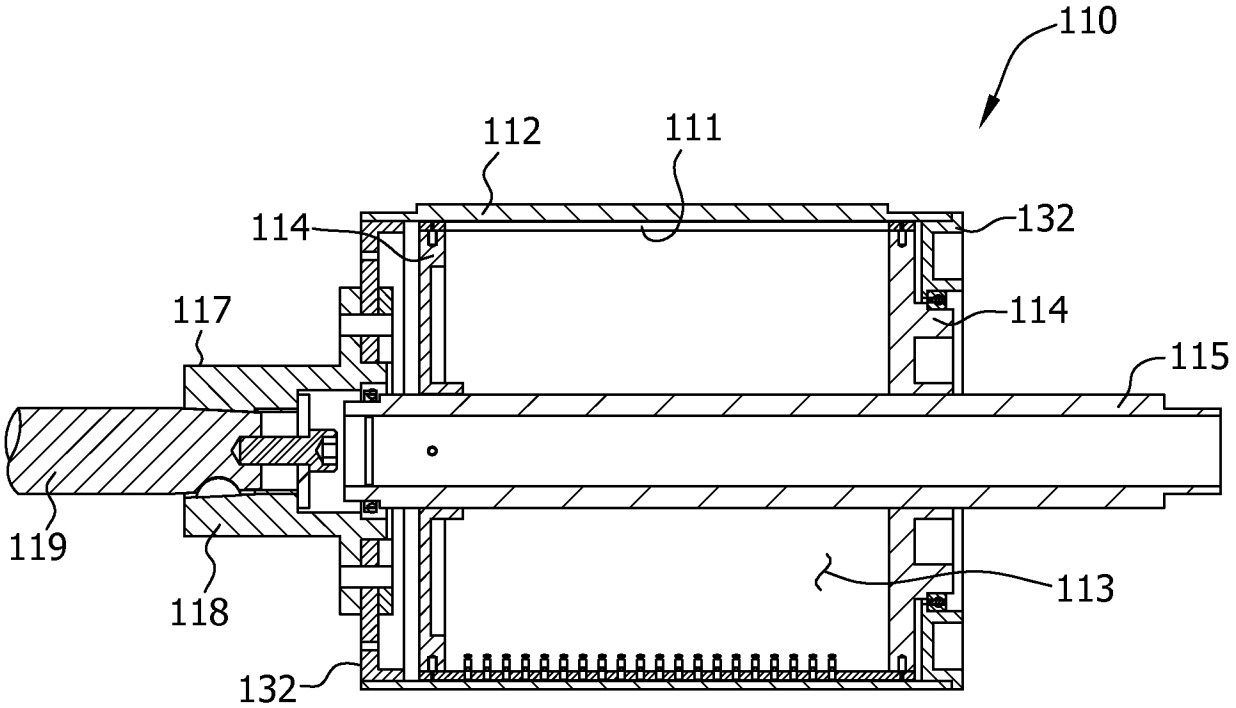
FIG. 9 is a vertical cross-section of the receiving roll.
Figure 10:
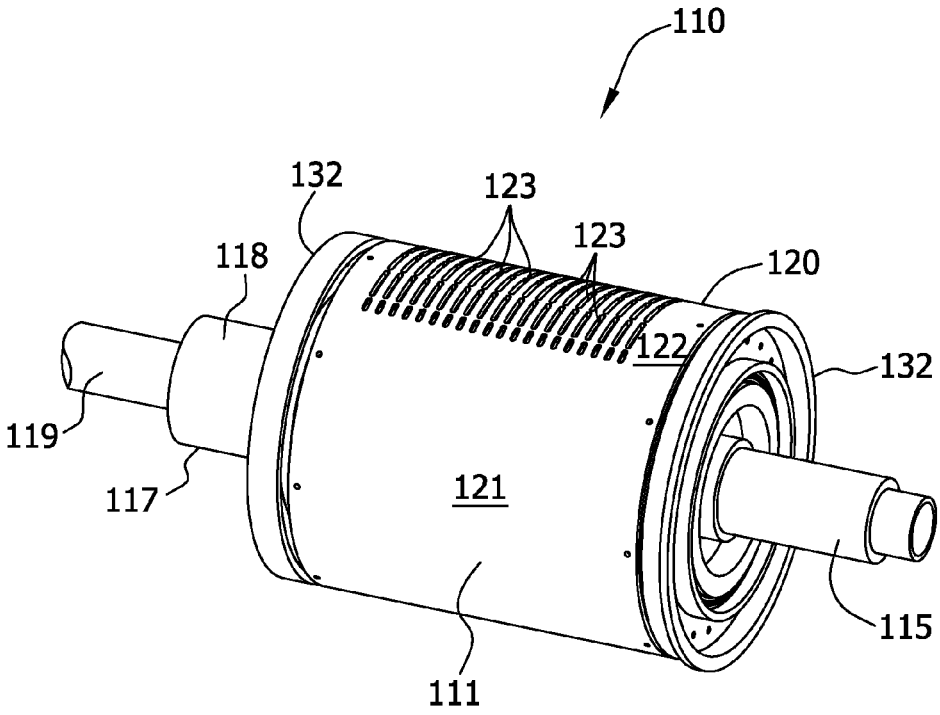
FIGS. 10 and 11 are perspectives of the receiving roll with an outer cylinder of the receiving roll removed.
Figure 11:
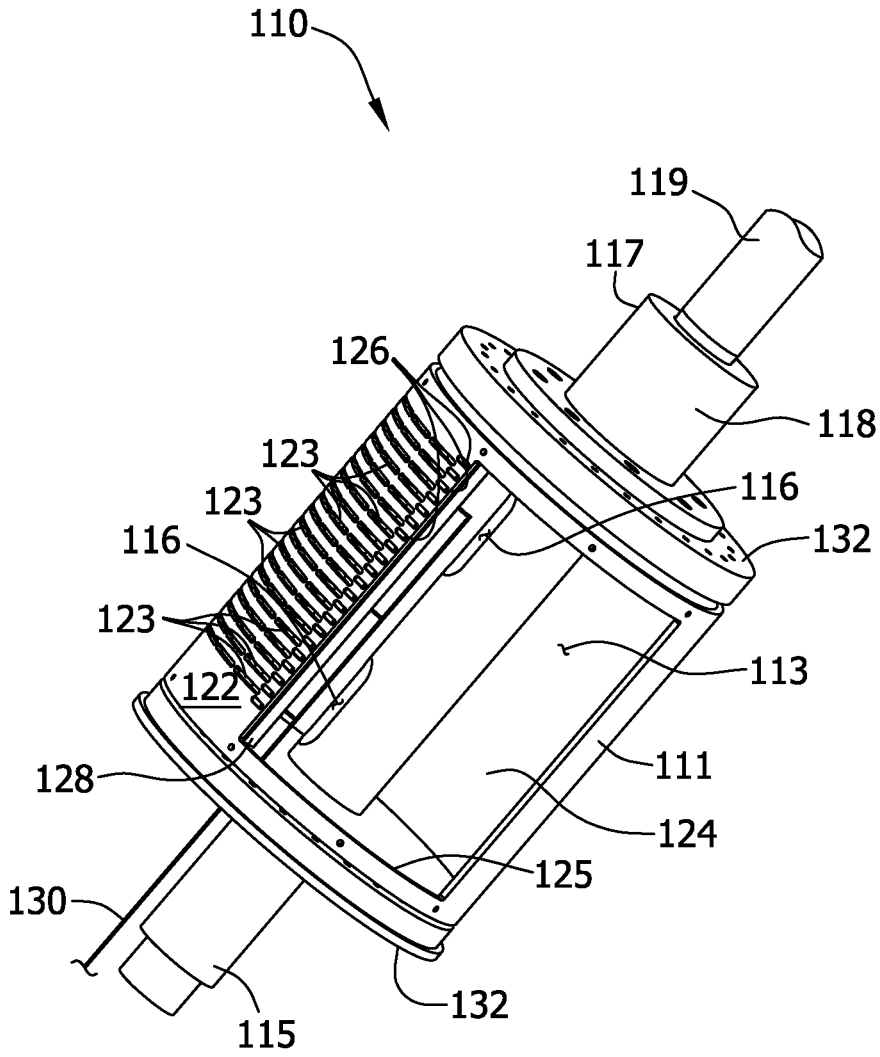

In the illustrated embodiment, the inner cylinder 111 is stationary and defines an interior chamber 113 (FIGS. 9 and 11). A conduit 115 extends into and is in fluid communication with the interior chamber 113 for allowing a suitable vacuum source (not shown) to apply a vacuum to the interior chamber. As seen in FIGS. 10 and 11, the inner cylinder 111 comprises a wall 120 with three discrete segments about its circumference: a solid segment 121; a slotted segment 122 having a plurality of slots 123 and a row of oval apertures 126; and an opened segment 124 having a generally rectangular opening 125. Each of the oval apertures 126 in the slotted segment 122 are transversely offset from the slots 123 and in fluid communication with an elongate enclosure 128. A pressurized air conduit 130 is provided to fluidly connect the elongate enclosure 128 to a suitable source of pressurized air (not shown). A pair of end plates 114 disposed adjacent the ends of the inner cylinder 111 closes the interior chamber 113.

As seen in FIGS. 4-9, a drive assembly 117 is operatively connected to the outer cylinder 112 for rotating the outer cylinder with respect to the inner cylinder 111. The drive assembly 117 includes a hub 118, a shaft 119 coupled to the hub, and a suitable drive mechanism (not shown) capable of rotating the shaft and hub.

Figure 12:
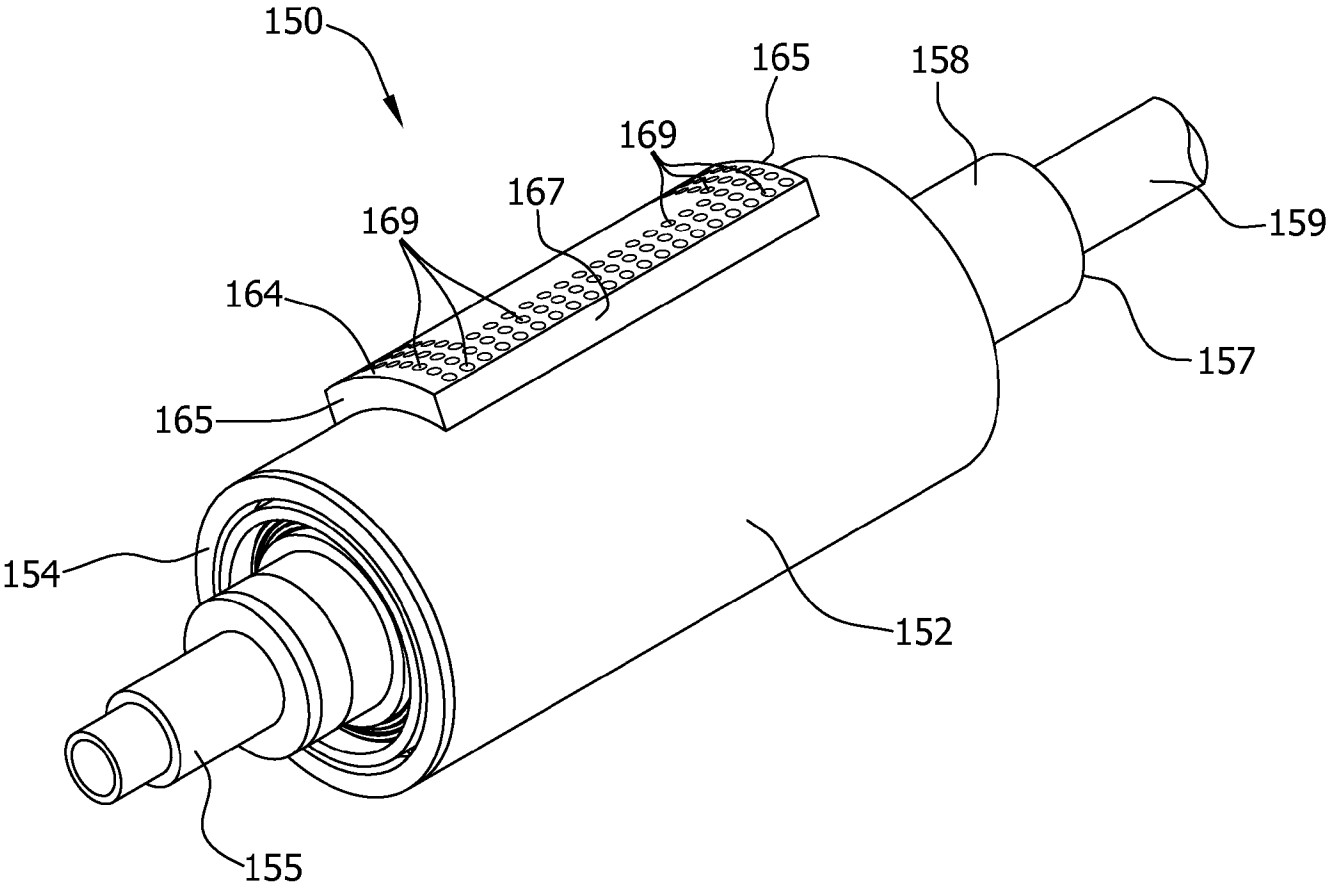
FIG. 12 is a perspective of the oscillating member of the folding apparatus.
Figure 13:
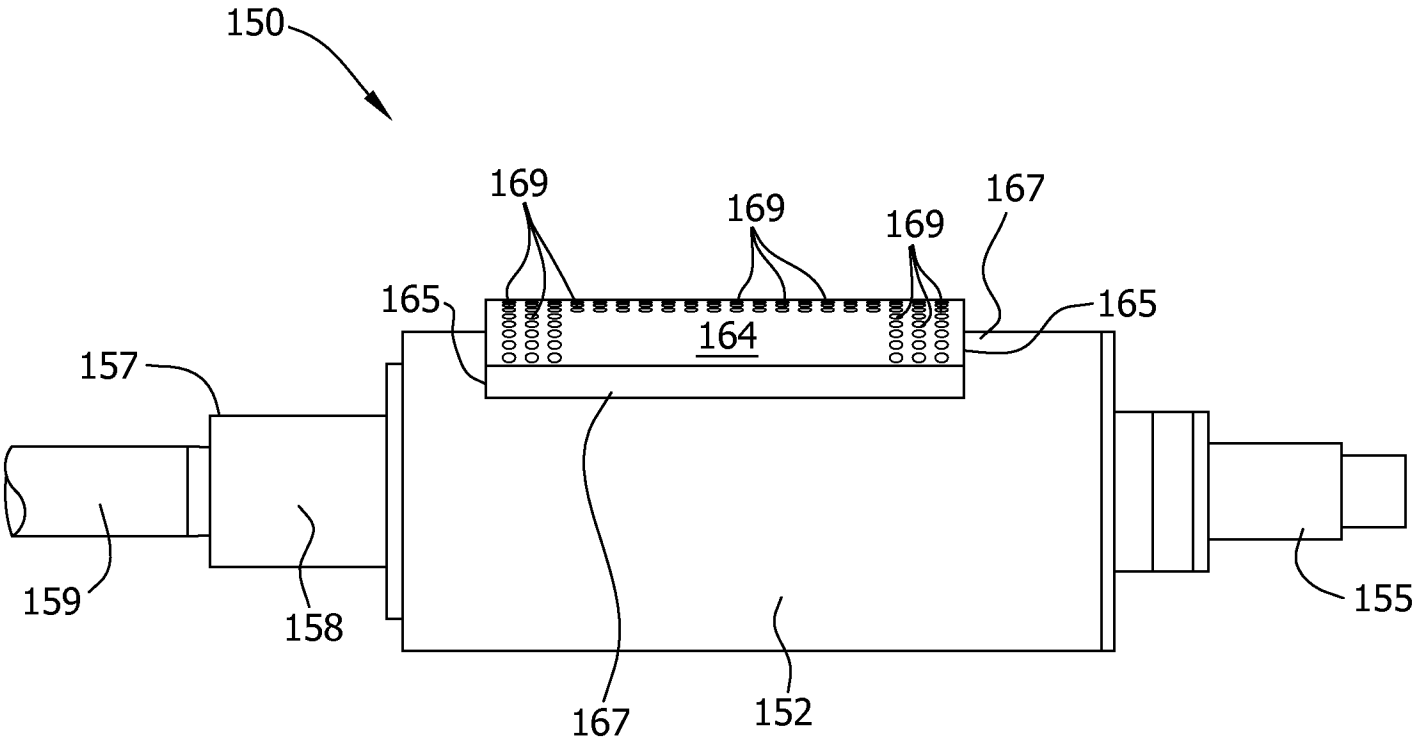
FIG. 13 is a left side view of the oscillating member as seen in FIG. 12.
Figure 14:
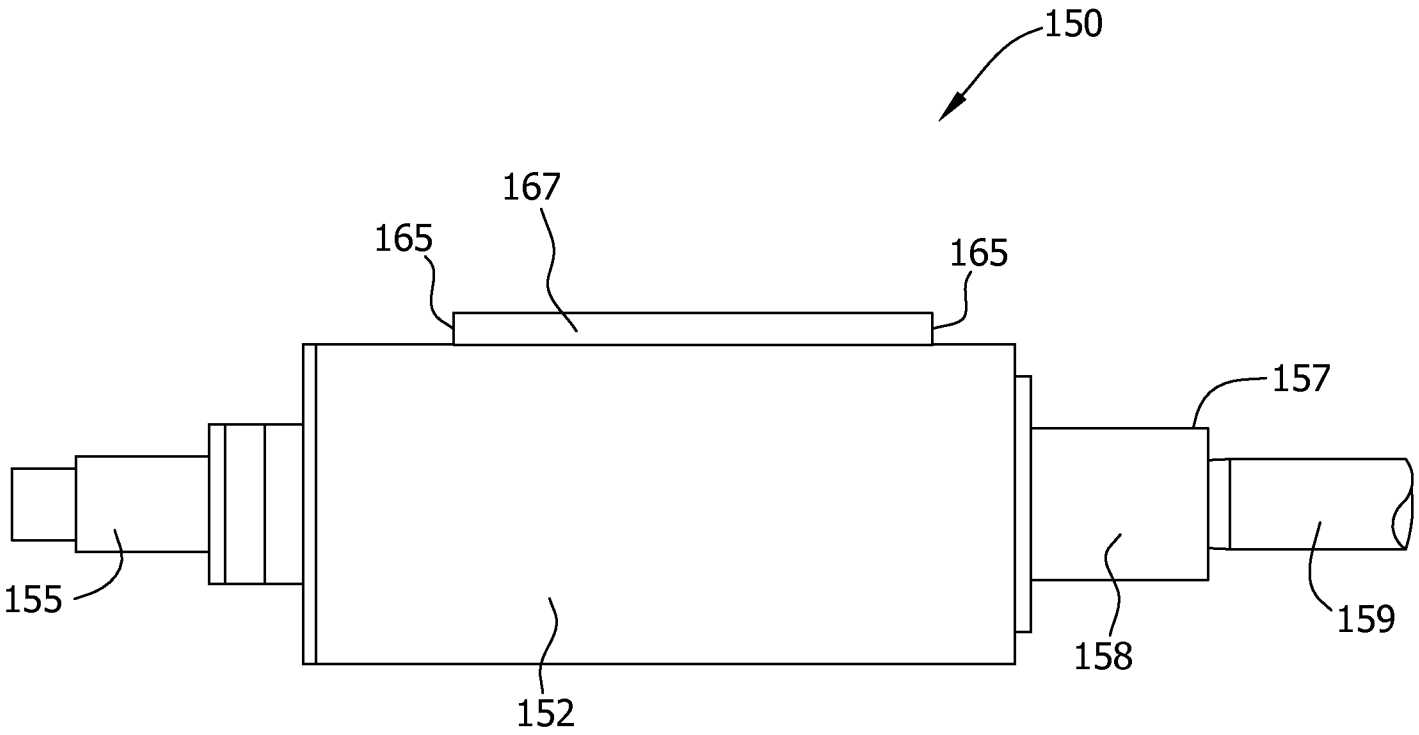
FIG. 14 is a right side view of the oscillating member.
Figure 15:
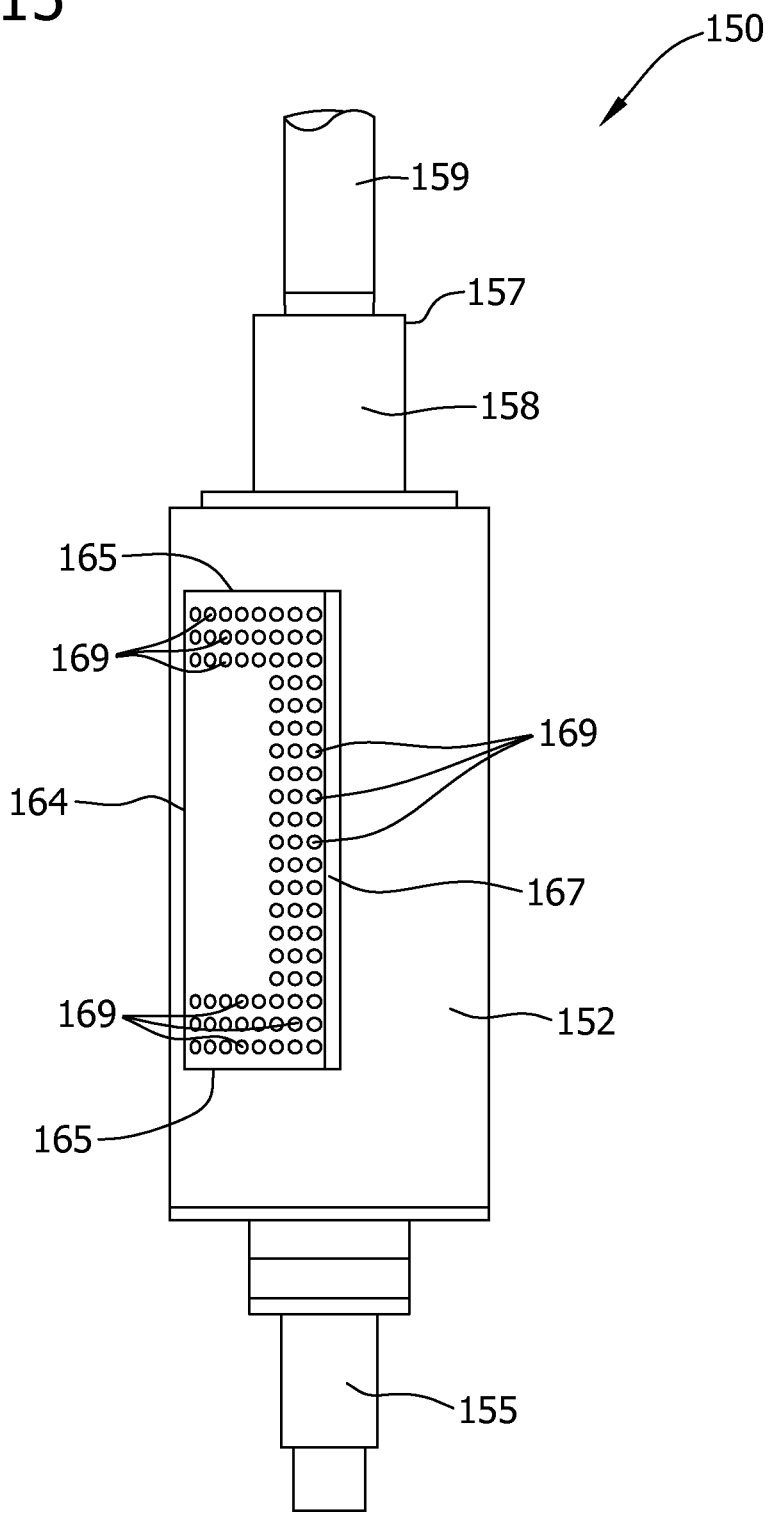
FIG. 15 is a top view of the oscillating member.
Figure 16:
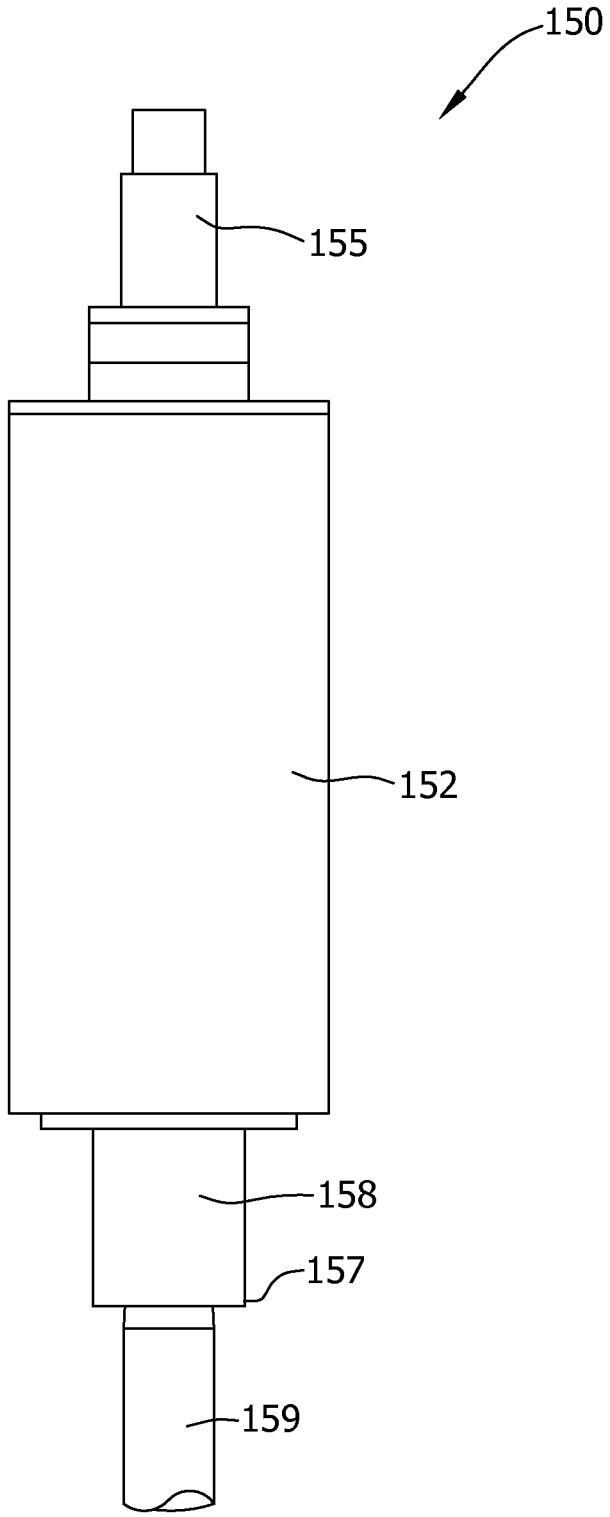
FIG. 16 is a bottom view of the oscillating member.
Figure 17:
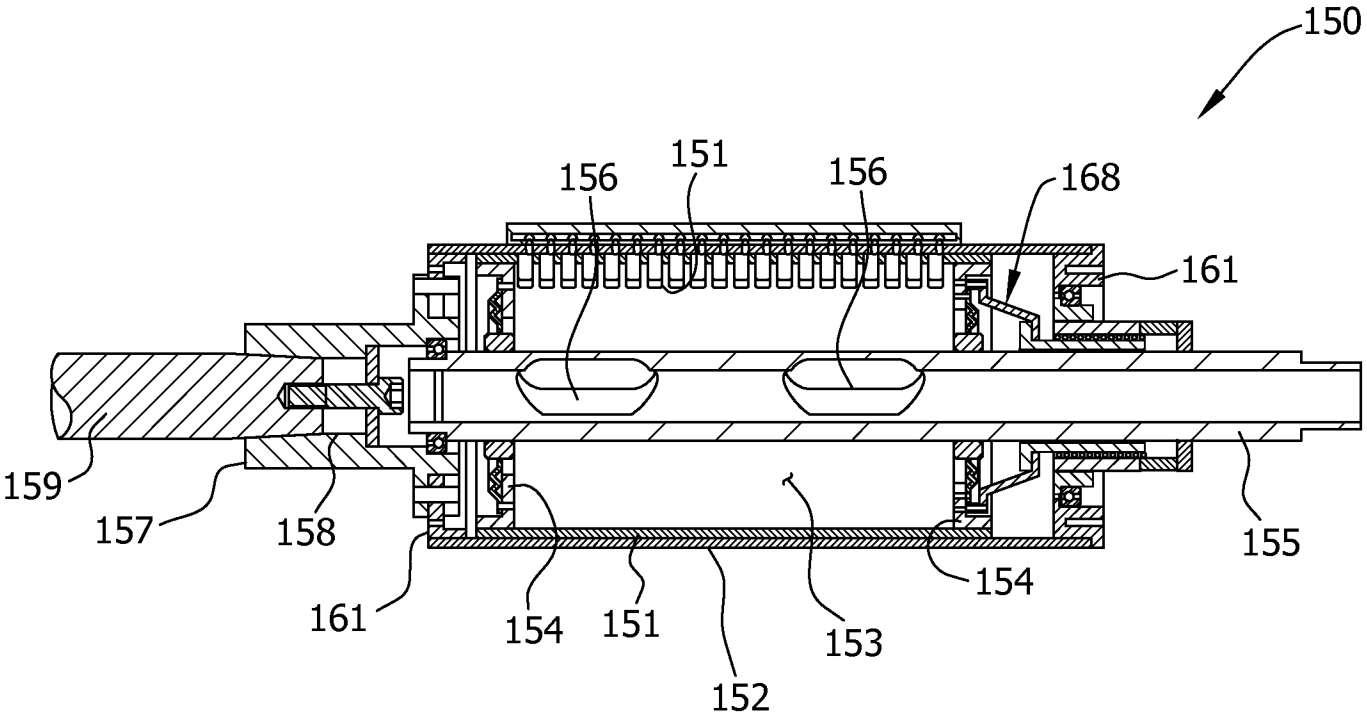
FIG. 17 is a vertical cross-section of the oscillating member.

With reference now to FIGS. 12-22, the oscillating member 150 comprises an inner cylinder 151 and an outer cylinder 152 that is rotatable about the inner cylinder. As seen in FIGS. 12 and 13, the outer cylinder 152 comprises a raised puck 164 (broadly, "an engagement area") adapted to receive a portion of the training pant from the receiving roll 110 and to transfer the portion to the folding roll 170. The puck 164 includes a pair of lateral sides 165, a pair of longitudinal sides 167, and a plurality of circular apertures 169 arranged generally adjacent the lateral sides and one of the longitudinal sides. As a result, a portion of the puck 164 is free of apertures 169. The outer cylinder 152 is closed by a pair of end plates 161 (FIG. 17).

It is understood that the puck 164 can be flush with the remainder of the outer cylinder 152 of the oscillating member 150 (i.e., not raised). It is further understood that the apertures 169 in the puck 164 of the outer cylinder 152 can be arranged differently, that there could be more or fewer apertures than illustrated in the accompanying drawings, and that the apertures can have different shapes and sizes than those illustrated.

Figure 18:
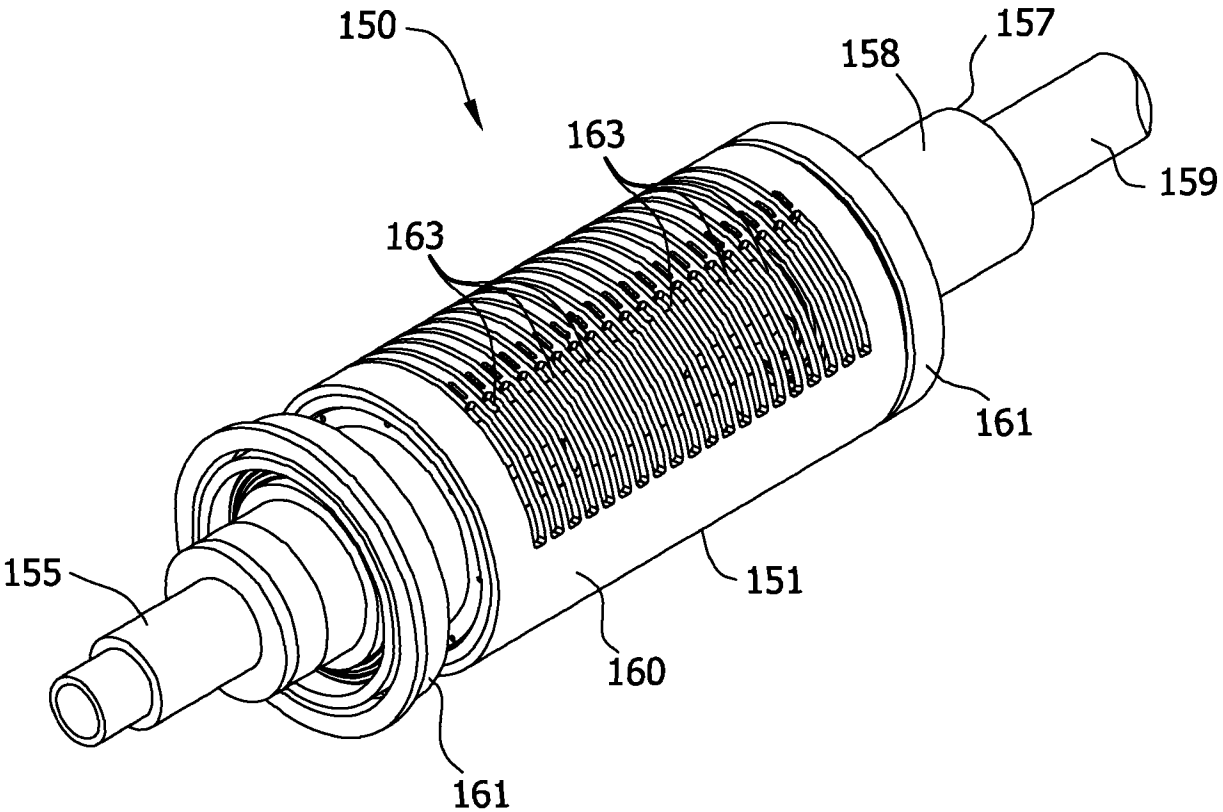
FIG. 18 is a perspective of the oscillating member with an outer cylinder of the oscillating member removed.
Figure 19:
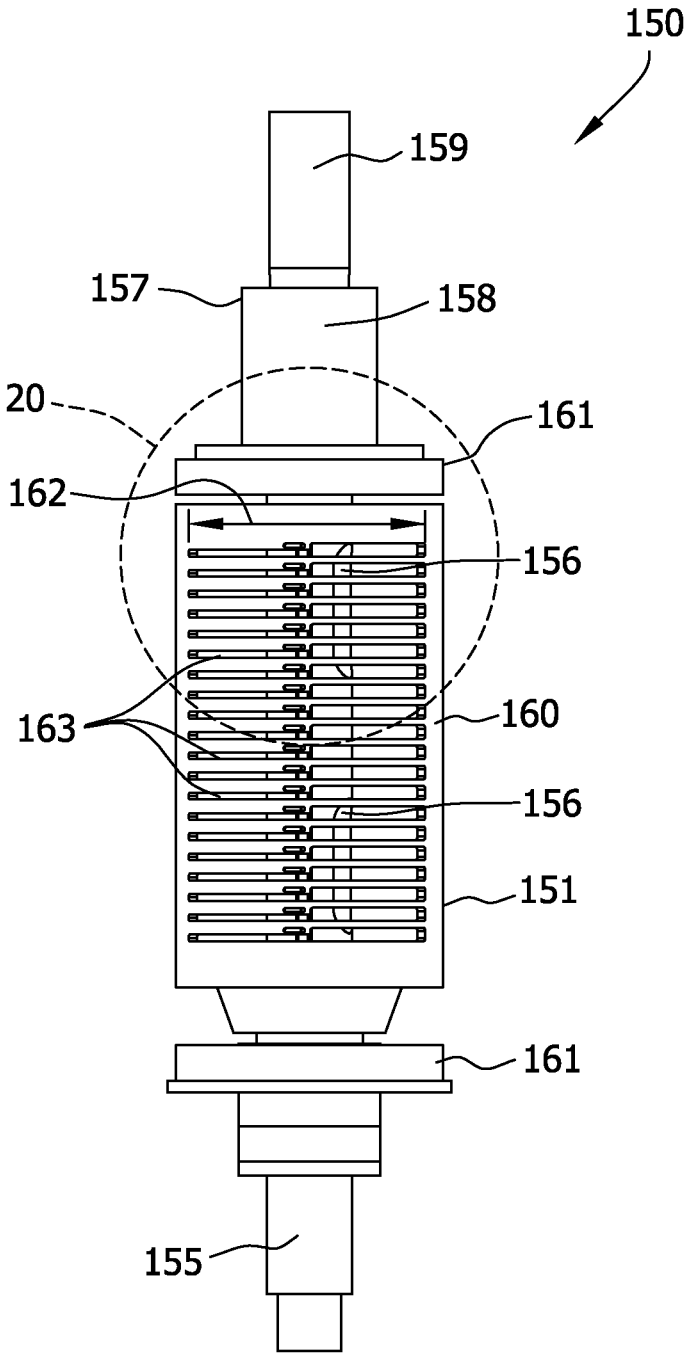
FIG. 19 is a top elevation of the oscillating member with the outer cylinder removed as seen in FIG. 18.
Figure 20:
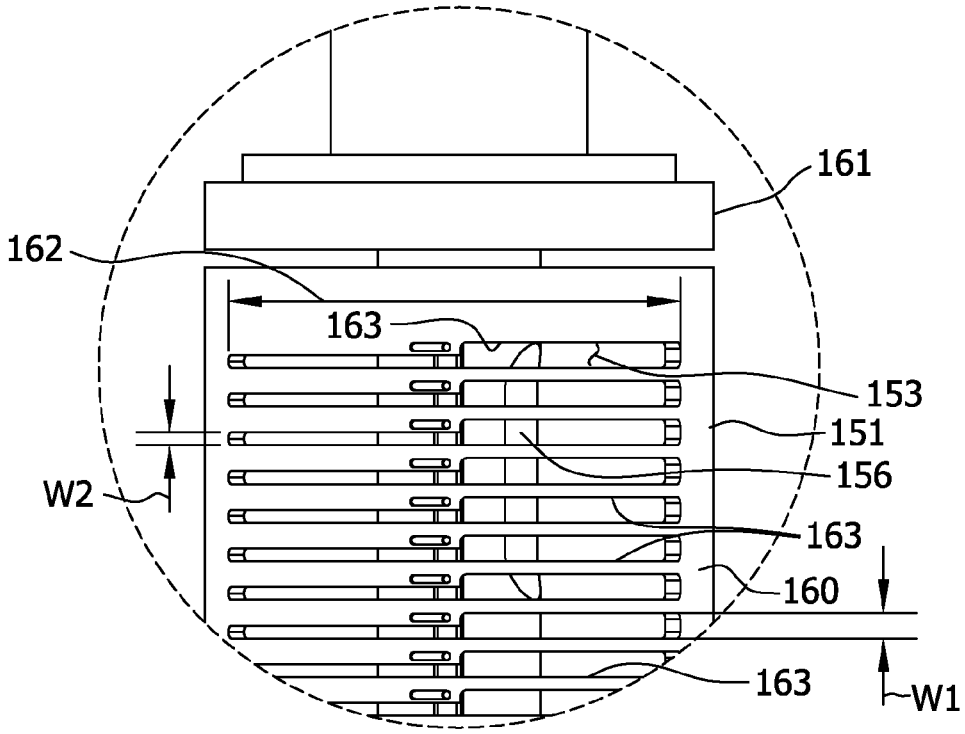
FIG. 20 is an enlarged view of a portion of the oscillating member of FIG. 19.

In the illustrated embodiment, the inner cylinder 151 does not rotate and defines an interior chamber 153 (FIGS. 17 and 20). With reference to FIGS. 18-20, the inner cylinder 151 comprises a wall 160 having a slotted segment 162 with a plurality of slots 163. Each of the slots 163 varies along its length from a first width W1 to a narrower second width W2 (FIG. 20). A pair of end plates 154 is disposed adjacent the ends of the inner cylinder 151 and closes the interior chamber 153 (FIG. 17). A conduit 155 extends into and is in fluid communication with the interior chamber 153 for allowing a suitable vacuum source (not shown) to apply a vacuum thereto. In one suitable embodiment, the conduit 155 extends through the interior chamber 153 and has a pair of oval openings 156 that open within the interior chamber (FIG. 17). It is understood that the conduit 155 may extend only partially into the interior chamber 153 and that the openings 156 in the conduit can vary in shape, size and number.

A drive assembly 157 is operatively connected to the outer cylinder 152 for rotating the outer cylinder with respect to the inner cylinder 151. The drive assembly 157 includes a hub 158, a shaft 159 coupled to the hub and a suitable drive mechanism (not shown) capable of rotating the shaft and the hub.

Figure 21:
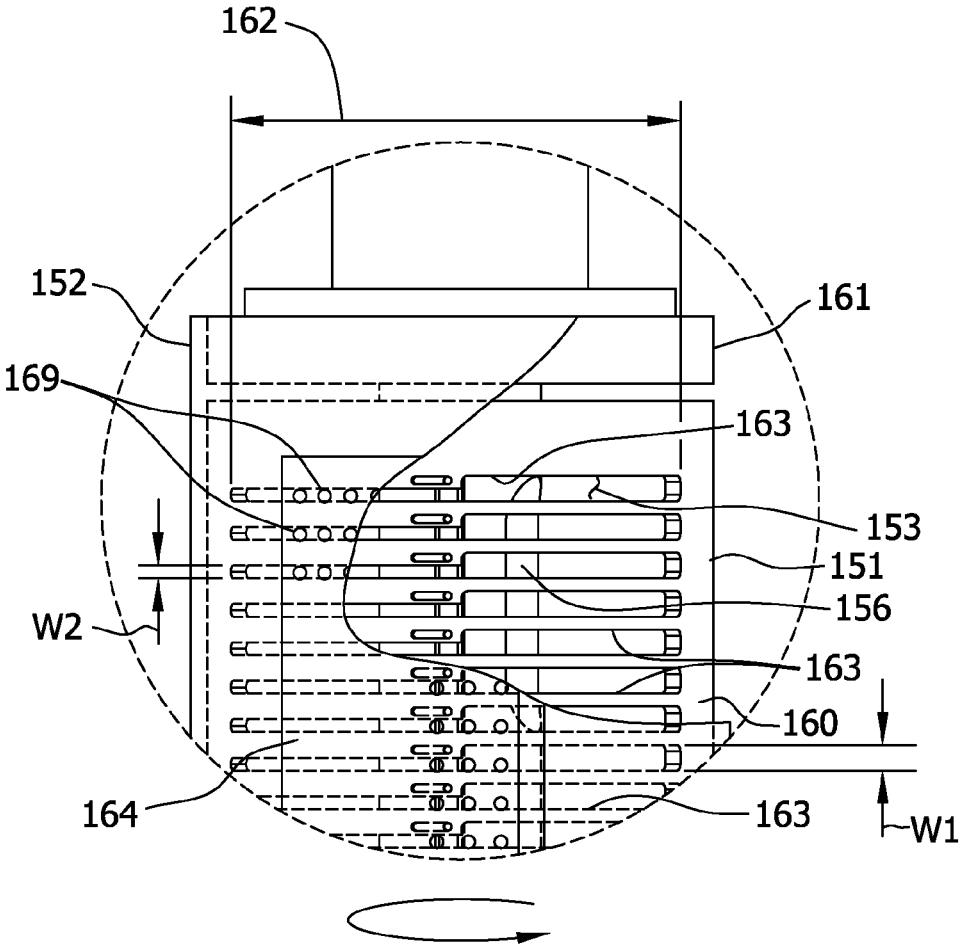
FIG. 21 is a view similar to FIG. 20 but showing the outer cylinder overlying the inner cylinder, the inner cylinder being in a first position and a portion of the outer cylinder being cut away.
Figure 22:
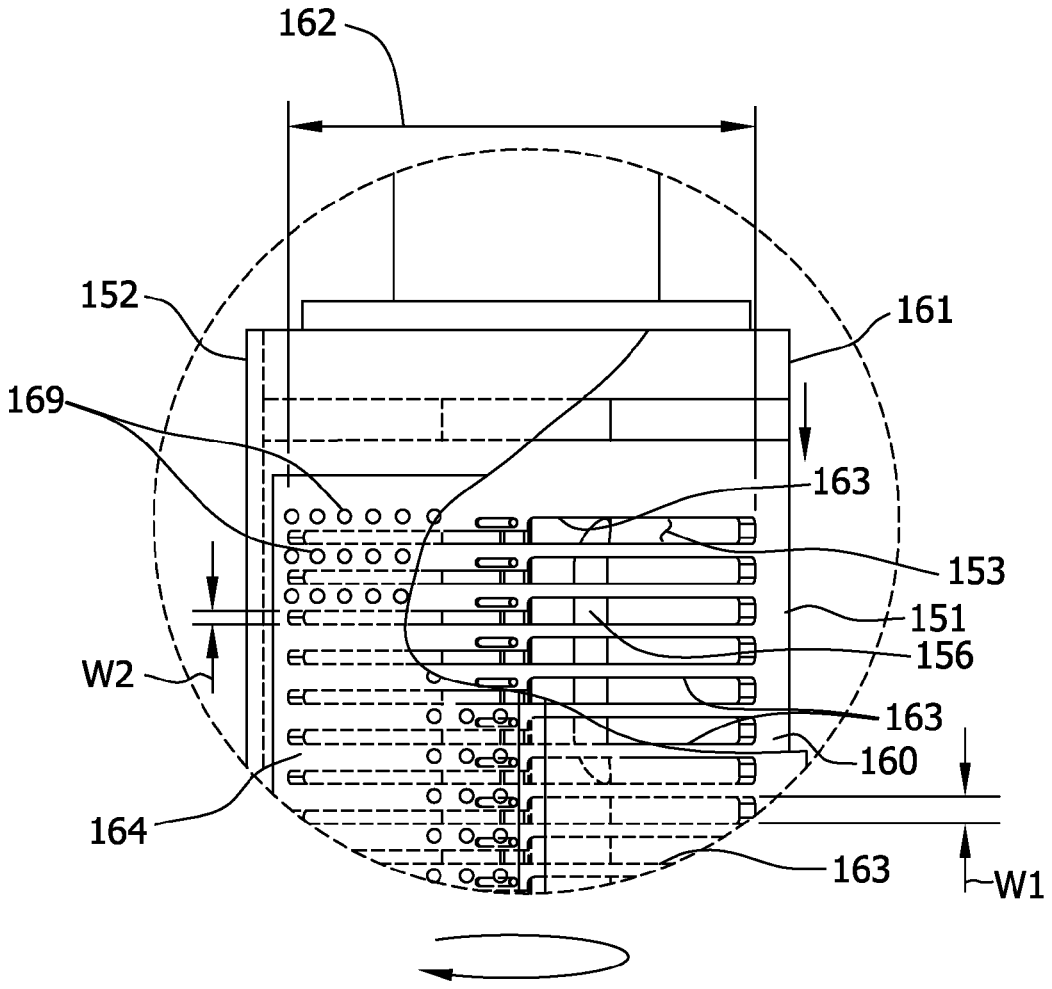
FIG. 22 is a view similar to FIG. 20 but showing the inner cylinder moved relative to the outer cylinder to a second position.
Figure 23:
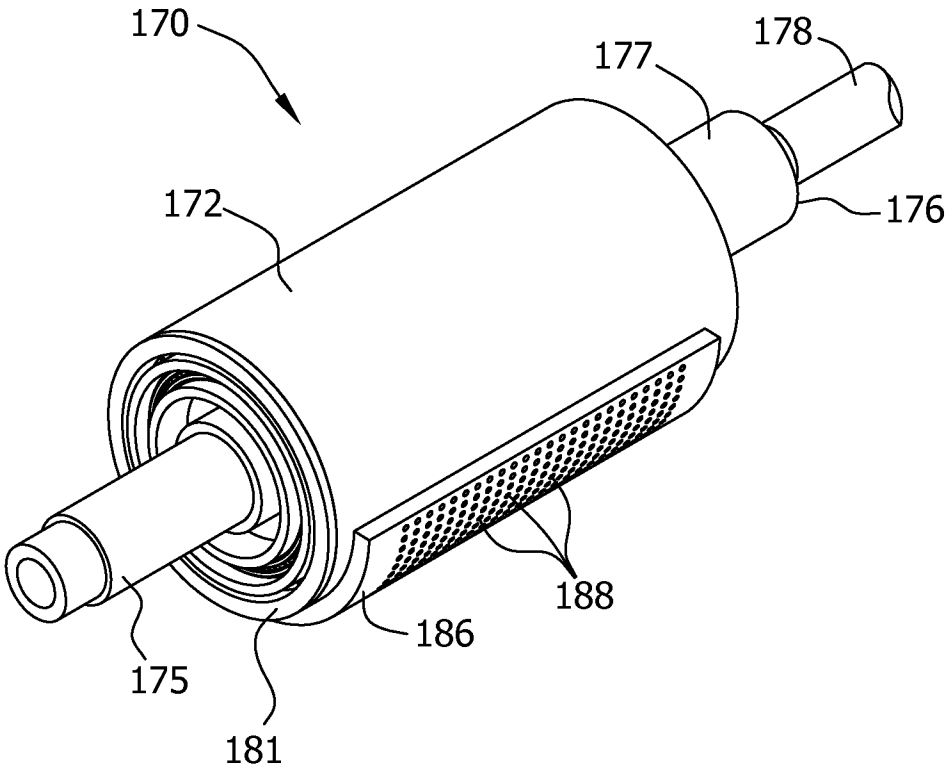
FIG. 23 is a perspective of the folding roll of the folding apparatus.

With reference now to FIGS. 17, 21 and 22, an actuator 168 is provided for translating the inner cylinder axially with respect to the outer cylinder 152 from a first position to a second position. In the illustrated embodiment, the actuator is adapted to translate the inner cylinder 151 axially (downward as viewed in FIGS. 21 and 22) with respect to the outer cylinder 152.

In the first position, which is illustrated in FIG. 21, the apertures 169 in the puck 164 of the oscillating member 150 are aligned with the slots 163 in the slotted segment 162 of the inner cylinder 151 along their entire length. That is, the apertures 169 in the puck 164 align with both the narrower and wider portions of the slots 163 in the inner cylinder 151. In the second position, however, the apertures 169 in the puck 164 of the oscillating member 150 only align with the wider portion of slots 163 (FIG. 22). Thus, the apertures 169 in the puck 164 of the oscillating member 150 do not align with the narrower portions of the slots 163 when the inner cylinder is in the second position.

As a result, the oscillating member 150 has a first vacuum profile with the inner cylinder 151 in the first position, and a second vacuum profile with the inner cylinder in the second position. That is, the vacuum is turned on and off at different points by the oscillating member when the inner cylinder is in the first position as compared to the inner cylinder being in the second position.

In the illustrated embodiment, the actuator 168 comprises a voice coil motor (FIG. 17). The voice coil motor is capable of developing force in either direction depending upon the polarity of the current applied thereto. Thus, the voice coil motor is capable of braking, damping, and holding forces. In one suitable embodiment, the voice coil motor is capable of displacing more than 15 mm at frequencies up to 40 or 50 Hz. In the illustrated embodiment, for example, the input current is preset so that the voice coil motor displaces the inner cylinder 151 approximately 5 millimeters (mm). More specifically, the inner cylinder 151 is illustrated in the first position in FIG. 21, which corresponds to the normal position of the voice coil motor. When the preset input current is applied to the voice coil motor, the voice coil motor acts on the inner cylinder 151 to translate the inner cylinder axially approximately 5 mm with respect to the outer cylinder 152. In other words, the voice coil motor moves the inner cylinder 151 to the second position. It is contemplated that the inner cylinder 151 can move more or less than 5 mm with respect to the outer cylinder 152. It is understood that other types of suitable actuators besides voice coil motors can be used to move the inner cylinder 151 relative to the outer cylinder 152.

Figure 24:
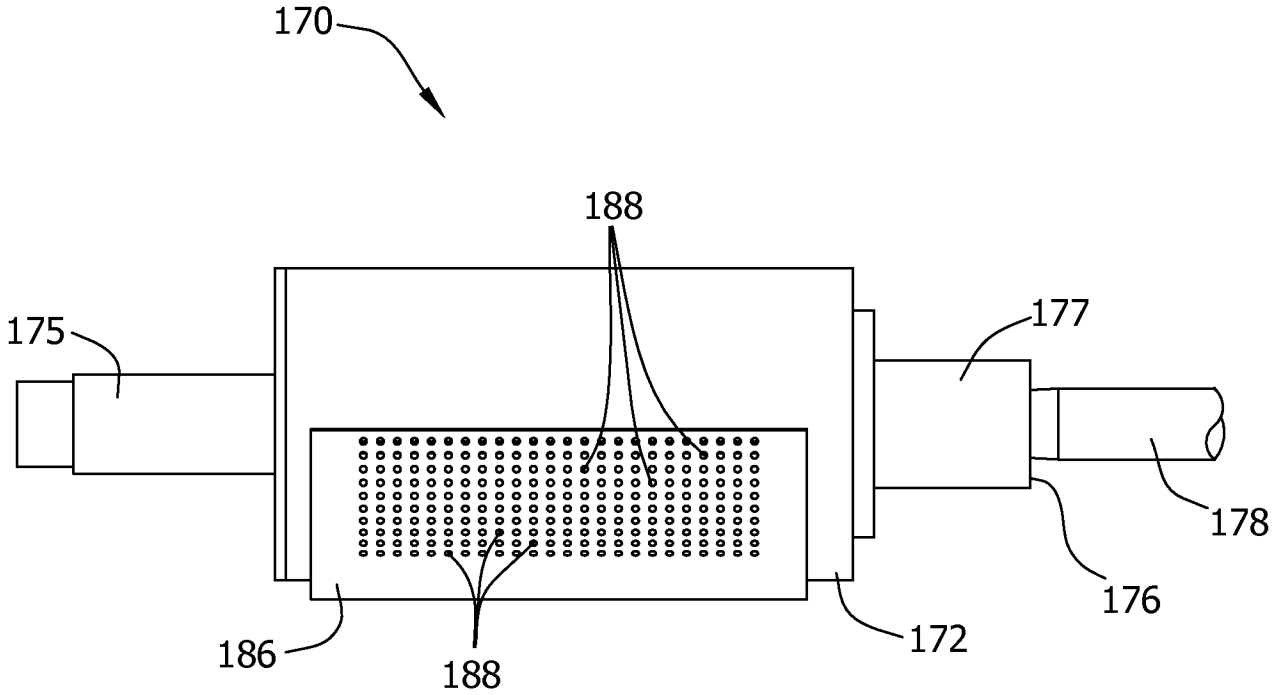
FIG. 24 is a right side view of the folding roll as seen in FIG. 23.
Figure 25:
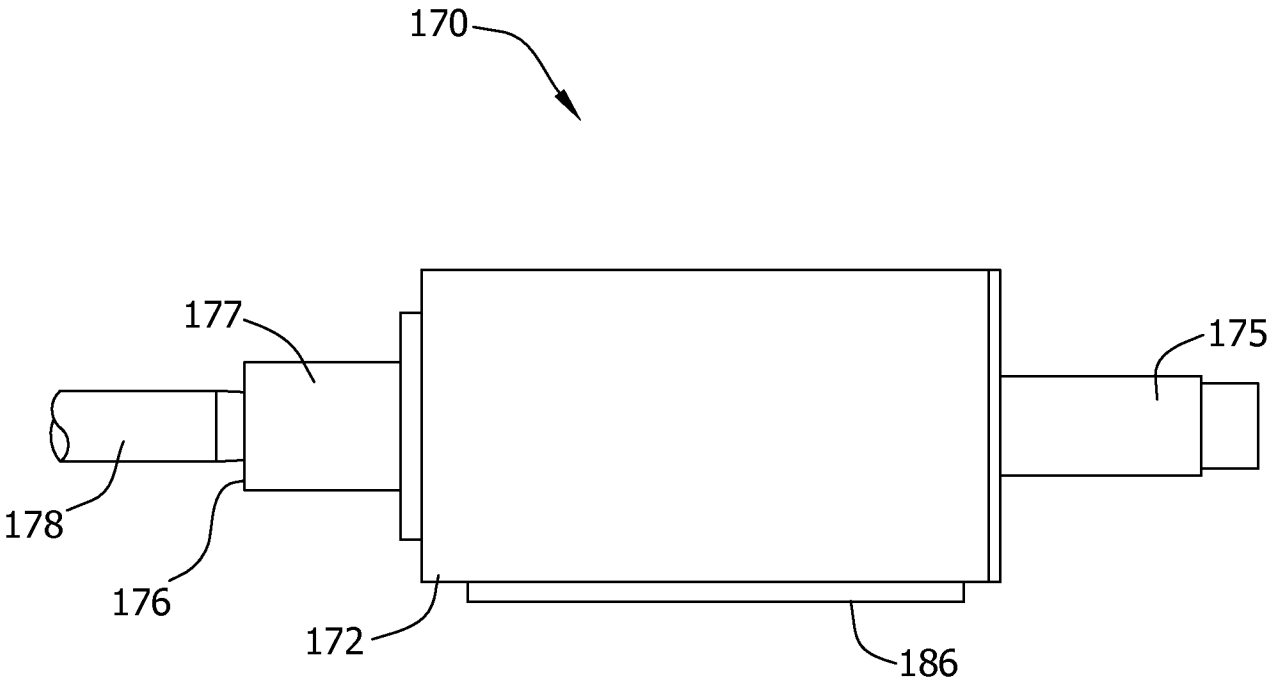
FIG. 25 is a left side view of the folding roll.
Figure 26:
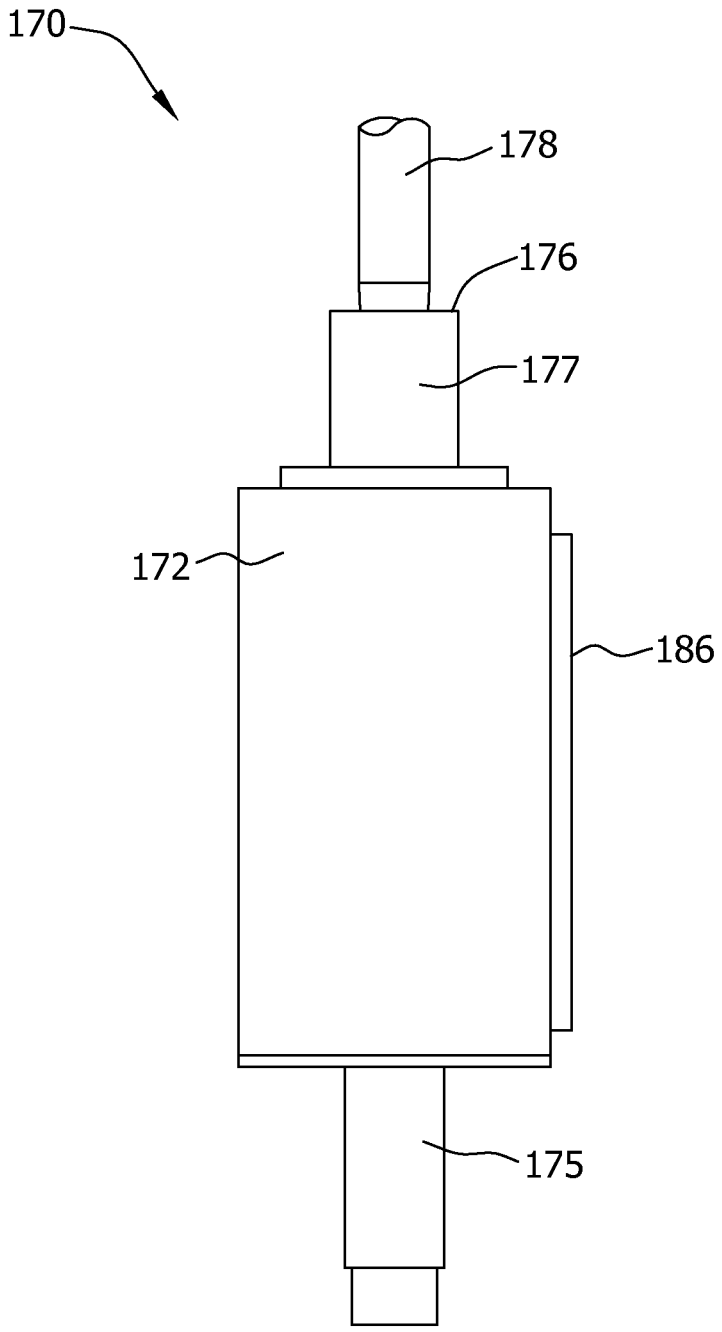
FIG. 26 is a bottom view of the folding roll.
Figure 27:
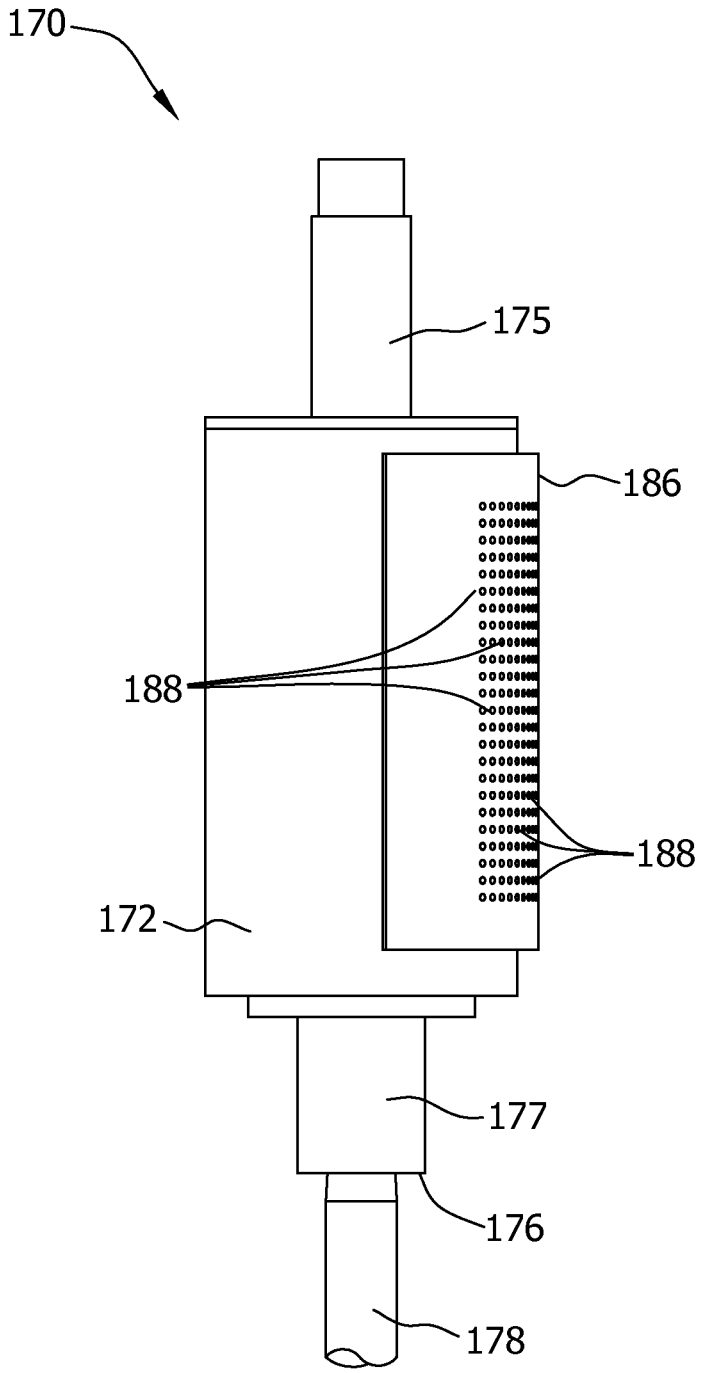
FIG. 27 is a top view of the folding roll.
Figure 28:
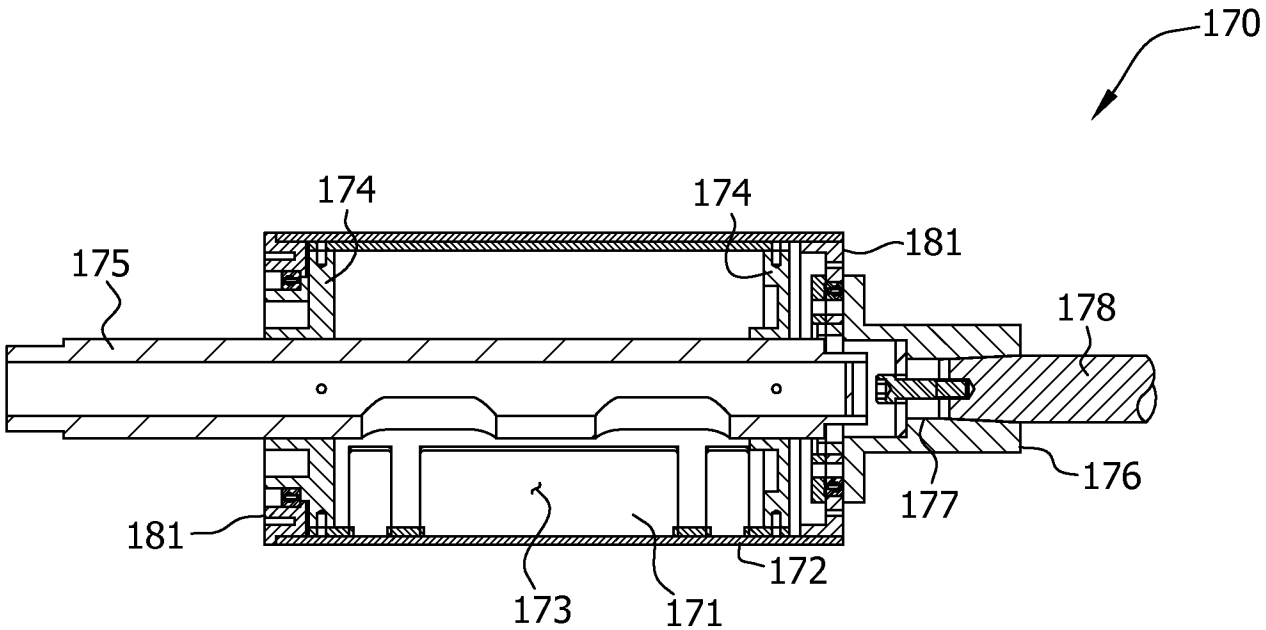
FIG. 28 is a vertical cross-section of the folding roll.

As illustrated in FIGS. 23-30, the folding roll 170 comprises an inner cylinder 171 and an outer cylinder 172 that is rotatable about the inner cylinder. As seen in FIGS. 23-27, the outer cylinder 172 comprises a raised puck 186 adapted to receive the portion of the training pant 500 from the oscillating member 150 and to transfer the portion to the receiving roll 110. The raised puck 186 includes a plurality of circular apertures 188 arranged generally in a rectangle (FIG. 24). It is understood, however, that the raised puck 186 can be flush with the remainder of the outer cylinder 172 (i.e., not raised). It is further understood that the apertures 188 in the puck 186 of the outer cylinder 172 can be arranged differently, that there could be more or fewer apertures than illustrated in the accompanying drawings, and that the apertures can have different shapes and sizes than those illustrated. The outer cylinder 172 is closed by a pair of end plates 181 (FIG. 28).

Figure 29:
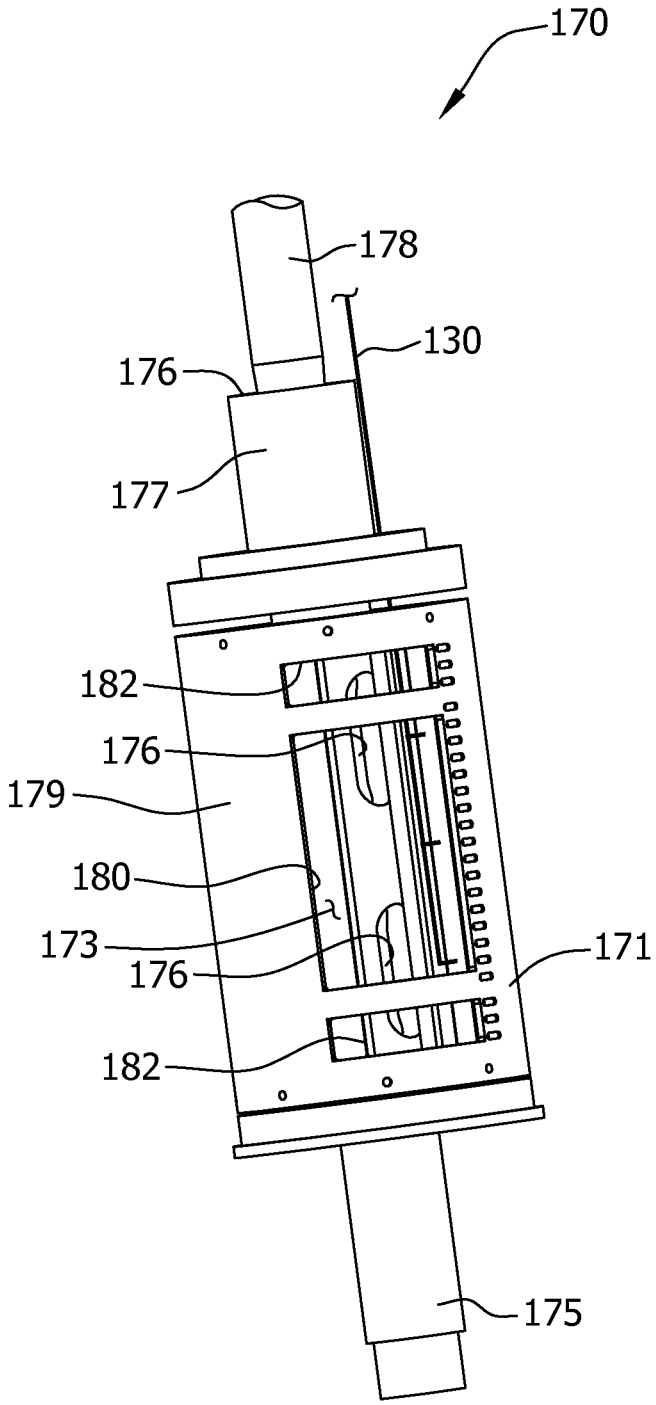
FIGS. 29 and 30 are perspectives of the folding roll with an outer cylinder of the folding roll removed.
Figure 30:
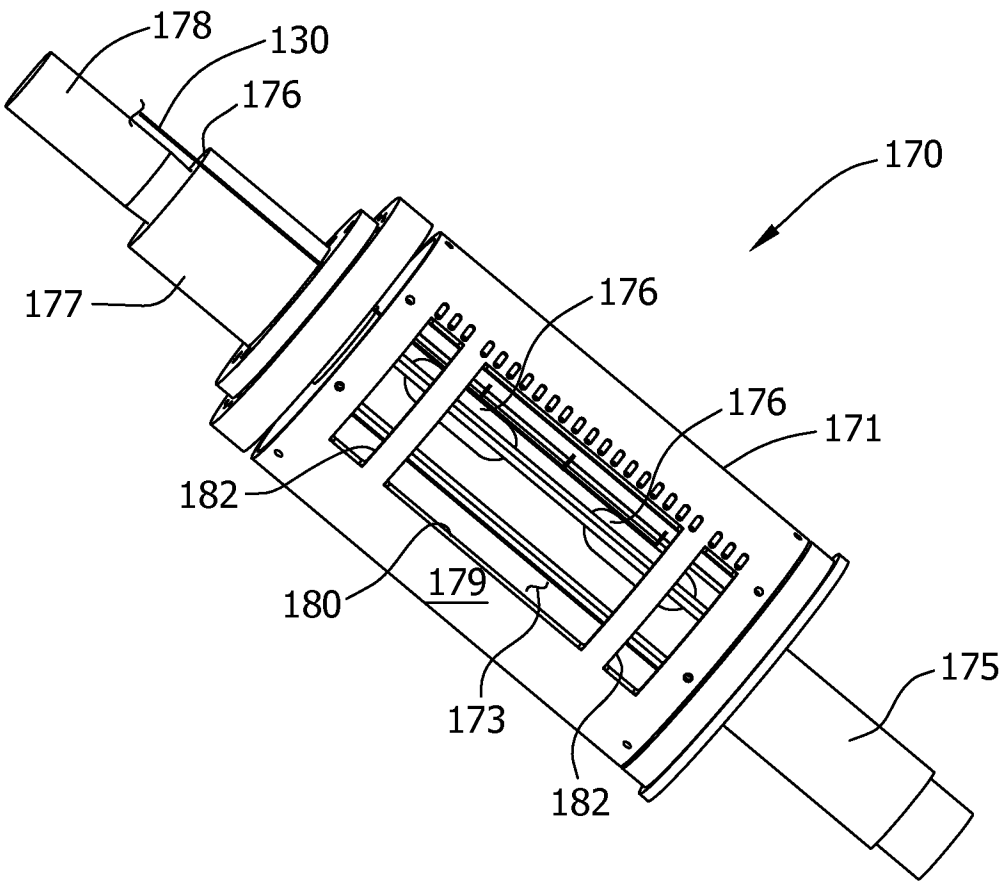
Figure 31:
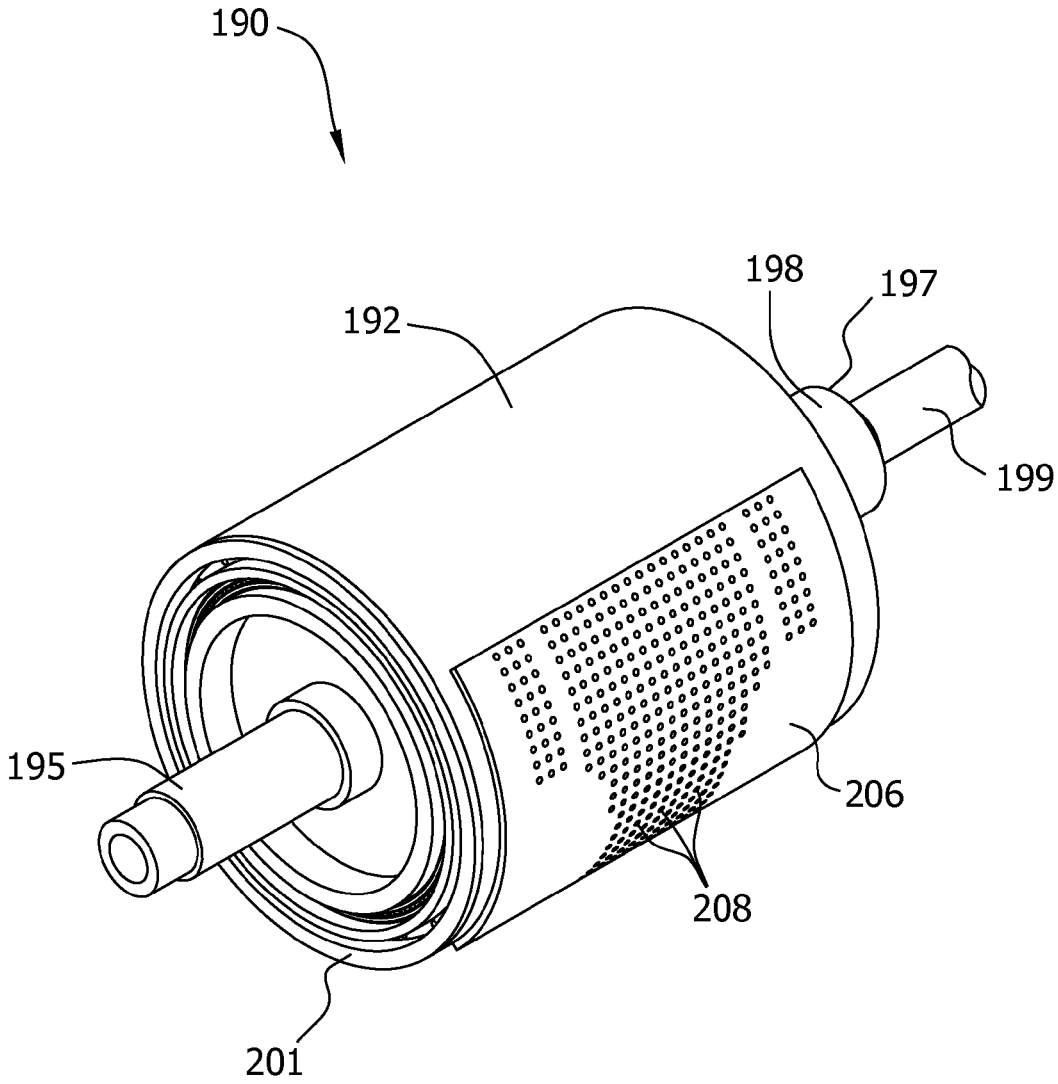
FIG. 31 is a perspective of the transferring roll of the folding apparatus.

In the illustrated embodiment, the inner cylinder 171 is stationary and defines an interior chamber 173 (FIGS. 28-30). As illustrated in FIGS. 29 and 30, the inner cylinder 171 comprises a wall 179 having a primary rectangular opening 180 and pair of secondary rectangular openings 182 flanking the primary opening. It is understood that the openings 180, 182 in the inner cylinder 171 can have other shapes and configurations than rectangular and that the second openings can be omitted. A pair of end plates 174 are disposed adjacent the ends of the inner cylinder 171 and closes the interior chamber 173 (FIG. 28). A conduit 175 extends into and is in fluid communication with the interior chamber 173 for allowing a suitable vacuum source (not shown) to apply a vacuum thereto. In the illustrated embodiment, the conduit 175 extends through the interior chamber 173 and has a pair of oval openings 176 that opens within the interior chamber (FIGS. 29 and 30). It is understood that the conduit 175 may extend only partially into the interior chamber and that the openings in the conduit can vary in shape, size and number.

A drive assembly 176 is operatively connected to the outer cylinder 172 for rotating the outer cylinder with respect to the inner cylinder 171. The drive assembly 176 includes a hub 177, a shaft 178 coupled to the hub, and a suitable drive mechanism (not shown) capable of rotating the shaft and hub.

Figure 32:
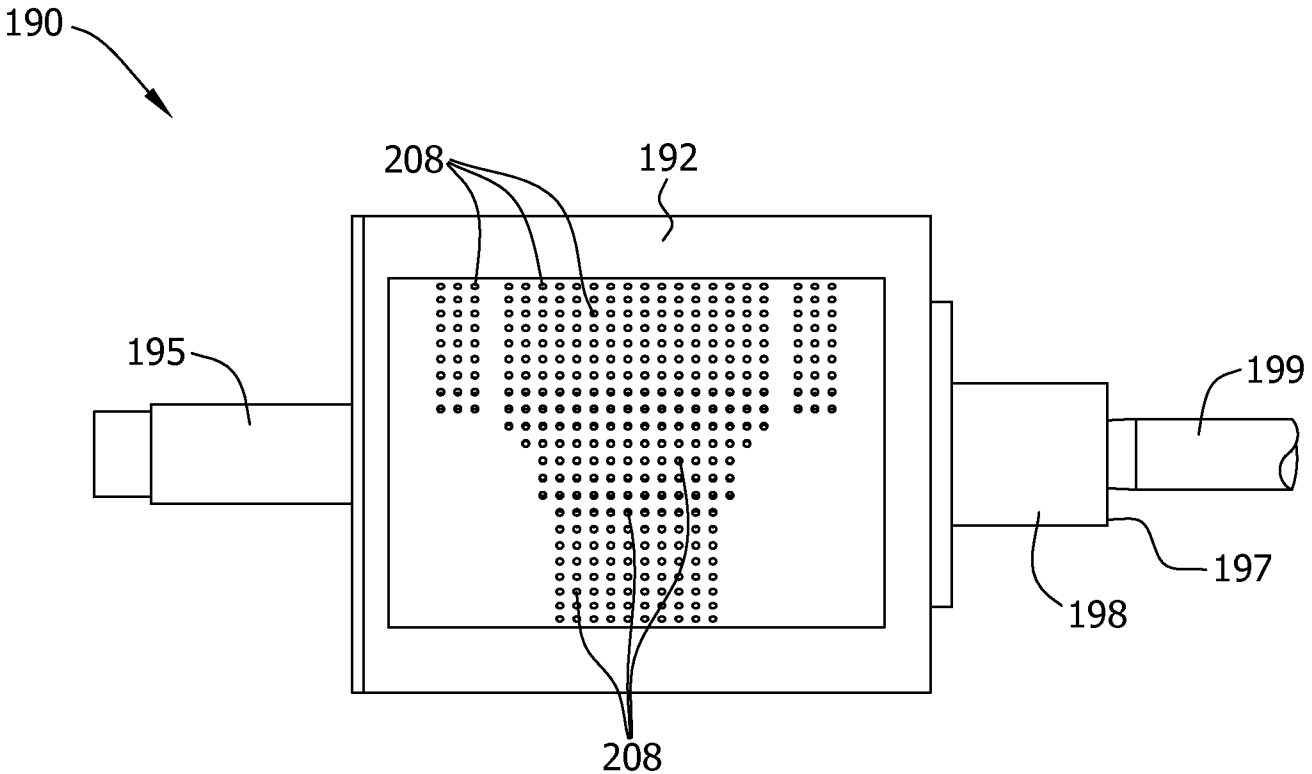
FIG. 32 is a right side view of the transferring roll as seen in FIG. 31.
Figure 33:
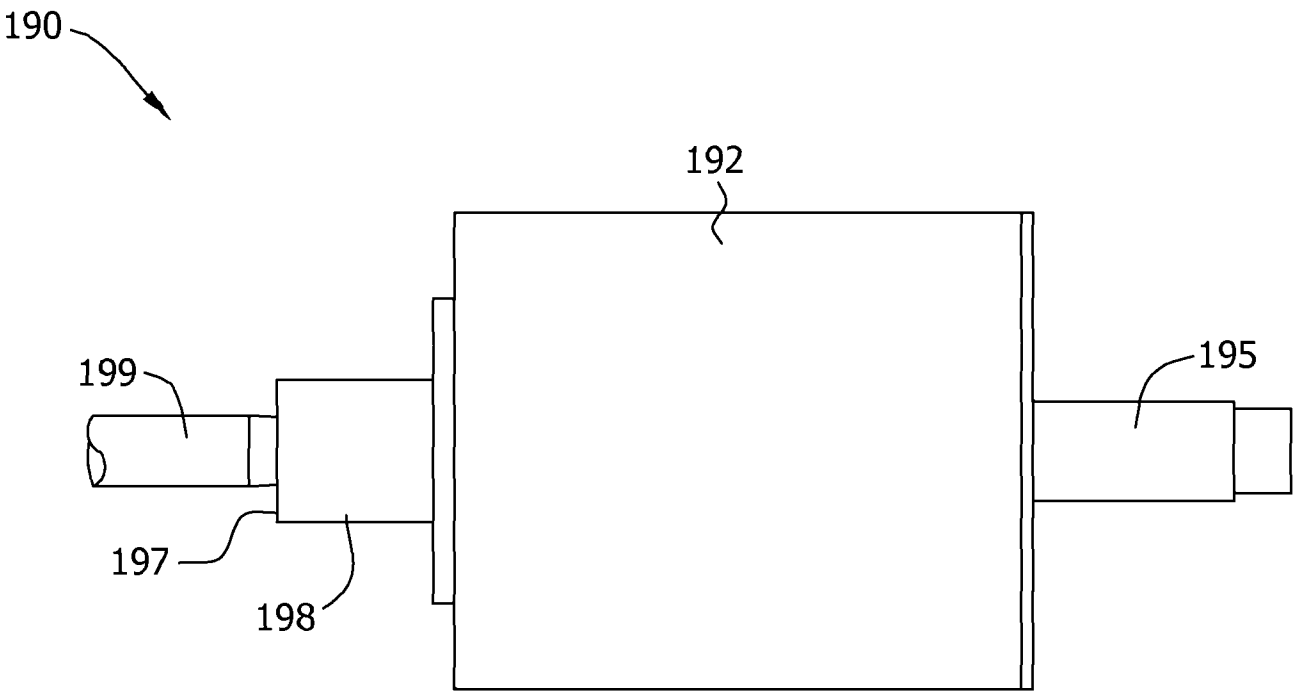
FIG. 33 is a left side view of the transferring roll.
Figure 34:
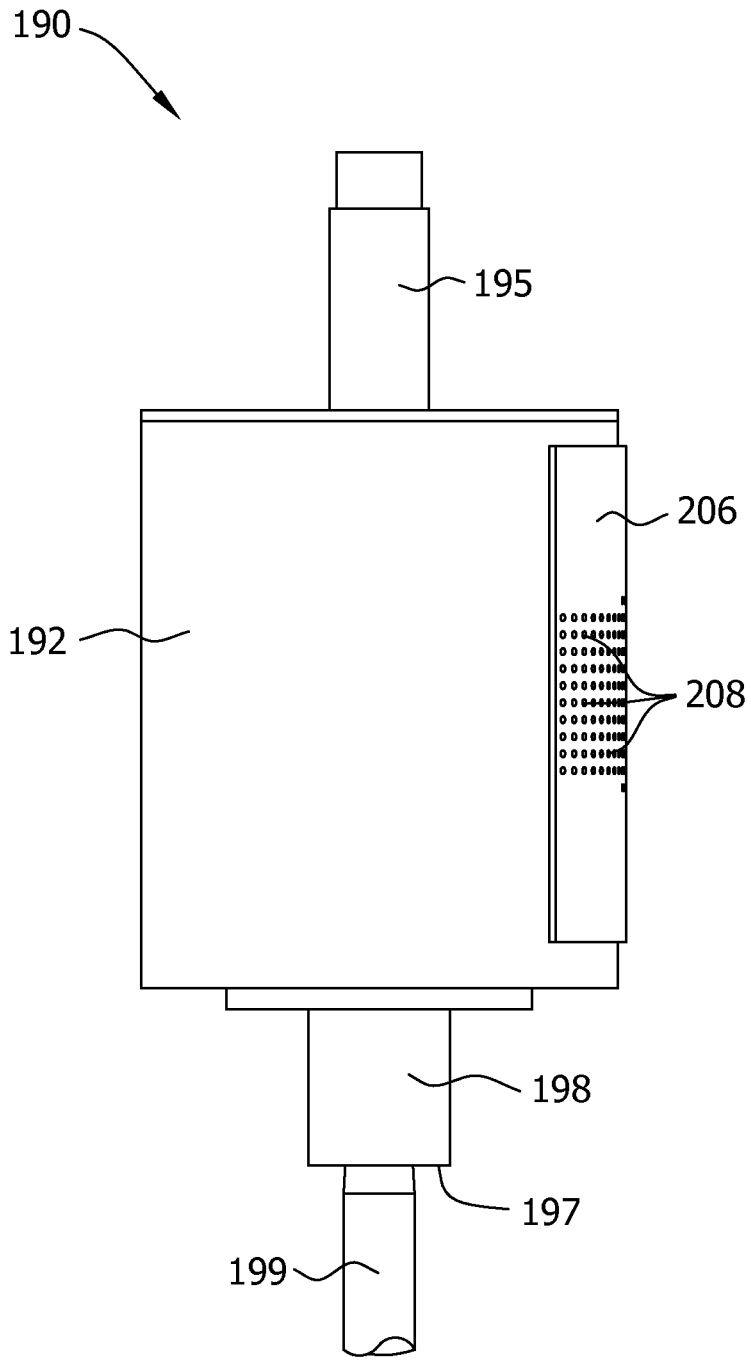
FIG. 34 is a bottom view of the transferring roll.
Figure 35:
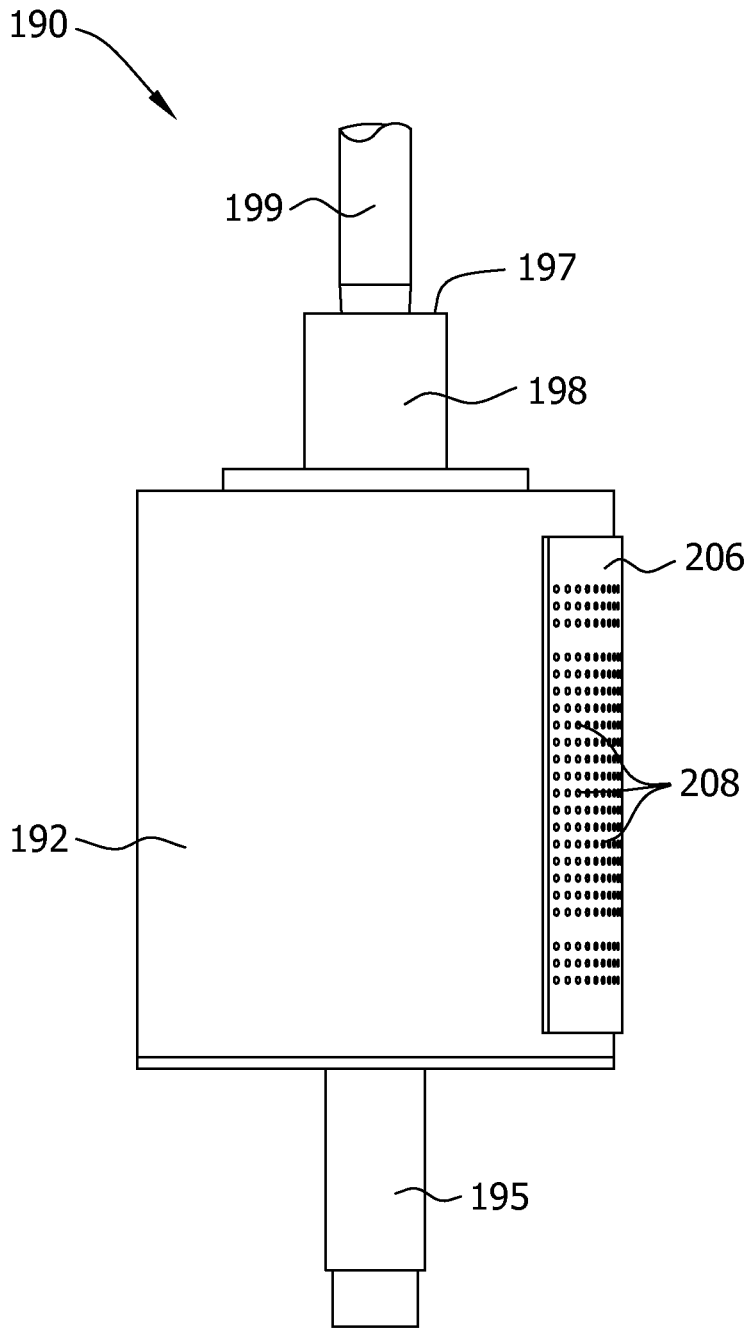
FIG. 35 is a top view of the transferring roll.
Figure 36:
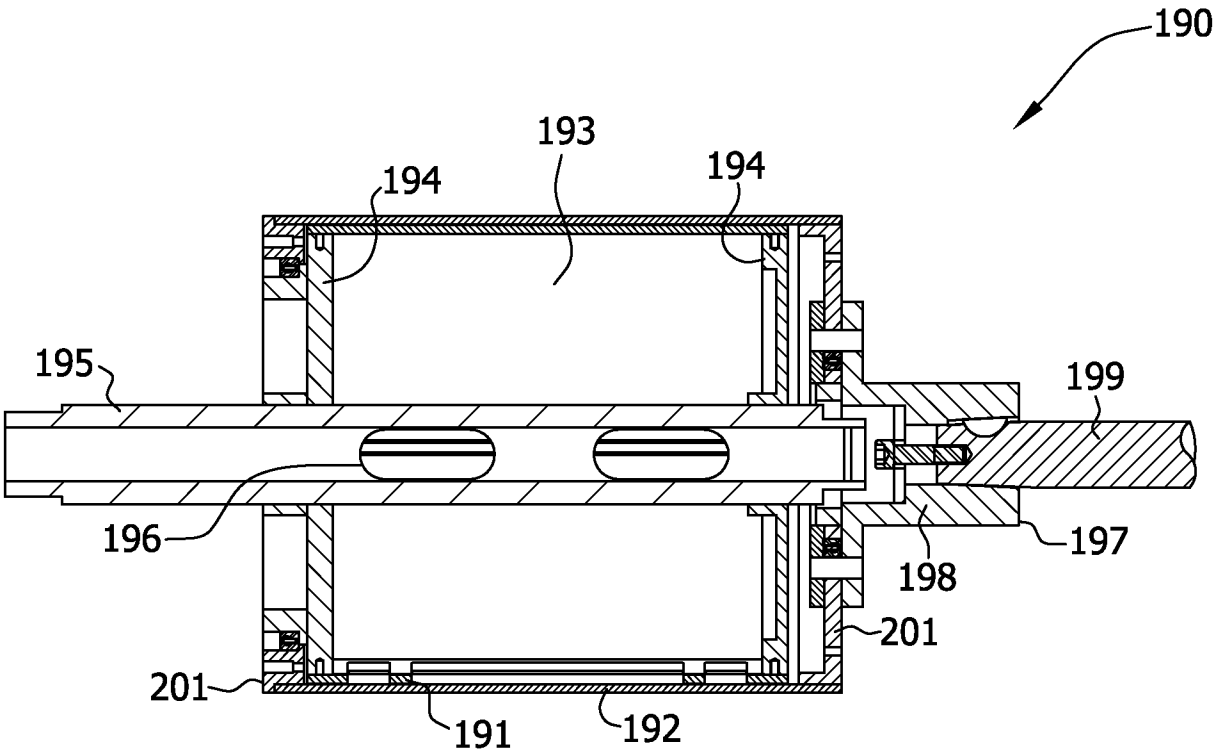
FIG. 36 is a vertical cross-section of the transferring roll.

As seen in FIGS. 31-38, the transferring roll 190 comprises an inner cylinder 191 and an outer cylinder 192 that is rotatable about the inner cylinder. With references to FIGS. 32, 34, and 35, the outer cylinder 192 comprises a raised engagement member 206 adapted to receive the training pant 500 in its folded configuration from the receiving roll 110. The raised engagement member 206 includes a plurality of circular apertures 208 arranged generally in the profile of the training pant 500 in its folded configuration (FIG. 32). It is understood, however, that the raised engagement member 206 can be flush with the remainder of the outer cylinder 192 (i.e., not raised). It is further understood that the apertures 208 in the engagement member 206 of the outer cylinder 192 can be arranged differently, that there could be more or fewer apertures than illustrated in the accompanying drawings, and that the apertures can have different shapes and sizes than those illustrated. The outer cylinder 192 is closed by a pair of end plates 201 (FIG. 36).

Figure 37:
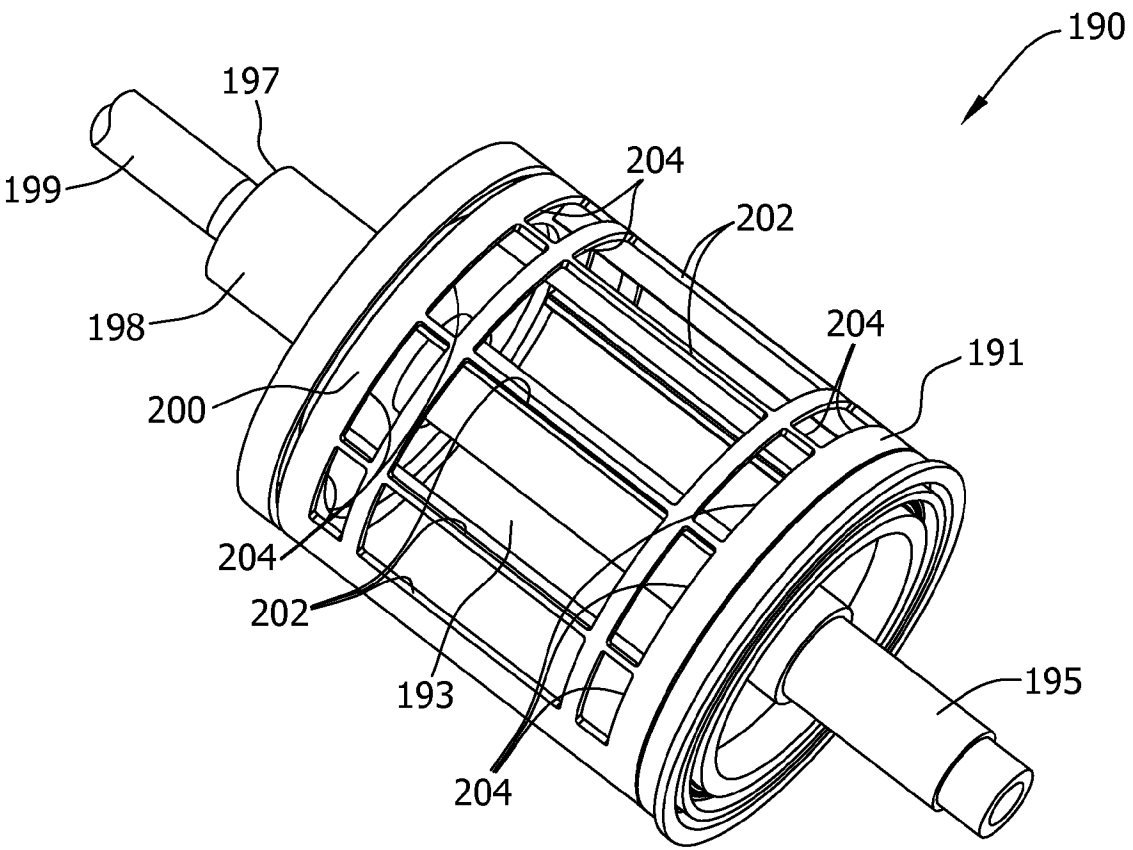
FIG. 37 is a perspective of the transferring roll with an outer cylinder of the transferring roll removed.
Figure 38:
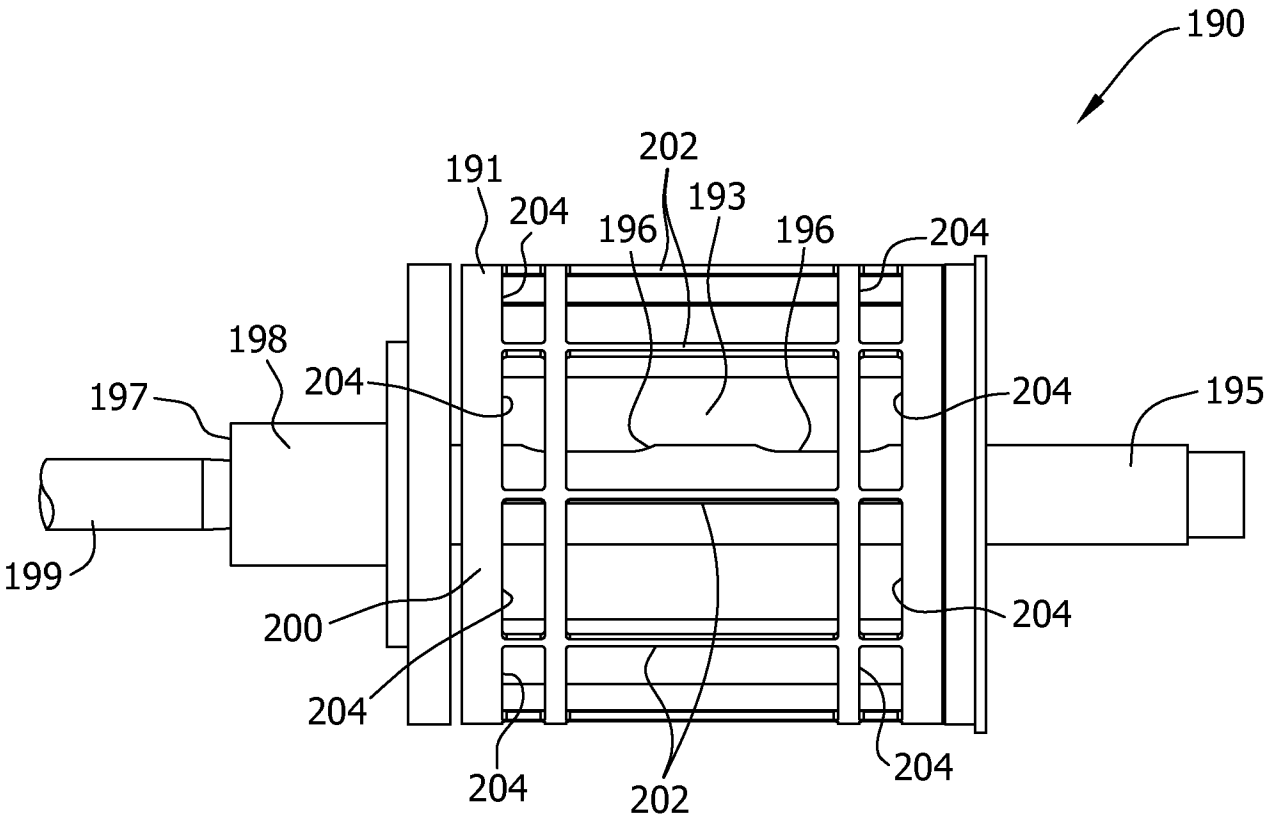
FIG. 38 is a top view of the transferring roll with the outer cylinder removed.

In the illustrated embodiment, the inner cylinder 191 is stationary and defines an interior chamber 193 (FIGS. 36-38). As seen in FIGS. 37 and 38, the inner cylinder 191 comprises a wall 200 having five primary rectangular openings 202 with each of the primary rectangular openings being flanked by a pair of secondary rectangular openings 204. A pair of end plates 194 are disposed adjacent the ends of the inner cylinder 191 and closes the interior chamber 193 (FIG. 38). A conduit 195 extends into and is in fluid communication with the interior chamber 193 for allowing a suitable vacuum source (not shown) to apply a vacuum thereto. In one suitable embodiment, the conduit 195 extends through the interior chamber 193 and has a pair of oval openings 196 that opens within the interior chamber (FIGS. 36 and 38). It is understood that the conduit 195 may extend only partially into the interior chamber 193 and that the openings 196 in the conduit can vary in shape, size and number.

A drive assembly 197 is operatively connected to the outer cylinder 192 for rotating the outer cylinder with respect to the inner cylinder 191. The drive assembly 197 includes a hub 198, a shaft 199 coupled to the hub, and a suitable drive mechanism (not shown) capable of rotating the shaft and the hub.

Each of the receiving roll 110, the oscillating member 150, the folding roll 170 and the transferring roll 190 are described herein as using vacuum to hold the training pant 500 to their respective outer cylinder. It is contemplated, however, that other suitable structure (e.g., adhesive, frictional members, nano-fabricated hairs) capable of grasping, controlling, and releasing the training pant 500 can be used instead.

Figure 39:
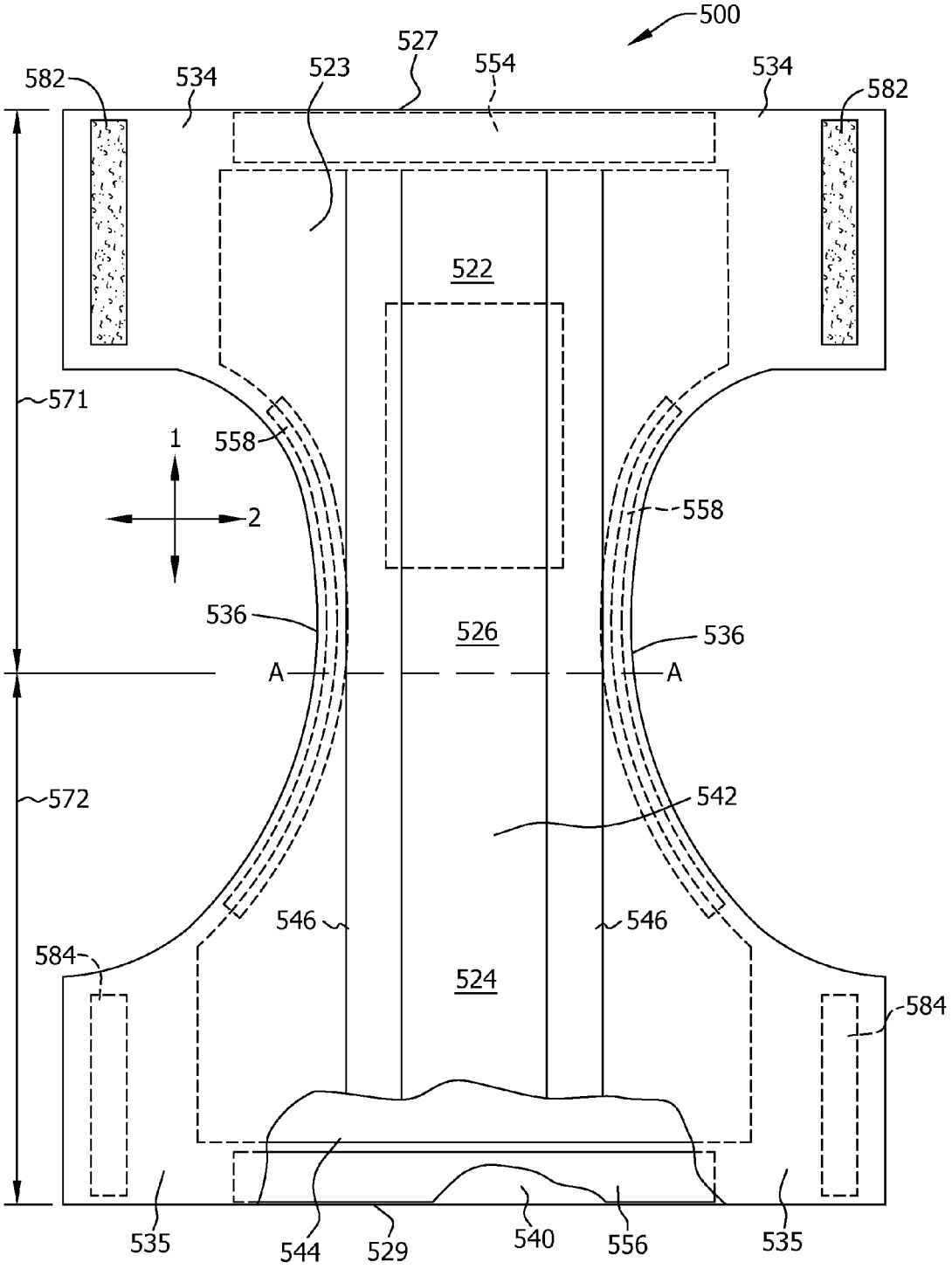
FIG. 39 is a top view of a training pant in a prefolded, laid-flat configuration with portions of the training pant being cut-away.
Figure 40:
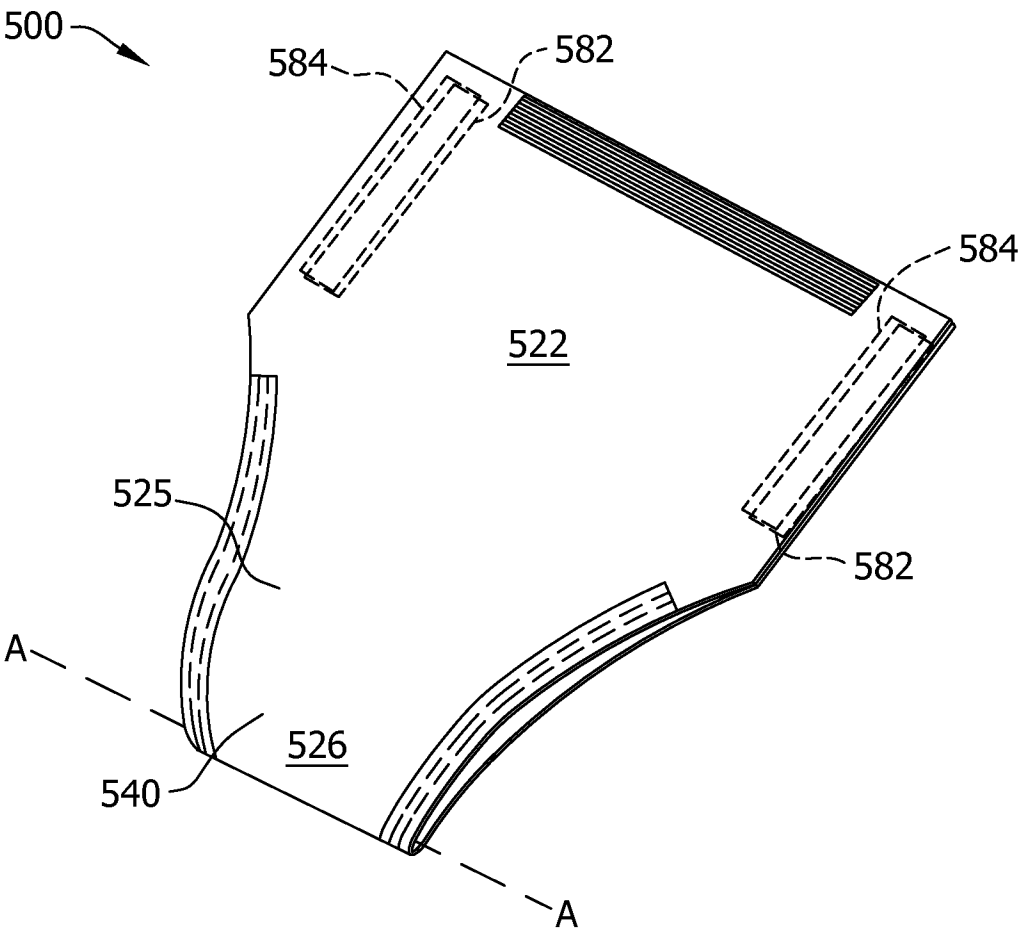
FIG. 40 is a top view of the training pant of FIG. 39 in a folded configuration.
Figure 41:
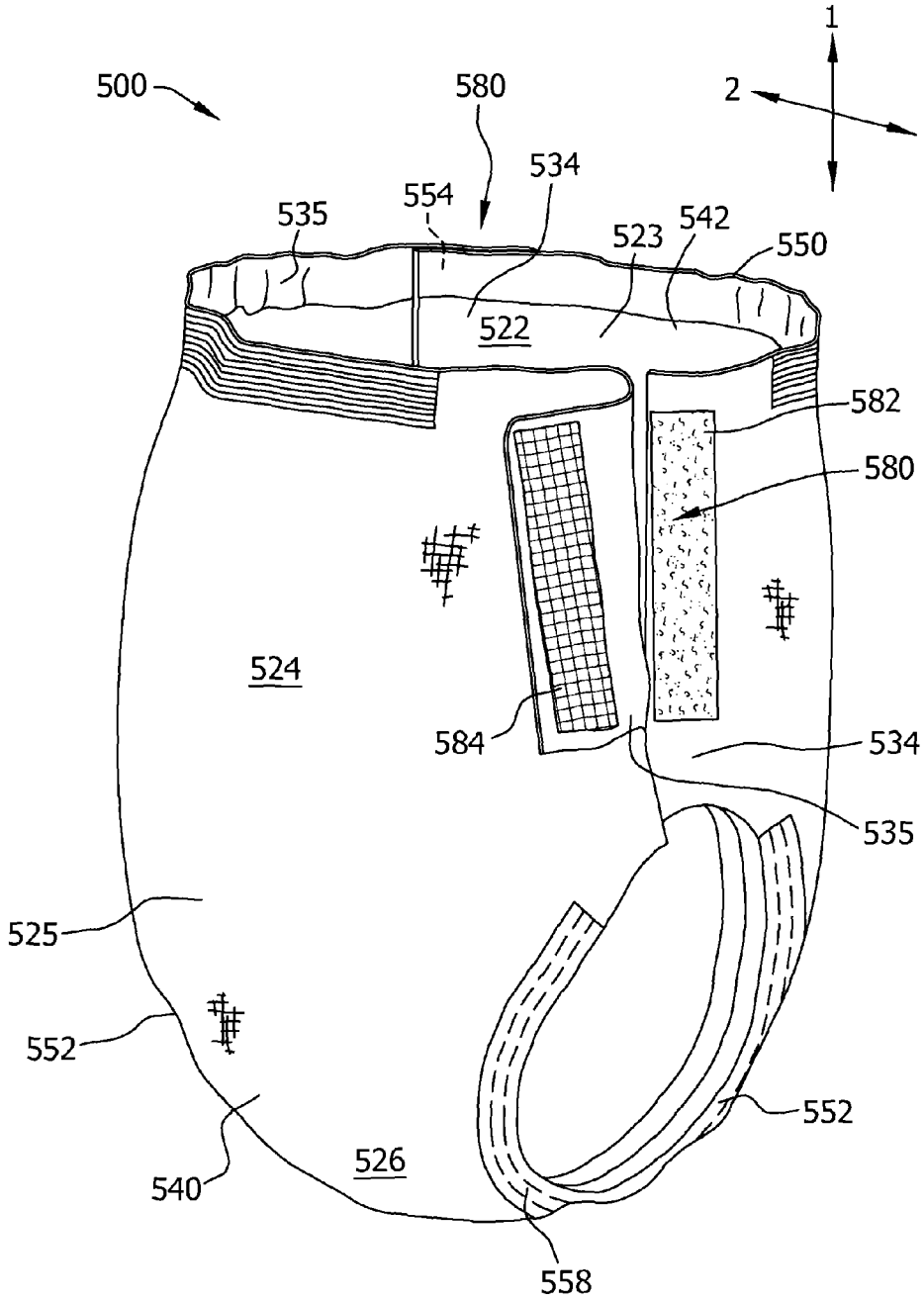
FIG. 41 is a perspective of the training pant in a partially fastened ready-to-use configuration.

As mentioned above, the manufacturing system 50 schematically illustrated in FIG. 1 and the folding apparatus 100 can be used to manufacture and fold training pants 500, which are well-known in the art. FIGS. 39-41 illustrate one embodiment of a known training pant 500 suitable for being manufactured and folded by the described manufacturing system 50 and the folding apparatus 100. The training pant 500 is illustrated in FIG. 39 in its pre-folded, laid-flat configuration. It should be understood that a "pre-folded configuration" is not limited to a training pant having no folds, but rather refers to a training pant entering the folding apparatus 100 (i.e., the training pant has not yet been folded specifically by the folding apparatus). Accordingly, the training pant 500 may or may not comprise additional folds or folded portions prior to entering the folding apparatus 100. FIG. 40 illustrates the training pant 500 in its folded configuration, i.e., after it has been folded by the folding apparatus 100. By "folded configuration" it is meant that the training pant 500 has been folded specifically by the folding apparatus 100. FIG. 41 illustrates the training pant 500 in a partially-fastened, ready-to-use configuration.

As seen in FIG. 39, the training pant 500 has a longitudinal direction 1, a transverse direction 2 that is perpendicular to the longitudinal direction, a leading edge 527, and a trailing edge 529. The training pant 500 defines a front region 522, a back region 524, and a crotch region 526 extending longitudinally between and interconnecting the front region and the back region. The training pant 500 also has an inner surface 523 (i.e., body-facing surface) adapted in use to be disposed toward the wearer, and an outer surface 525 (i.e., garment-facing surface) opposite the inner surface.

The illustrated training pant 500 also includes an outer cover 540, and a liner 542 joined to the outer cover, and an absorbent core 544 disposed between the outer cover and the liner. A pair of containment flaps 546 is secured to the liner 542 and/or the absorbent core 544 for inhibiting generally lateral flow of body exudates. The outer cover 540, the liner 542 and the absorbent core 544 can be made from many different materials known to those skilled in the art. The illustrated training pant 500 further includes a pair of transversely opposed front side panels 534, and a pair of transversely opposed back side panels 535. The side panels 534, 535 can be integrally formed with either the outer cover 540 or the liner 542, or may comprise separate elements.

As seen in FIG. 41, the front and back side panels 534, 535 of the training pant 500 can be selectively connected together by a fastening system 580 to define a three-dimensional configuration having a waist opening 550 and a pair of leg openings 552. The fastening system 580 comprises laterally opposite first fastening components 582 adapted for refastenable engagement to corresponding second fastening components 584. In one embodiment, each of the first fastening components 582 comprises a plurality of engaging elements adapted to repeatedly engage and disengage corresponding engaging elements of the second fastening components 584 to releasably secure the training pant 500 in its three-dimensional configuration.

The fastening components 582, 584 can comprise any refastenable fasteners suitable for absorbent articles, such as adhesive fasteners, cohesive fasteners, mechanical fasteners, or the like. In one particular embodiment, the fastening components 582, 584 comprise complementary mechanical fastening elements. Suitable mechanical fastening elements can be provided by interlocking geometric shaped materials, such as hooks, loops, bulbs, mushrooms, arrowheads, balls on stems, male and female mating components, buckles, snaps, or the like.

In the illustrated embodiment, the first fastening components 582 comprise loop fasteners and the second fastening components 584 comprise complementary hook fasteners. Alternatively, the first fastening components 582 may comprise hook fasteners and the second fastening components 584 may comprise complementary loop fasteners. In another embodiment, the fastening components 582, 584 can comprise interlocking similar surface fasteners, or adhesive and cohesive fastening elements such as an adhesive fastener and an adhesive-receptive landing zone or the like. Although the training pant 500 illustrated in FIG. 41 show the back side panels 535 overlapping the front side panels 534 upon connection thereto, which is conventional, the training pant can also be configured so that the front side panels overlap the back side panels when connected.

The illustrated training pant 500 further includes a front waist elastic member 554, a rear waist elastic member 556, and leg elastic members 558, as are known to those skilled in the art. The front and rear waist elastic members 554, 556 can be joined to the outer cover 540 and/or liner 542 adjacent the leading edge 527 and the trailing edge 529, respectively, and can extend the full length of or part of the length of the edges. The leg elastic members 558 can be joined to the outer cover 540 and/or liner 542 along transversely opposing leg opening side edges 536 and positioned in the crotch region 526 of the training pant 500.

The elastic members 554, 556, 558 can be formed of any suitable elastic material. As is well known to those skilled in the art, suitable elastic materials include sheets, strands or ribbons of natural rubber, synthetic rubber, or thermoplastic elastomeric polymers. The elastic materials can be stretched and bonded to a substrate, bonded to a gathered substrate, or bonded to a substrate and then elasticized or shrunk, for example with the application of heat, such that elastic constrictive forces are imparted to the substrate. One non-limiting example of a suitable elastic material includes dry-spun coalesced multifilament spandex elastomeric threads sold under the trade name LYCRA, available from Invista, having a place of business located in Wichita, Kans., U.S.A.

FIG. 40 illustrates the training pant 500 in its folded configuration wherein it has been folded about a transverse fold axis A-A so that a first portion 571 of the training pant is in a superimposed relation with a second portion 572 of the training pant. The first and second portions 571, 572 of the training pant are illustrated in FIG. 39. In the illustrated embodiment, the inner surface 523 of the first portion 571 is in a facing relation with the inner surface of the second portion 572. In addition, the transverse fold axis A-A is shown in the approximate longitudinal center of the prefolded-training pant 500, and the leading edge 527 and the trailing edge 529 of the folded training pant are longitudinally aligned. It is understood that the transverse fold axis A-A can be positioned anywhere between the leading edge 527 and the trailing edge 529 as may be desired, which can result in a longitudinal offset of the leading edge and the trailing edge (particularly as it relates to other products). Moreover, the transverse fold axis A-A need not be perpendicular to the longitudinal direction 1, but rather may be skewed at an angle from the transverse direction 2, if desired. It can also be seen in the illustrated embodiment that the first fastening component 582 and the second fastening component 584 are accurately aligned with one another.

Figure 42:
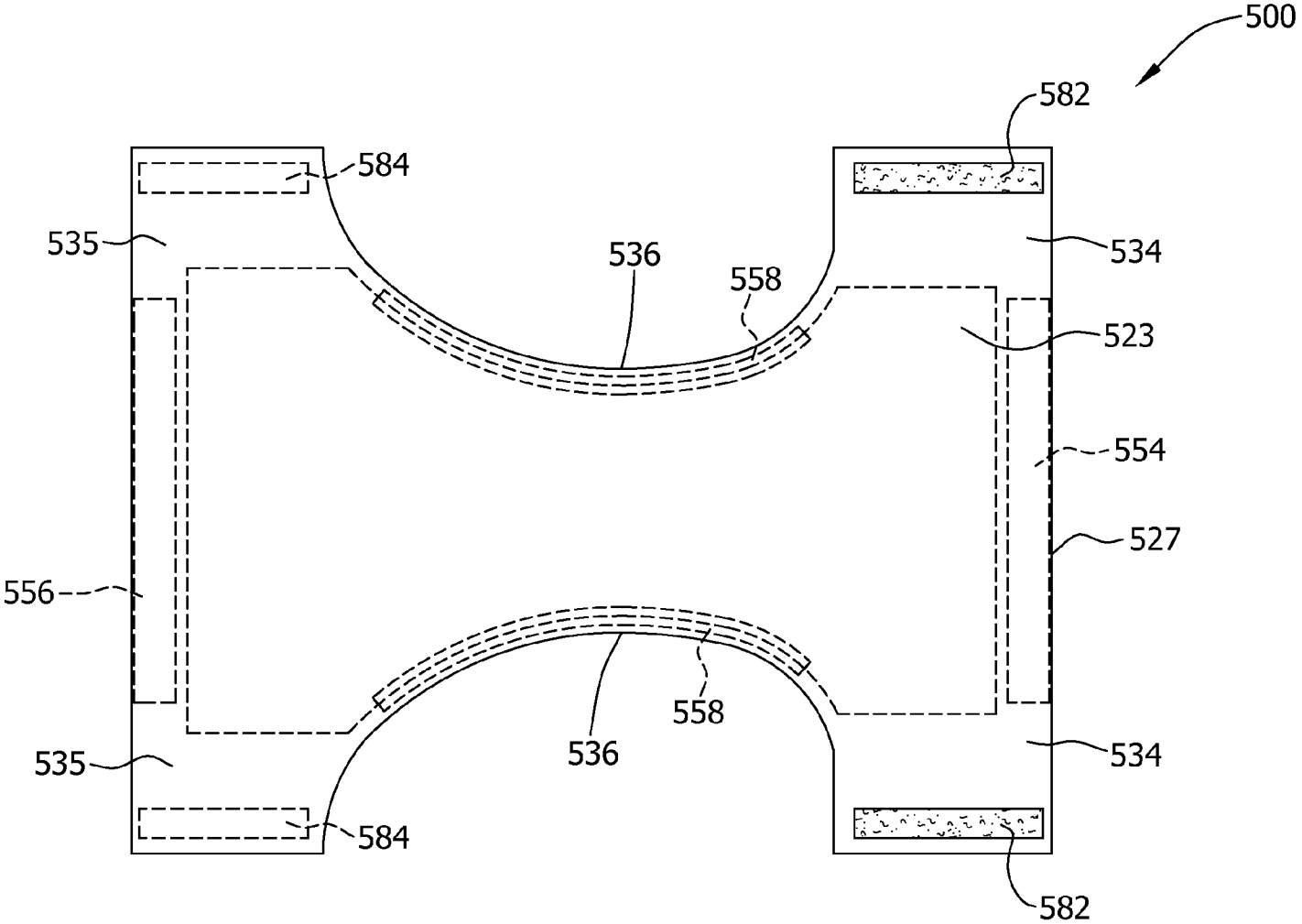
FIG. 42 is a top view of the training pant having front and back side panels.
Figure 43:
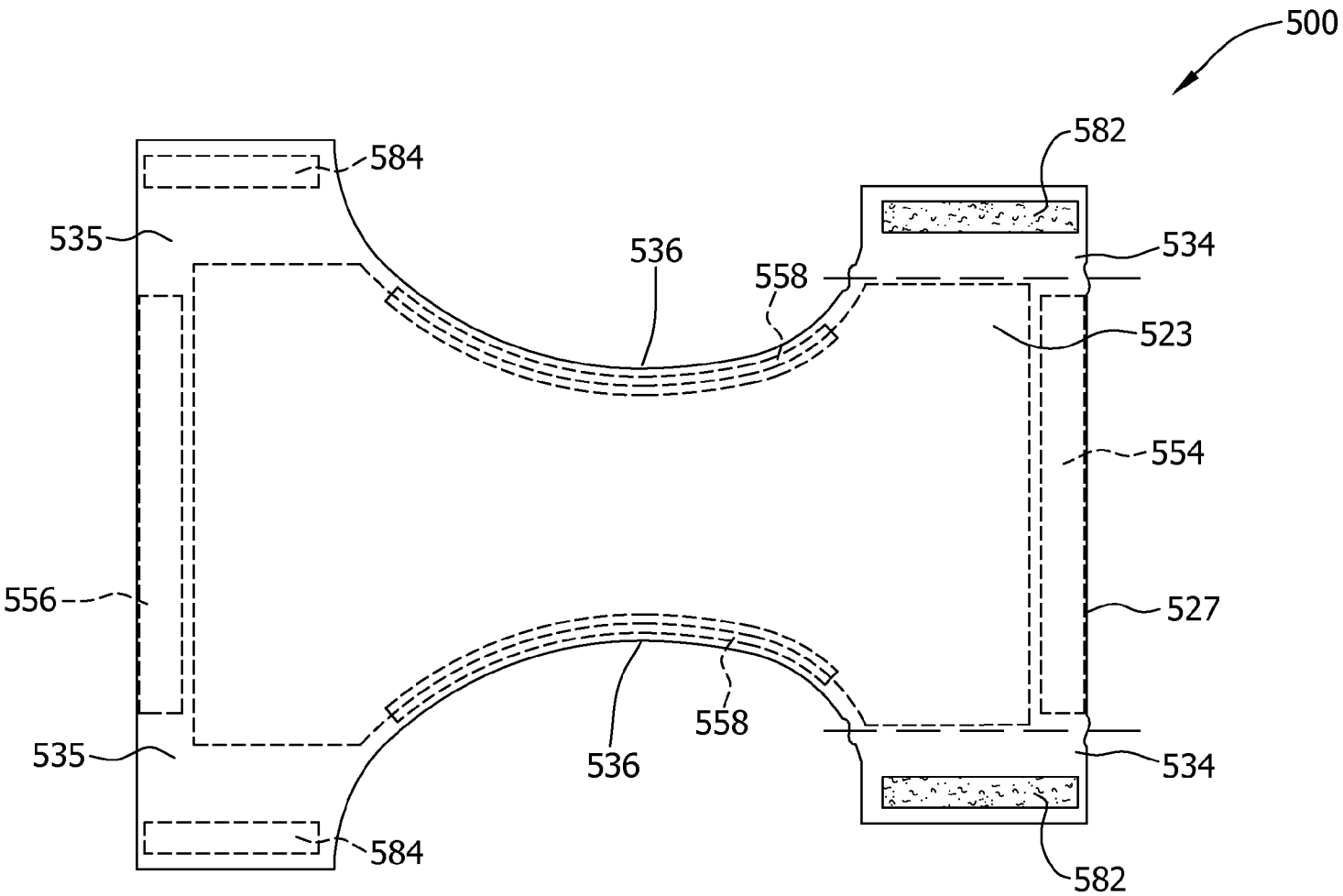
FIG. 43 is a top view similar to FIG. 42 but with the front side panels of the training pant being scrunched.

In this embodiment and as illustrated in FIG. 1, a discrete training pant 500 (one of the plurality of training pants passing through the manufacturing system 50) is delivered by the first conveying member 80 to one of the folding apparatus 100. The training pant 500 is delivered to the folding apparatus 100 with its front side panels 534 scrunched and each of its second fastening components 584 inverted (i.e., flipped approximately 180°). FIGS. 42 and 43 illustrate the training pant 500 with its front side panels 534 in their pre-scrunched and post-scrunched configurations, respectively. As seen in FIG. 43, each of the front side panels 534 is scrunched so that the first fastening components 582 are moved closer together as compared to the pre-scrunched configuration. It is contemplated that other portions of the front region 522 of the training pant 500 (i.e., portions other than the front side panels) can be scrunched to bring the first fastening components 582 closer together.

Figure 44:
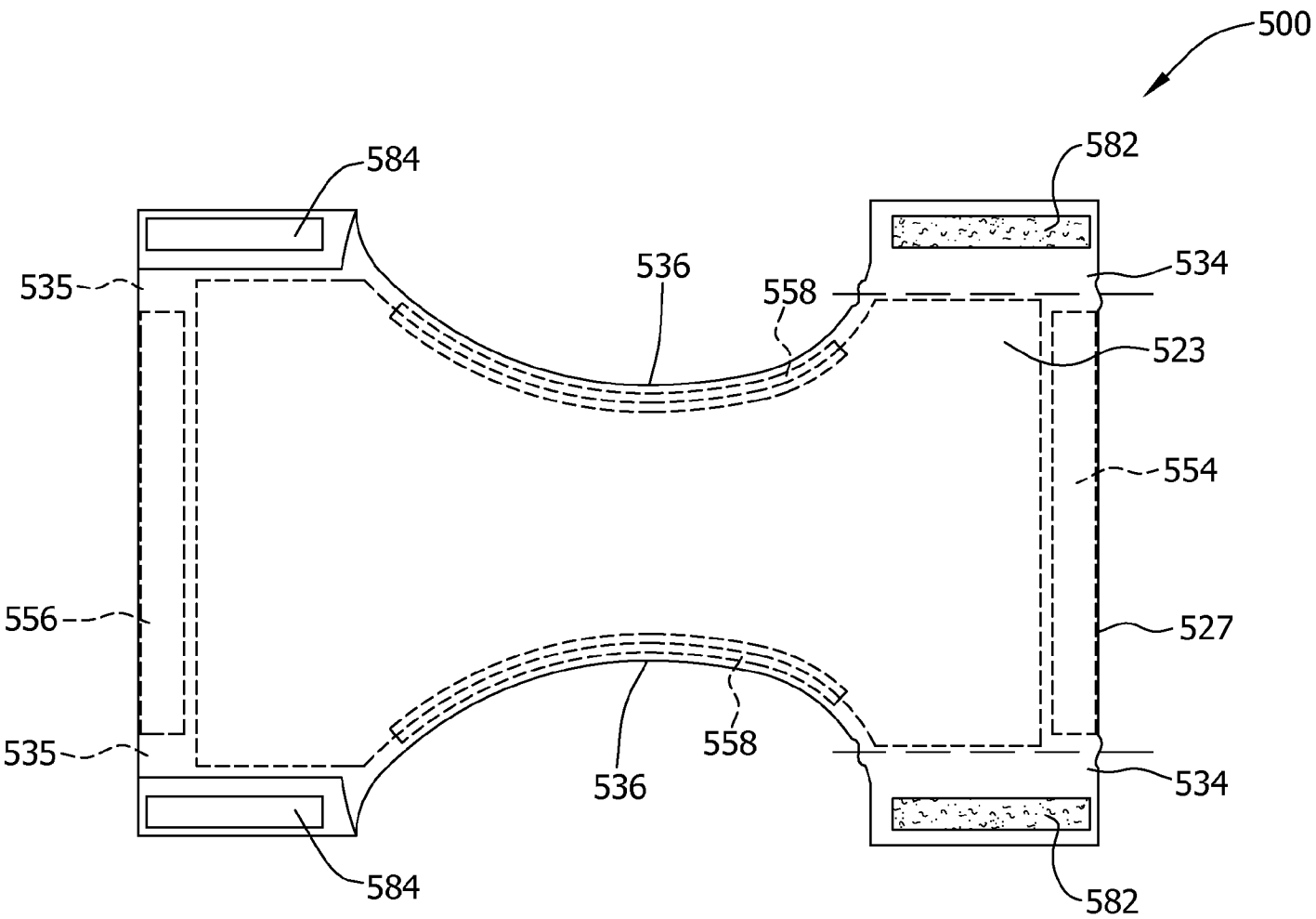
FIG. 44 is a top view similar to FIG. 43 but with portions of the back side panels being inverted.

The training pant 500 is illustrated in FIG. 44 with its second fastening components 584, which are located on respective back side panels 535, inverted and its front side panels 534 scrunched. As seen therein, both the first and second fastening components 582, 584 are now facing in the same direction. In addition, each of the first fastening components 582 is longitudinally aligned with a respective one of the second fastening components 584. As mentioned above, the training pant 500 is delivered to the folding apparatus 100 with its front side panels 534 scrunched and each of its second fastening components 584 inverted.

In the illustrated embodiment, half of the training pants 500 are delivered to each of the folding apparatus 100. Devices suitable for use as the first conveying member 80 are well-known in the art and include, but are not limited to, drums, rollers, belt conveyors, air conveyors, vacuum conveyors, chutes, and the like. For exemplary purposes, the first conveying member 80 is illustrated herein as a vacuum belt conveyor. In one suitable embodiment, the first conveying member 80 includes a conveying-assist device 82 to assist in keeping the training pants in a controlled position during advancement (FIG. 1). Conveying-assist means are well-known in the art and, for example, include support belts, vacuum means, support rolls, secondary conveyor belts, guide plates, and the like.

Since both of the folding apparatus 100 are the same, the operation of only one of them will be described herein. The receiving roll 110 is aligned with respect to the first conveying member 80 so that the opening 125 in the opened segment 124 of the inner cylinder 111 is adjacent the first conveying member 80. As a result, the apertures 129 in the engagement member 127 of the outer cylinder 112 are subjected to a vacuum when they pass by the opening 125 and the vacuum source is applying vacuum to the interior chamber 113. The outer cylinder 112 of the illustrated receiving roll 110 is rotated in a counterclockwise direction (broadly, a first direction) by the drive assembly 117 at a constant surface speed, and suitably at the same speed that the training pant 500 is traveling on the first conveying member 80. The vacuum source is activated to apply a vacuum to the interior chamber 113 of the inner cylinder 111 via the conduit 115 and the openings 116 in the conduit. The training pant 500 is delivered to the receiving roll 110 by the first conveying member 80 with its outer cover 540 facing upward (i.e., away from the first conveying member) and its first and second fastening components 582, 584 facing downward (i.e., toward the first conveying member).

Figure 45:
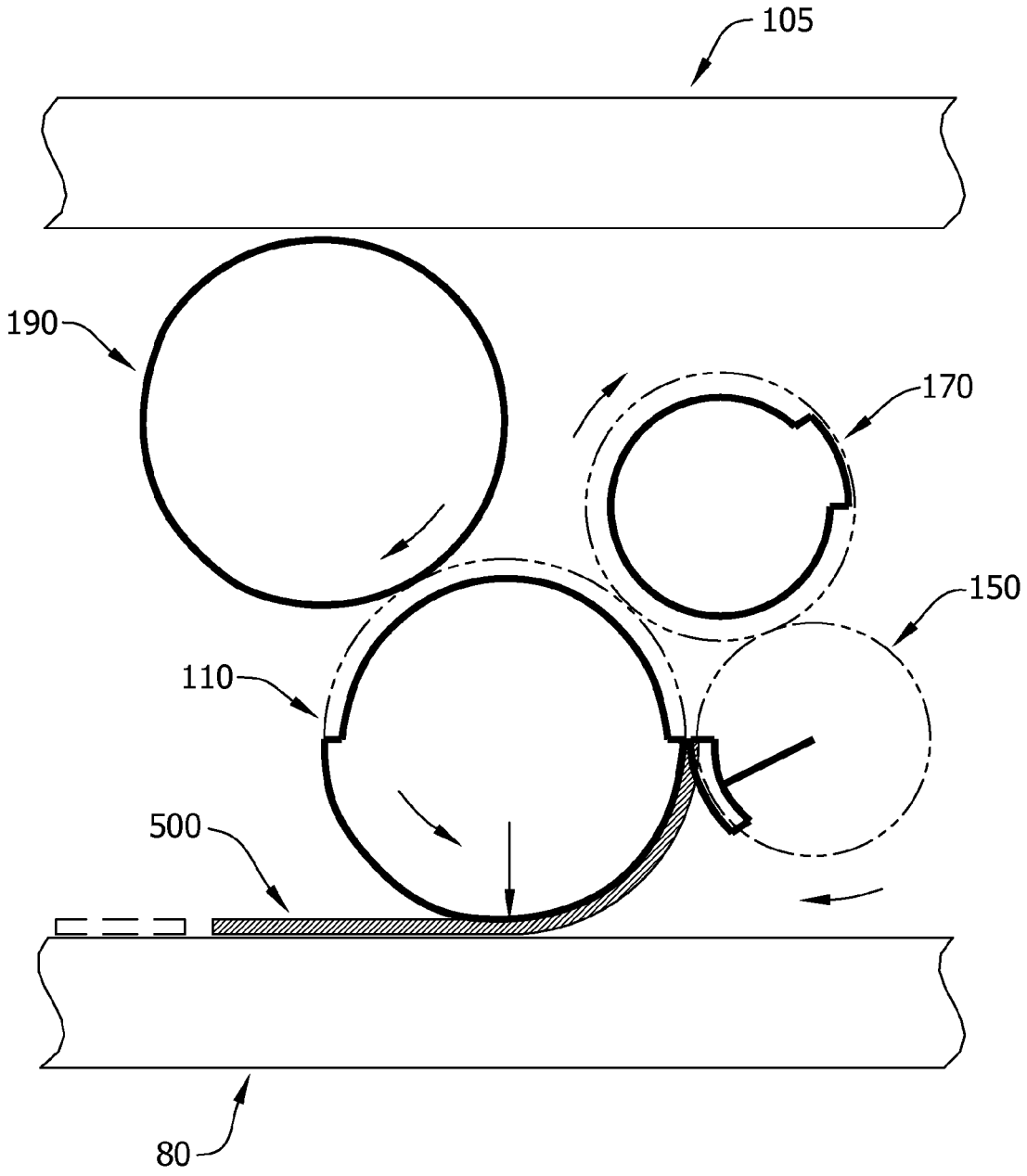
FIG. 45 is a schematic of the folding apparatus with the training pant entering the folding apparatus in its prefolded, laid-flat configuration and being held by the receiving roll.

When the leading edge 527 of the training pant 500 reaches the receiving roll 110, the outer cover 540 of the training pant is aligned with and grasped by the leading boundary of the first zone 133 of the engagement member 127 of the outer cylinder 112 of the receiving roll 110. As the receiving roll rotates away from the first conveying member 80, the leading edge 527 of the training pant 500 is lifted off of the first conveying member and transferred to the receiving roll (FIG. 45). As the remainder of the training pant 500 is delivered to the receiving roll 110 by the first conveying member 80, it is aligned with and grasped by the receiving roll in substantially the same manner as the leading edge 527.

The training pant 500 is delivered to the receiving roll 110 in such a manner that the training pant is generally aligned with the apertures 129 in the engagement member 127. As a result, the first portion 571 of the training pant 500 overlies the first zone 133 of the engagement member 127 and the second portion 572 of the training pant overlies the second zone 135. As a result, the entire training pant 500 is held by the receiving roll 110 as it is transferred from the first conveying member 80 thereto.

As the training pant 500 rotates with the outer cylinder 112 of the receiving roll 110, the leading edge 527 of the training pant is moved adjacent the oscillating member 150 as seen in FIG. 45. The inner cylinder 111 is configured such that the opened segment 124 extends generally from the tangent point of the receiving roll 110 with the first conveying member 80 to a first nip defined by the receiving roll and the oscillating member. The slotted segment 122 of the inner cylinder 111 of the receiving roll 110 extends generally from the first nip to a fourth nip defined by the receiving roll and the transfer roll. The apertures 129 in the first zone 133 do not align with the slots 123 in the slotted segment 122 of the inner cylinder 111, the vacuum within the interior chamber 113 of the inner cylinder 111 is blocked thereby releasing the leading edge 527 and subsequently the entire first portion 571 of the training pant 500 as it rotates beyond the first nip.

As the leading edge 527 of the training pant 500 approaches the first nip, the puck 164 of the oscillating member 150 moves adjacent the receiving roll at the first nip as shown in FIG. 45. The inner cylinder 151 of the oscillating member 150 is configured such that the narrower portion of slots 163 (the portion of the slots having the narrower width W2) extend generally from the first nip to a second nip defined by the oscillating member 150 and the folding roll 170.

As a result, the leading edge 527 of the training pant 500 approaches the puck 164 of the oscillating member 150 as the apertures 129 in the first zone 133 of the engagement member 127 of the outer cylinder 112 of the receiving roll 110 pass over the slotted segment 122 of the inner cylinder 111. Since the apertures 129 in the first zone 133 do not align with the slots 123 in the slotted segment 122, the vacuum within the interior chamber 113 of the inner cylinder 111 is blocked thereby releasing the leading edge 527 of the training pant 500 as it rotates. At approximately the same time or slightly before, the puck 164 of the oscillating member 150 contacts the liner 542 in the first portion 571 of the training pant 500 at a first nip defined by the puck of the oscillating member and the engagement member 127 of the receiving roll 110 (FIG. 45). At this point, the training pant 500 is subject to the vacuum of the oscillating member 150 through the apertures 169 in the puck 164 as a result of the apertures being aligned with the slots 163 in the inner cylinder 151. More specifically, each of the first fastening components 582 and the front waist elastic member 554 of the training pant 500 is grasped by the puck 164 because of the vacuum being applied thereto through the apertures 169 in the puck.

Moreover, the apertures 129 located in the first zone 133 of the engagement member 127 rotate into alignment with the oval apertures 126 located in the slotted segment 122 of the inner cylinder 111 of the receiving roll 110. Since the oval apertures 126 are in fluid communication with the pressurized elongate enclosure 128, pressurized air moves from the elongate enclosure through the oval apertures 126, through the apertures 129 in the engagement member 127 of the outer cylinder 112, and into contact with the first portion 571 of the training pant 500. The pressurized air assists in the transfer of the first portion 571 of the training pant 500 from the first zone 133 of the engagement member 127 of the outer cylinder 112 of the receiving roll to the puck 164 of the oscillating member 150.

Figure 46:
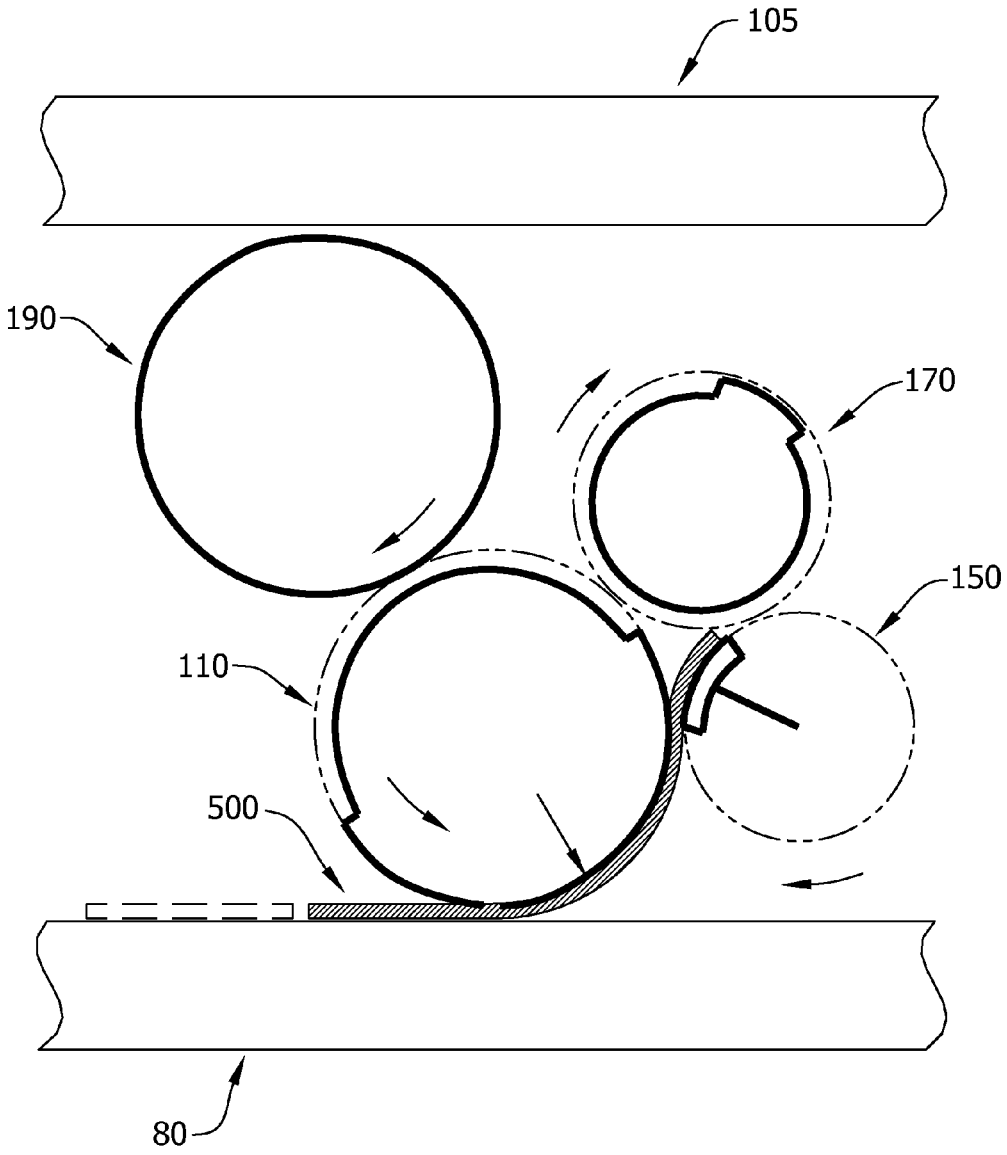
FIG. 46 is a schematic of the folding apparatus with the training pant having a first portion thereof being transferred from the receiving roll to the oscillating member and a second portion thereof held by the receiving roll.

The first portion 571 of the training pant 500 is transferred to the puck 164 of the outer cylinder 152 of the oscillating member 150 while the outer cylinder (and thereby the puck) is being rotated relative to the receiving roll 110 by the drive assembly 157 of the oscillating member. As seen in FIGS. 45 and 46, the outer cylinder 152 of the oscillating member 150 is moving in a clockwise direction (broadly, a second direction), which is opposite the rotation of the outer cylinder 112 of the receiving roll. In addition, the outer cylinder 152 of the oscillating member 150 is rotating at approximately the same surface speed as the outer cylinder 112 of the receiving roll 110 when the first portion 571 of the training pant 500 is transferred from the receiving roll 110 to the oscillating member 150.

The second portion 572 of the training pant 500 remains held to the receiving roll 110 through the rotation of the outer cylinder 112 past the slotted segment 122 of the inner cylinder 111 because the apertures 129 in the second zone 135 of the engagement member 127 are aligned with the slots 123 in the slotted segments. As a result, the vacuum continues to be applied to and thereby hold the second portion 572 of the training pant 500 to the engagement member 127 of the outer cylinder 112 of the receiving roll 110.

Once the leading edge 527 of the training pant 500 is transferred from the receiving roll 110 to the oscillating member 150 (or shortly thereafter), the outer cylinder 152 of the oscillating member begins to slow down. That is, the drive assembly 157 of the oscillating member 150, which is variable, reduces the surface speed at which the outer cylinder 152 of the oscillating member rotates relative to the receiving roll 110. In fact, once the outer cylinder 152 of the oscillating member 150 rotates a predetermined amount in the clockwise direction, the outer cylinder stops and rotates in the opposite direction (i.e., the counterclockwise direction). In the illustrated embodiment, the outer cylinder 152 of the oscillating member 150 moves in a generally pendular manner through about 180 degrees. In the illustrated embodiment, for example, the range of travel of the outer cylinder 152 of the oscillating member 150 is defined by it rotating in a clockwise direction through about one-half rotation, stopping, and then rotating back in a counterclockwise direction to its original position.

Figure 47:
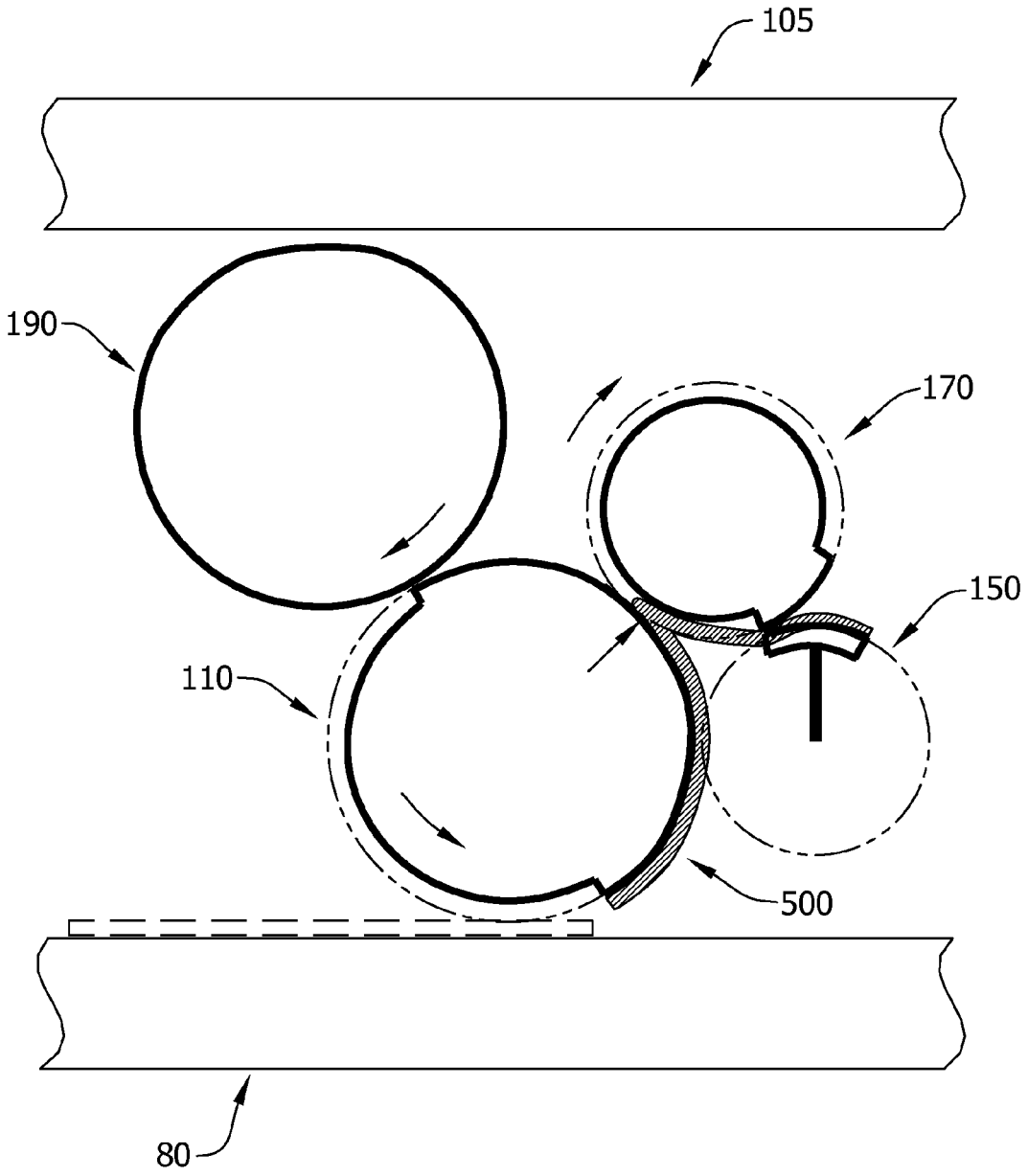
FIG. 47 is a schematic of the folding apparatus with the training pant beginning to fold and having the first portion thereof held by the oscillating member and the second portion thereof held by the receiving roll.

Because of the slowing, stopping, and change in rotational direction of the outer cylinder 152 of the oscillating member 150 relative to the outer cylinder 112 of the receiving roll 110, which is moving at a constant surface speed, the training pant 500 begins to fold (FIG. 47).

With the outer cylinder 152 of the oscillating member 150 stopped or beginning to rotate in the counterclockwise direction, the actuator 168 of the oscillating member 150 is actuated by applying the preset input current thereby causing the inner cylinder to translate relative to the outer cylinder 152 as illustrated in FIGS. 21 and 22. Since this occurs when the apertures 169 in the puck 164 of the oscillating member 150 are aligned with wider portions of the slots 163 in the slotted segment 162 (i.e., the portions of the slots 163 having the wider width W1), the first portion 571 of the training pant 500 remains securely held to the puck 164 by the vacuum. As seen in FIG. 21, the apertures 169 in the puck 164 remain in fluid communication with the vacuum being applied to the interior chamber 153 through the wider portions of the slots 163.

As the outer cylinder 152 of the oscillating member 150 rotates in a counterclockwise direction, the apertures 169 in the puck 164 move from the area of the slotted segment 162 with the wider portions of the slots 163 to over the area with the narrower portions. As a result of the apertures 169 in the puck 164 not being aligned with the narrow portions of the slots 163, the vacuum being applied to the interior chamber 153 is blocked by the inner cylinder and thereby inhibited from reaching the first portion 571 of the training pant 500 via the apertures 169 in the puck 164. In other words, the first portion 571 of the training pant 500 is released from the vacuum of the oscillating member 150.

As mentioned above, the outer cylinder 152 of the oscillating member 150 rotates in a clockwise direction through about one-half rotation, stops, and then rotates back in a counterclockwise direction to its original position. The actuator 168 of the illustrated embodiment is configured to be in its normal position when the outer cylinder 152 is rotating in the clockwise direction, and in its actuated position when the outer cylinder is rotating in its counterclockwise direction. As a result, the inner cylinder 151 is in the first position when the outer cylinder 152 is rotating clockwise and the second position when the outer cylinder is rotating in the counterclockwise direction. It is understood that the position of the inner cylinder 151 can be changed (i.e., the actuator 168 actuated or de-actuated) when the outer cylinder 152 is at a stopped position or while it is rotating.

With the outer cylinder 152 of the oscillating member 150 rotating in the counterclockwise direction, the first portion 571 of the training pant 500 is contacted by the puck 186 of the outer cylinder 172 of the folding roll 170 at a second nip defined by the oscillating member and the folding roll (FIG. 47). The outer cylinder 172 of the folding roll 170 is rotating at generally the same surface speed as the outer cylinder 152 of the oscillating member 150 but in the opposite direction (i.e., clockwise). The rotational surface speed of the outer cylinders 152, 172 of the oscillating member 150 and the folding roll 170 at this point in the folding process are slower than the rotational surface speed of the outer cylinder 112 of the receiving roll 110. As a result, the second portion 572 of the training pant 500 is moving faster than the first portion 571.

Figure 48:
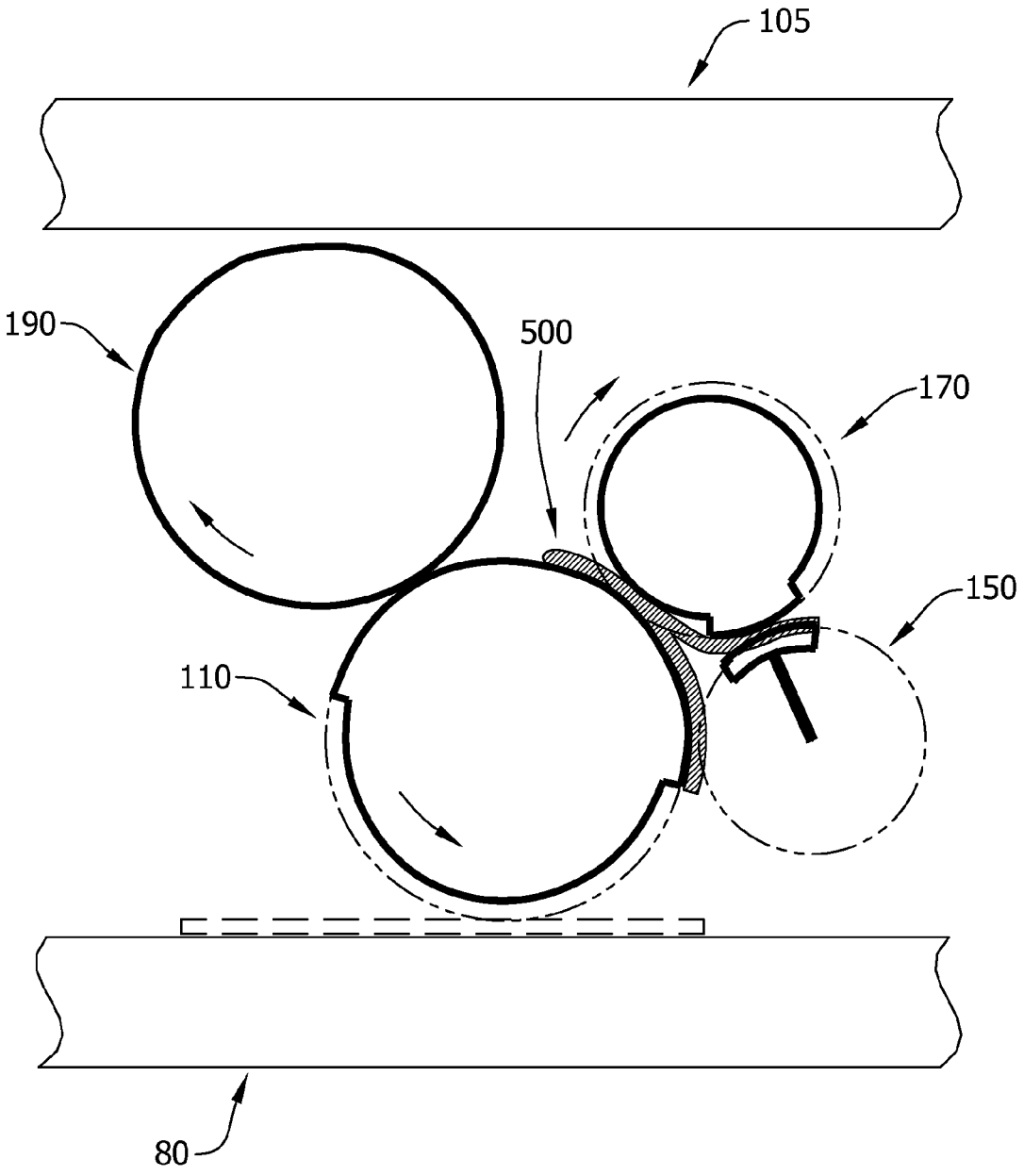
FIG. 48 is a schematic of the folding apparatus with the training pant having the first portion thereof being transferred from the oscillating member to the folding roll and the second portion thereof held by the receiving roll.

Because the vacuum being applied by the oscillating member 150 to the first fastening components 582 and front waist elastic member 554 of the training pant 500 is blocked by the inner cylinder 151, the first portion 571 of the training pant transfers from the puck 164 of the oscillating member to the puck 186 of the outer cylinder 172 of the folding roll 170 (FIG. 48). The primary and secondary openings 180, 182 in the inner cylinder 171 of the folding roll 170 are generally aligned with the apertures 188 in the puck 186 of the outer cylinder 172 of the folding roll thereby subjecting the first portion of the training pant 500 to the vacuum being applied to the interior chamber 173 of the inner cylinder. As a result, the first portion 571 of the training pant 500 transfers to the puck 186 of the outer cylinder 172 of the folding roll 170 at the second nip defined by the puck of the outer cylinder of the folding roll and the puck 164 of the outer cylinder 152 of the oscillating member 150 (FIG. 48).

Figure 49:
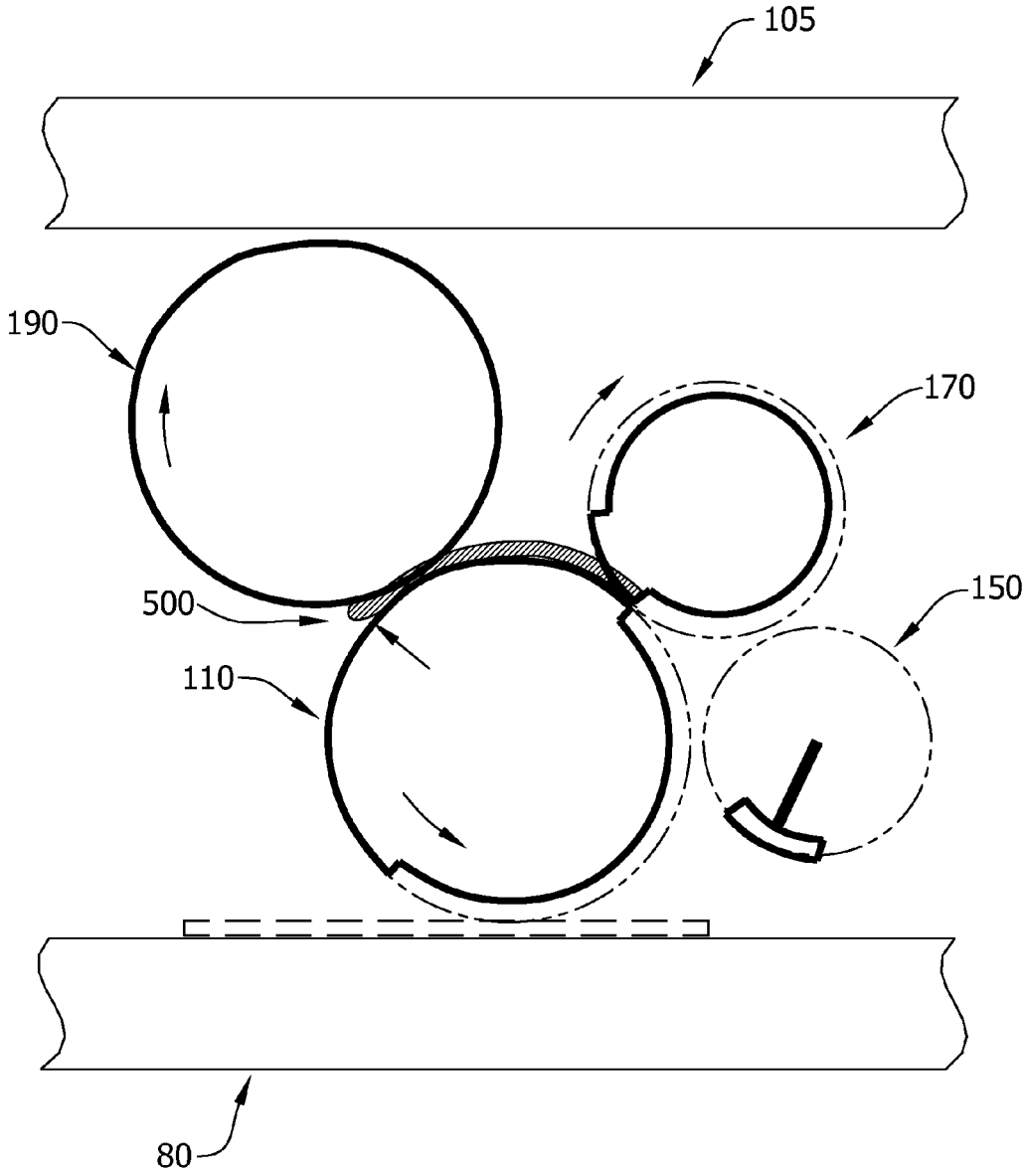
FIG. 49 is a schematic of the folding apparatus with the training pant having the first portion thereof held by the folding roll and the second portion thereof held by the receiving roll.

Once the first portion 571 of the training pant 500 is transferred from the oscillating member 150 to the folding roll 170, the rotational surface speed of the outer cylinder 172 of the folding roll 170 is increased by its drive assembly 176 to generally match the rotational surface speed of the outer cylinder 112 of the receiving roll 110. As illustrated in FIGS. 48 and 49, the outer cylinder 172 of the folding roll 170 is rotating a clockwise direction which is opposite from the counterclockwise direction of the outer cylinder 112 of the receiving roll 110. The first portion 571 of the training pant 500 is brought back into engagement with the engagement member 127 of the outer cylinder 112 of the receiving roll 110 at a third nip defined between the folding roll 170 and the receiving roll 110 such that the first portion 571 of the training pant is in overlying relationship with the second portion 572 (FIG. 49). In addition, each of the first fastening components 582 are engaged to a respective one of the second fastening components 584.

The primary and secondary openings 180, 182 in the inner cylinder 171 of folding roll 170 terminate adjacent the third nip. As a result, the vacuum holding the first portion 571 of the training pant 500 to the puck 186 of the folding roll 170 is blocked from contact therewith. As a result, the first portion 571 of the training pant 500 is transferred back to the receiving roll 110 and the training pant is arranged in its folded configuration. In addition, relative rotation of the folding roll 170 and receiving roll 110 applies both a compressive force and a shear force to the first and second fastening components 582, 584 thereby securely engaging the first and second fastening components together.

Figure 50:
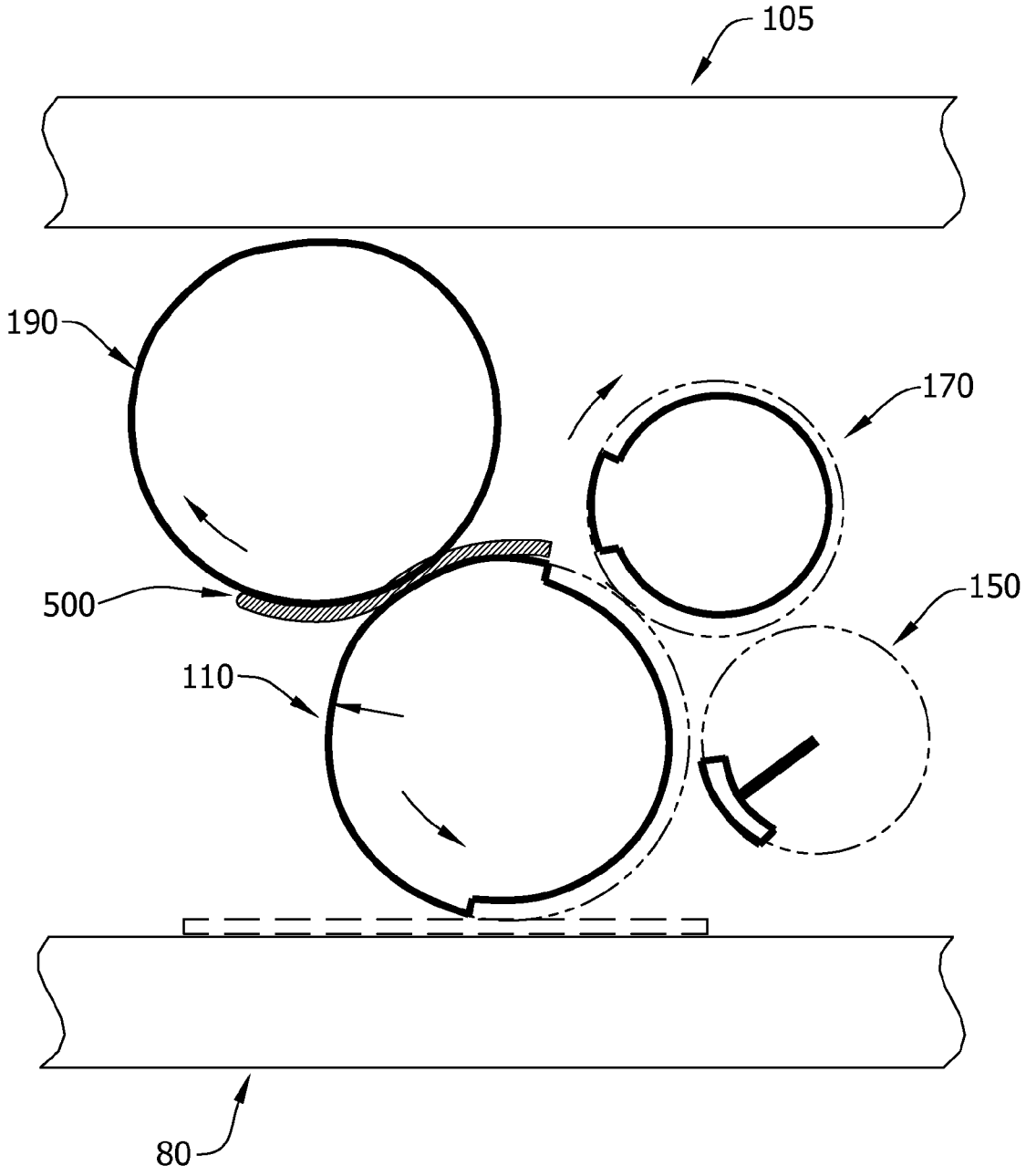
FIG. 50 is a schematic of the folding apparatus with the training pant being in its folded configuration and being transferred from the receiving roll to the transferring roll.

The training pant 500, which is in its folded configuration and has its first and second fastening components 582, 584 securely engaged, is then transferred from the receiving roll 110 to the transferring roll 190 at a fourth nip defined between the receiving roll and the transferring roll (FIGS. 49 and 50). The outer cylinder 112 of the receiving roll 110 is continuing to rotate in the counterclockwise direction at a constant surface speed. The outer cylinder 192 of the transferring roll 190 is rotating at approximately the same surface speed as the outer cylinder 112 of the receiving roll 110 but clockwise.

The transition from the slotted segment 122 to the solid segment 121 of the inner cylinder 111 of the receiving roll 110 is generally aligned with the fourth nip defined between the receiving roll and the transferring roll 190. As a result, the apertures 129 in the engagement member 127 are blocked from the vacuum by the solid segment 121 of the inner cylinder 111 and thereby inhibits the vacuum from being applied to the training pant 500. That is, the training pant 500 is free from the vacuum of the receiving roll 110 at this location.

The leading edges of the primary and secondary openings 202, 204 in the inner cylinder 191 of the transferring roll 190 are generally aligned with the fourth nip defined by the receiving roll 110 and the transferring roll. Thus, as the apertures 208 pass by the forth nip, the vacuum applied to the interior chamber 193 of the inner cylinder 191 of the transferring roll 190 is in fluid communication with the apertures in the puck of the outer cylinder 192 of the transferring roll. As a result, the outer cylinder 192 of the transferring roll 190 grasps the training pant 500 and thereby transfers the training pant 500 from the receiving roll 110 to the transferring roll. The training pant 500, which is in its folded configuration, is generally aligned with the profile (i.e., arrangement) of apertures 208 in the puck 206 of the outer cylinder 192. Accordingly, the entire training pant 500 including the fastening components 582, 584, which are securely engaged, is held in alignment by the transferring roll 190.

With reference again to FIG. 1, the transferring roll 190 carries the training pant 500 to and transfers the training pant to the second conveying member 105, which carries the training pant to additional components of the manufacturing system 50. In the illustrated embodiment, the second conveying member 105 is a vacuum belt conveyor. Other devices suitable for use as the second conveying member 105 are well-known in the art and include, but are not limited to, drums, rollers, air conveyors, vacuum conveyors, chutes, and the like.

In one suitable embodiment, training pants 500 can be manufactured at high line speeds (i.e., rates of 400 products per minute (ppm) or greater, such as 400 ppm to 4000 ppm, or 600 ppm to 3000 ppm, or 900 ppm to 1500 ppm). In the embodiment illustrated in FIG. 1, for example, training pants 500 can be manufactured at a rate of approximately 1000 ppm. Each of the illustrated folding apparatus 100 is capable of folding training pants at a rate of approximately 500 ppm. Thus, in another suitable embodiment having only one folding apparatus, the training pants 500 can be manufactured at high line speeds (i.e., 500 ppm). It is understood, that the line speeds of the illustrated manufacturing system 50 can be increased beyond 1000 ppm by adding additional folding apparatus 100 (e.g., three folding apparatus would allow line speeds of up to 1500 ppm, four folding apparatus would allow line speeds of up to 2000 ppm).

As mentioned above, the outer cylinders 112, 192 of the receiving roll 110 and the transferring roll 190 rotate at a constant speed whereas the outer cylinders 152, 172 of the oscillating member 150 and the folding roll 170 move/rotate at variable speeds throughout the operation of the folding apparatus 100.

Figure 51:
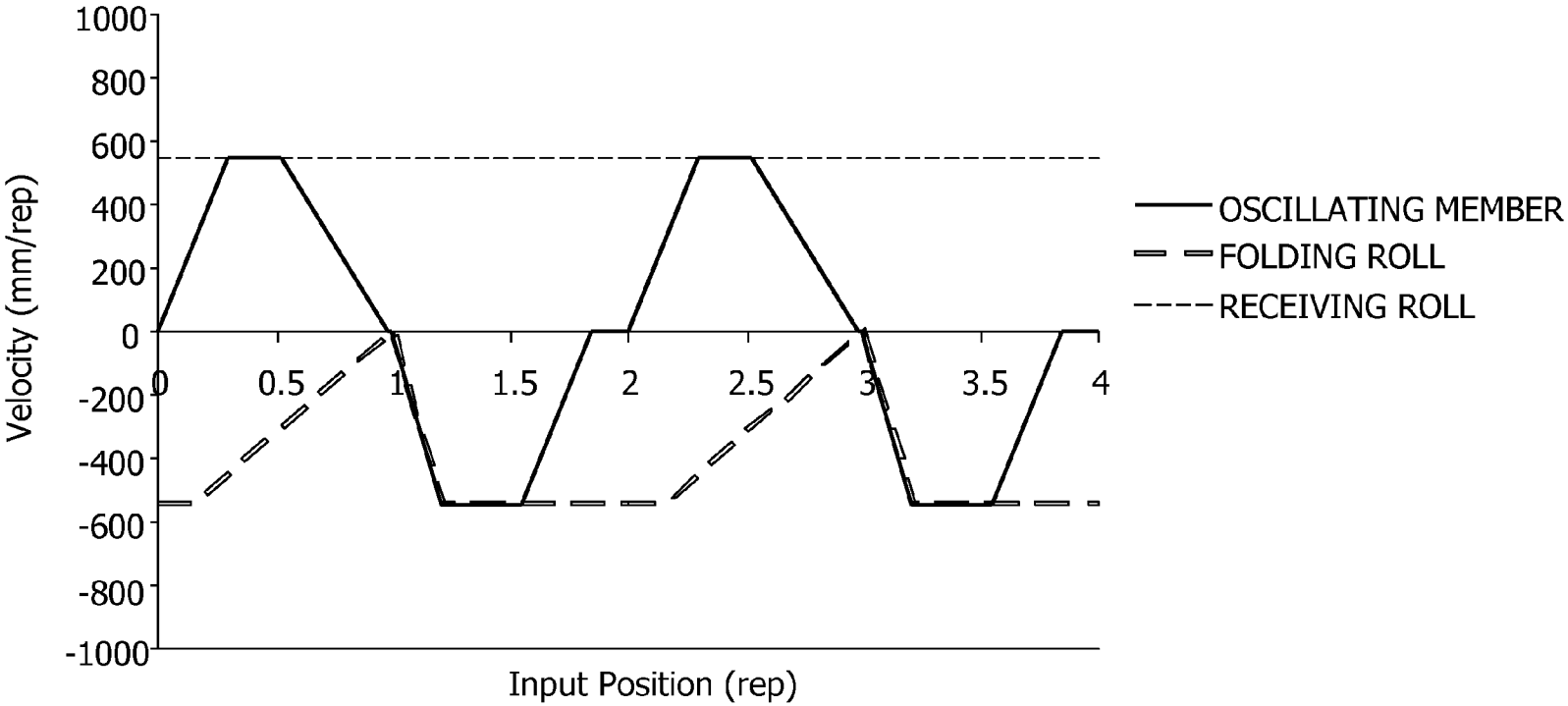
FIG. 51 is a graph illustrating one suitable embodiment of the velocity profiles for the receiving roll, the oscillating member, and the folding roll.

FIG. 51 is a graph illustrating one suitable embodiment of the relative velocity profiles between the receiving roll 110, the oscillating member 150, and the folding roll 170. As seen in FIG. 51, the velocity profile for the receiving roll 110 is constant and in the first direction. The velocity profile for the oscillating member 150 begins at a stopped position and accelerates to match the velocity of the receiving roll 110. Once the velocity of the receiving roll 110 and oscillating member 150 are approximately the same, the first portion 571 of the training pant 500 is transferred from the receiving roll to the oscillating member.

After the first portion 571 of the training pant 500 is received by the oscillating member 150, the oscillating member decelerates and comes to a stopped position. After a brief stop, the oscillating member accelerates in the opposite direction at approximately the same rate as the folding roll 170 during which the first portion 571 of the training pant 500 is transferred from the oscillating member to the folding roll. After the first portion 571 is transferred from the oscillating member 150, the oscillating member decelerates to a stopped position and repeats its velocity profile.

As seen in FIG. 51, the velocity profile of the folding roll 170 begins with the folding roll rotating at a constant speed and then decelerates to a stopped position. From the stopped position, the folding roll 170 and oscillating member 150 accelerate at generally the same rate during which time the first portion 571 of the training pant 500 is transferred from the oscillating roll to the folding roll. The folding roll 170 continues to accelerate with the first portion 571 of the training pant 500 held thereto until the folding roll reaches a constant surface speed. The surface speed of the folding roll is generally the same as the surface speed of the receiving roll 110. After the folding roll reaches a constant speed, the first portion 571 is transferred from the folding roll 170 to the receiving roll 110. The folding roll 170 then repeats its velocity profile.

The velocity profile of transferring roll 190, which is not illustrated in FIG. 51, is substantially the same as velocity profile for the receiving roll 110 but in the opposite direction. It is understood, however, that the velocity profiles of the transferring roll 190 and receiving roll 110 can differ.

Figure 52:
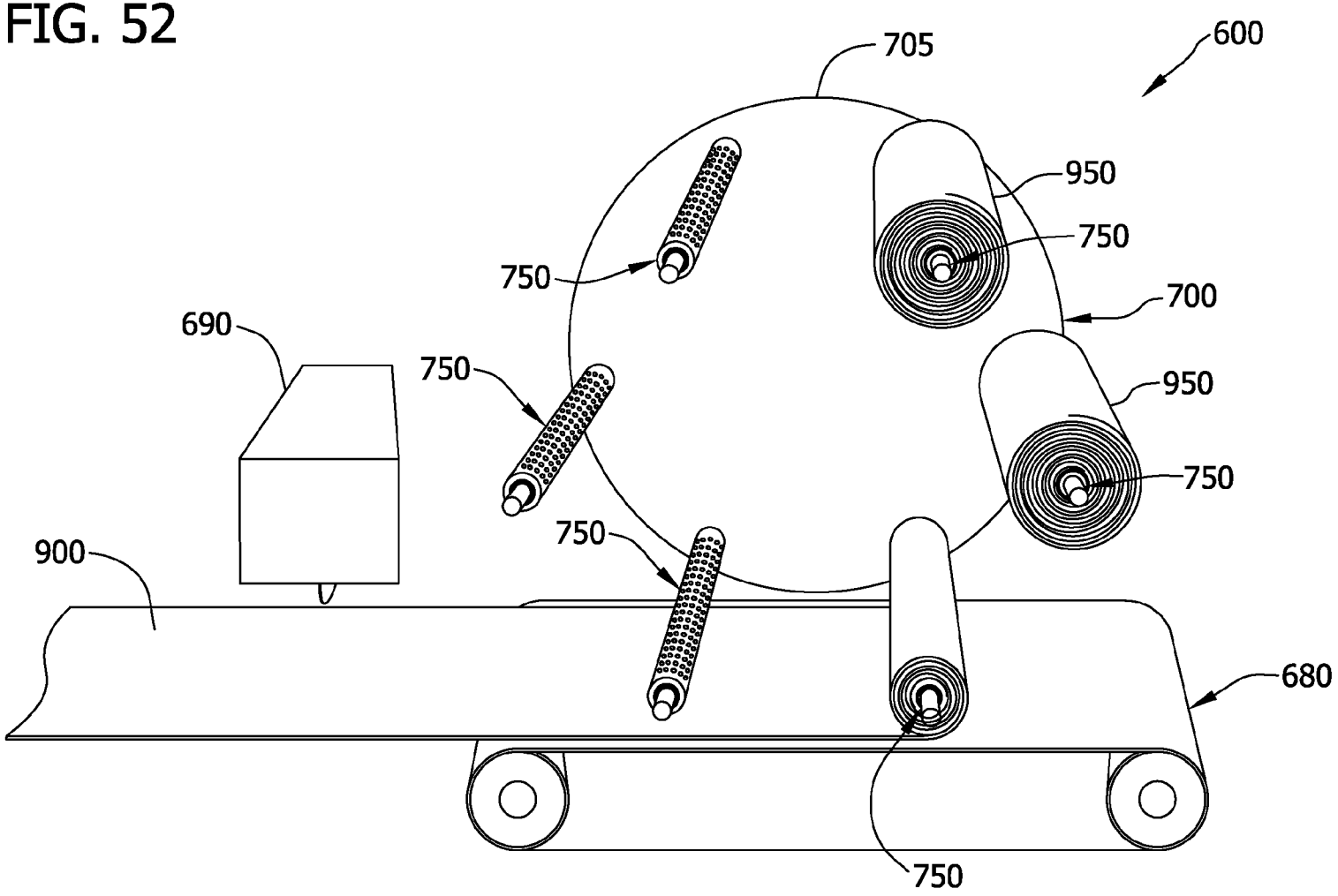
FIG. 52 is perspective of a portion of a web winding system having a plurality of vacuum winding rolls for winding logs of toilet paper.

FIG. 52 illustrates one embodiment of a web winding system, indicated generally at 600, comprising a conveying member 680, a cutting apparatus 690, and a winding apparatus 700 for winding a web (e.g., a web of toilet paper 900 (broadly, "a material")) into wound logs (e.g., a log of toilet paper 950). The conveying member and the winding apparatus are indicated generally by their respective reference numbers.

The winding apparatus 700 is described herein as being adapted to wind the web of toilet paper 900 without using a core. Elimination of the core significantly reduces the amount of material used in the finished roll of toilet paper (by up to 20 percent); reduces processing cost by eliminating process steps, equipment, and materials; and reduces waste. It is understood that the winding apparatus 700 can be used to wind other flexible materials and composites. For example, the winding apparatus 700 can be used to wind rolls of woven or nonwoven webs, plastic sheeting, trash bags, metal foils, and paper towels.

Devices suitable for use as the conveying member 680 are well-known in the art and include, but are not limited to, drums, rollers, belt conveyors, air conveyors, vacuum conveyors, chutes, and the like. For exemplary purposes, the conveying member 680 is illustrated herein as a vacuum belt conveyor. In the illustrated embodiment, conveying member 680 is adapted to deliver the web of toilet paper 900 to the winding apparatus 700 at approximately 3000 feet per minute. It is understood, however, the conveying member 680 can deliver the web of toilet paper 900 to the winding apparatus 700 at any suitable high line speed.

In one suitable embodiment, the conveying member 680 includes a conveying-assist device (not shown) to assist in keeping the web in a controlled position during advancement. Conveying-assist means are well-known in the art and, for example, include support belts, vacuum means, support rolls, secondary conveyor belts, guide plates, and the like.

The winding apparatus 700 includes a plurality of vacuum winding rolls (broadly, "vacuum rolls"), indicated generally at 750, mounted on a rotatable support 705. The support 705 is capable of indexing each of the vacuum winding rolls 750 into position to receive and wind the web of toilet paper 900 being delivered to the winding apparatus by the conveying member 680. The illustrated winding apparatus 700 has six vacuum winding rolls 750 but it is understood that the apparatus could have more or fewer.

With reference now to FIGS. 53-64, each of the vacuum winding rolls 750 comprises an inner cylinder 751 and an outer cylinder 752 that is rotatable about the inner cylinder. Since each of the vacuum winding rolls 750 of the illustrated winding apparatus 700 are the same only one will be described in detail. In the illustrated embodiment, the outer cylinder 752 is approximately 120 inch long and is approximately 1.5 inch in diameter. It is understood, however, that the length and diameter of the outer cylinder 752 can vary.

Figure 53:
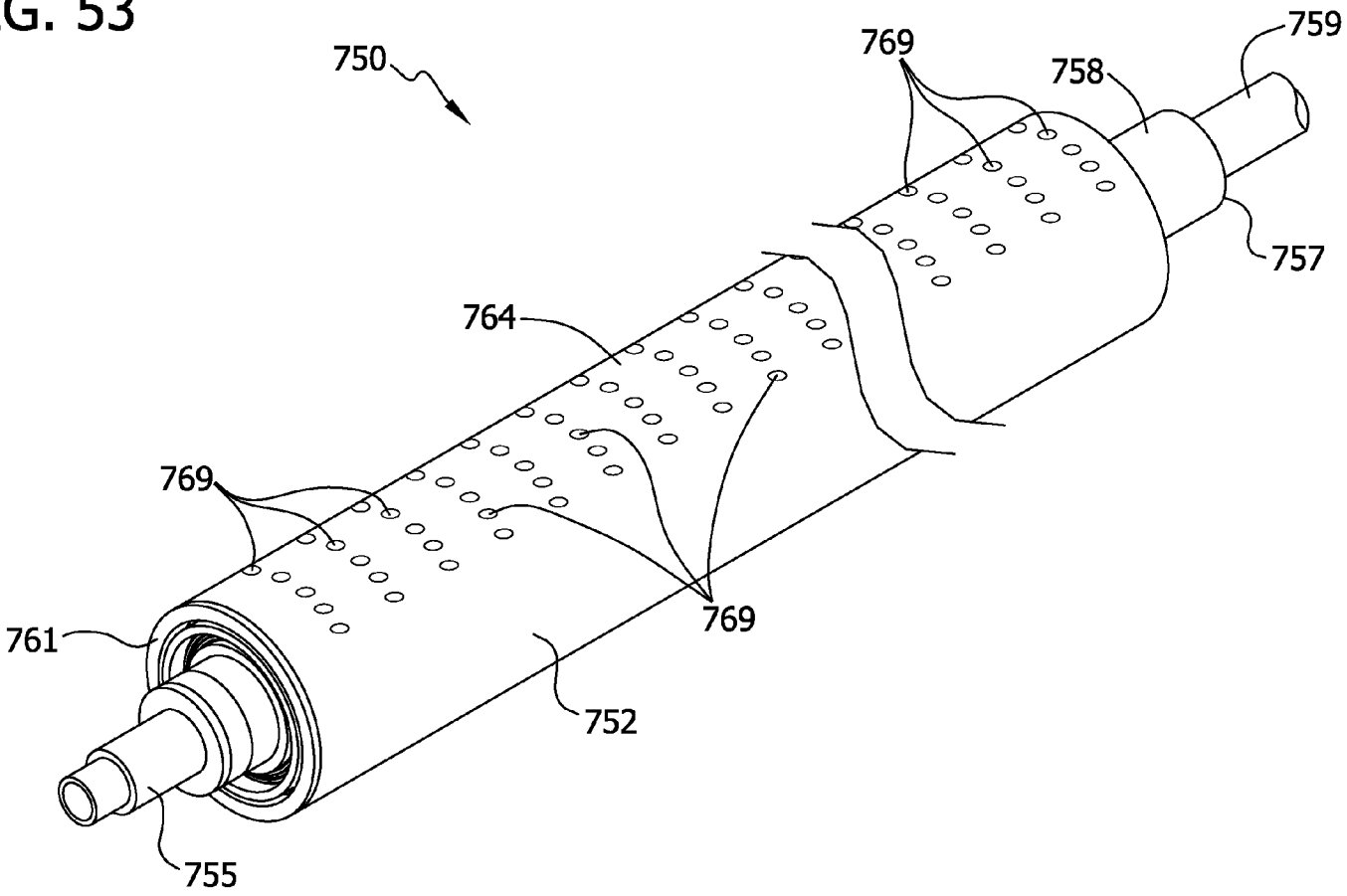
FIG. 53 is a perspective of one of the vacuum winding rolls removed from the web winding system.
Figure 54:
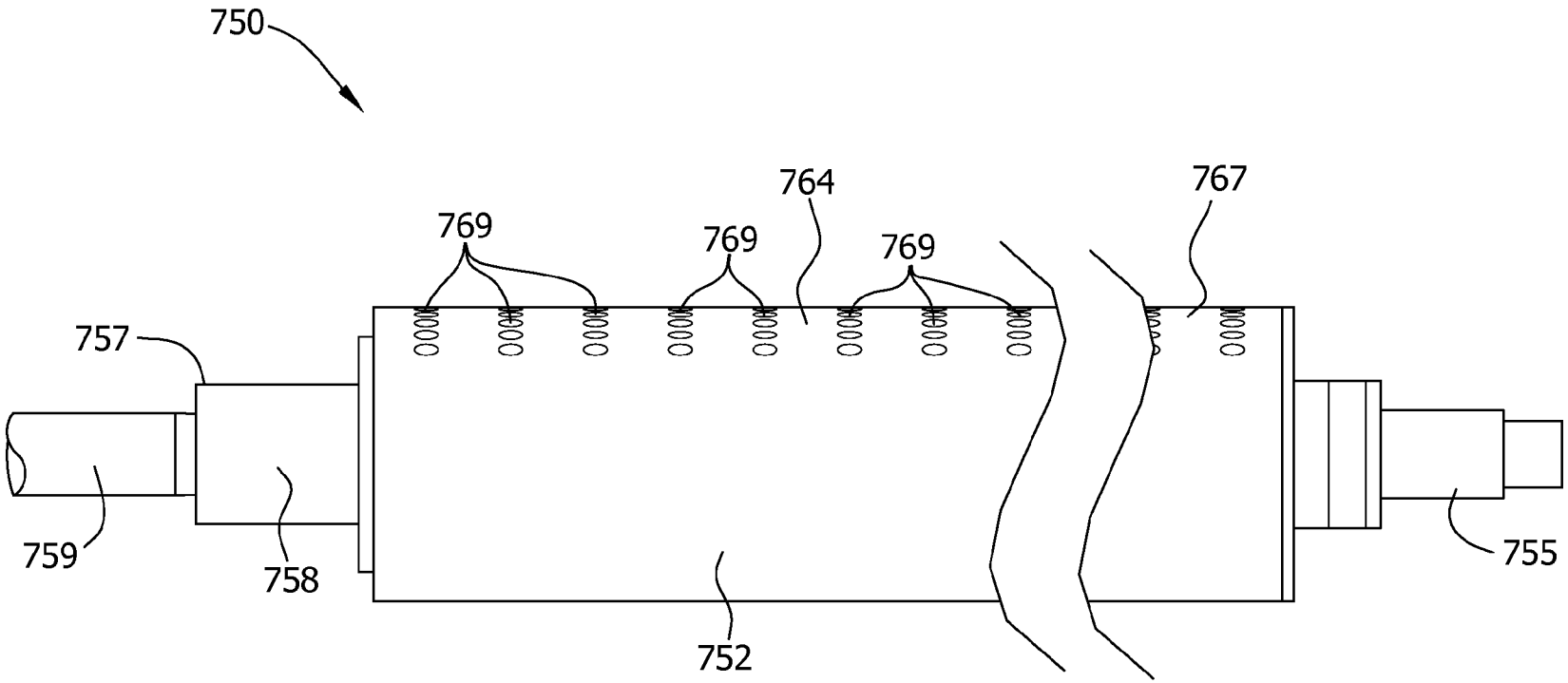
FIG. 54 is a left side view of the vacuum winding roll as seen in FIG. 53.
Figure 55:
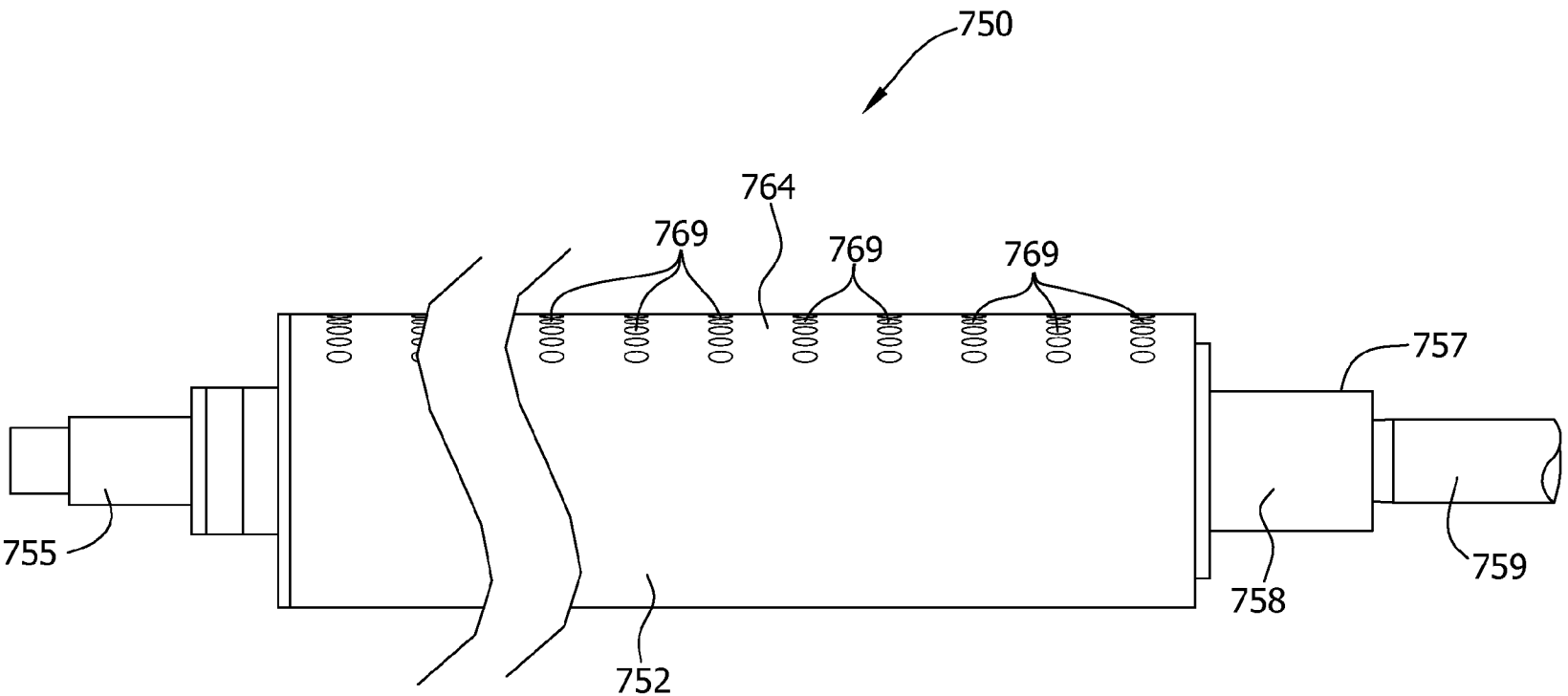
FIG. 55 is a right side view of the vacuum winding roll.
Figure 56:
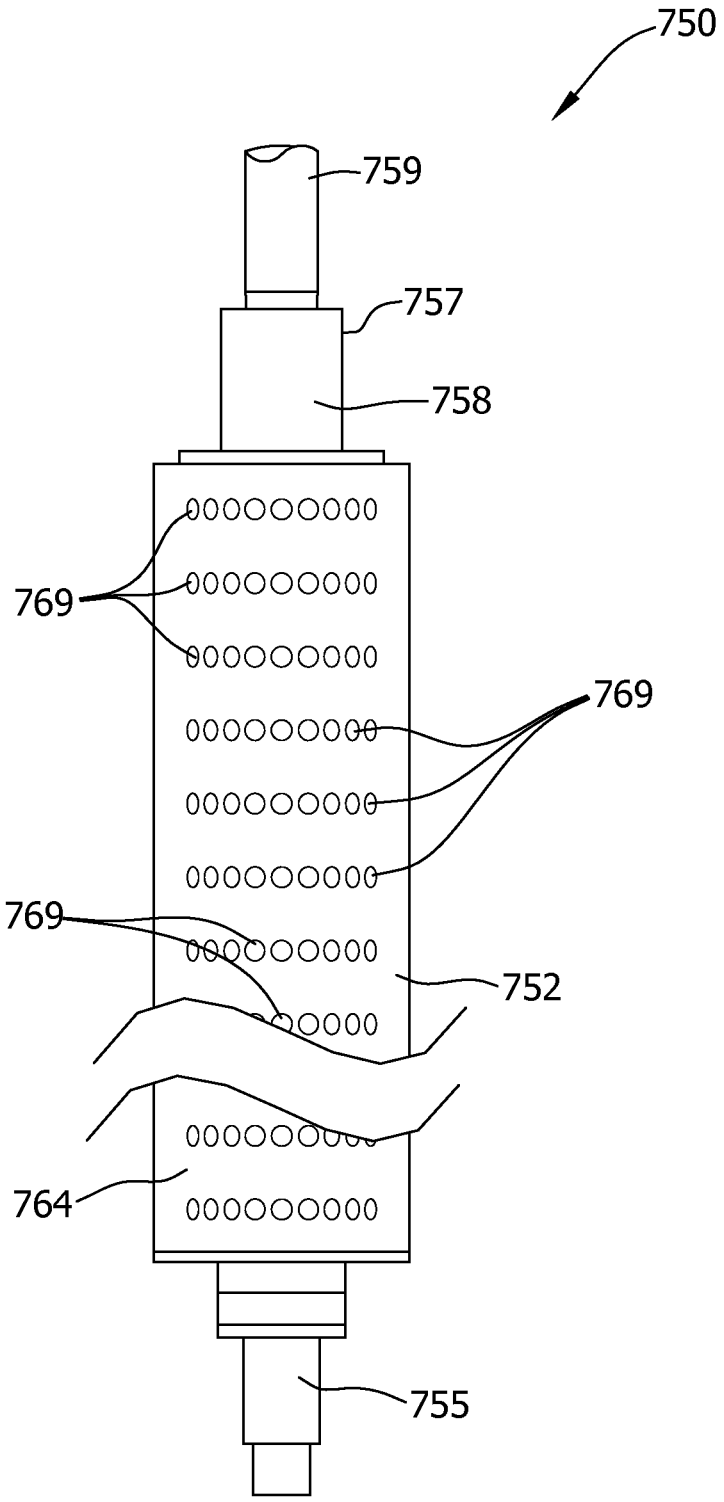
FIG. 56 is a top view of the vacuum winding roll.
Figure 57:
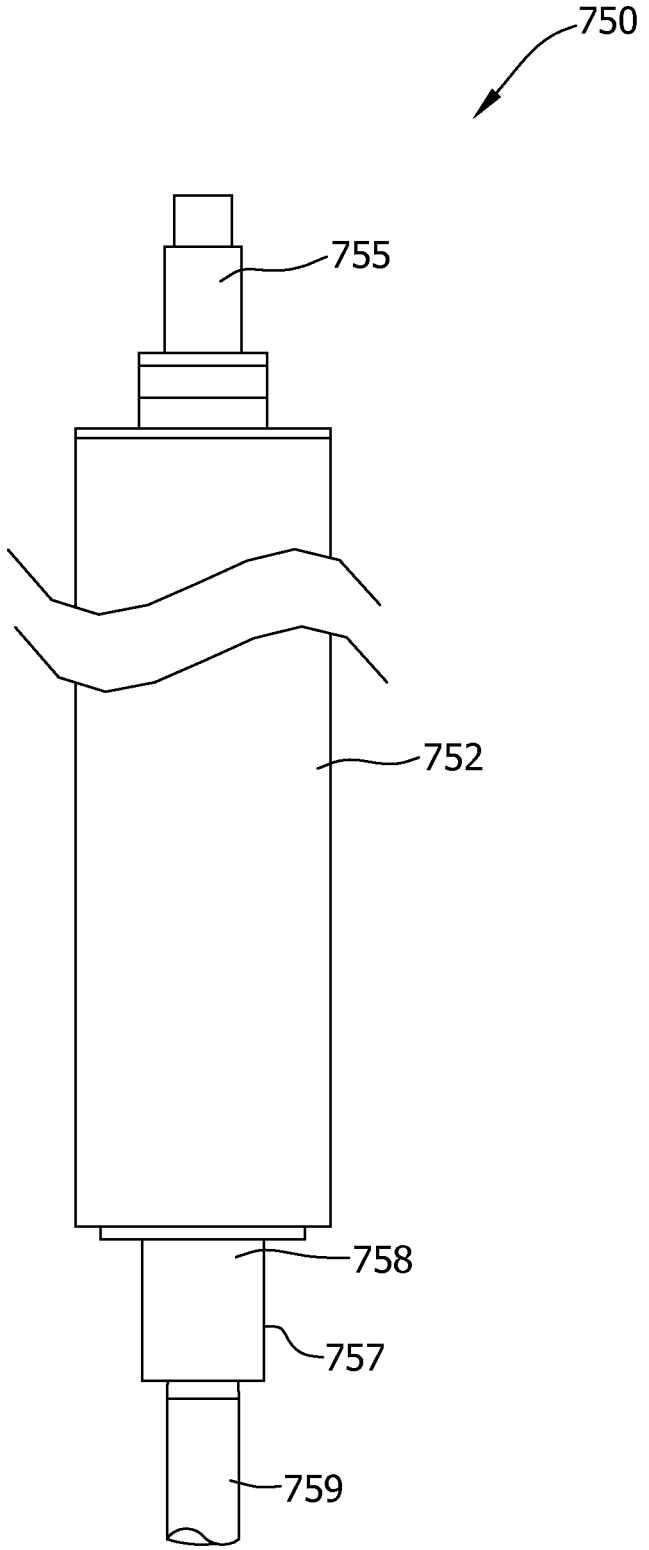
FIG. 57 is a bottom view of the vacuum winding roll.

As seen in FIGS. 53 and 56, the outer cylinder 752 comprises a plurality of circular apertures 769 arranged generally in a rectangle. In the illustrated embodiment, for example, the apertures extend about 1.2 inches about the circumference of the outer cylinder (i.e., machine direction) and across the length of the outer cylinder (i.e., cross-machine direction). Also in the illustrated embodiment, the apertures are approximately 5 mm in diameter and are located at a spacing of about 15 mm. It is understood, however, that the apertures 769 in the outer cylinder 752 can be arranged differently, that there could be more or fewer apertures than illustrated in the accompanying drawings, and that the apertures can have different shapes and sizes than those illustrated.

The portion of the outer cylinder 752 having the apertures 769 generally defines an engagement portion 764 of the vacuum winding roll 750. The engagement portion 764 is adapted to grasp and hold a leading edge of the web of toilet paper 900 as it is being delivered by the conveying member 680. The outer cylinder 752 is closed by a pair of end plates 761 (FIG. 58).

Figure 58:
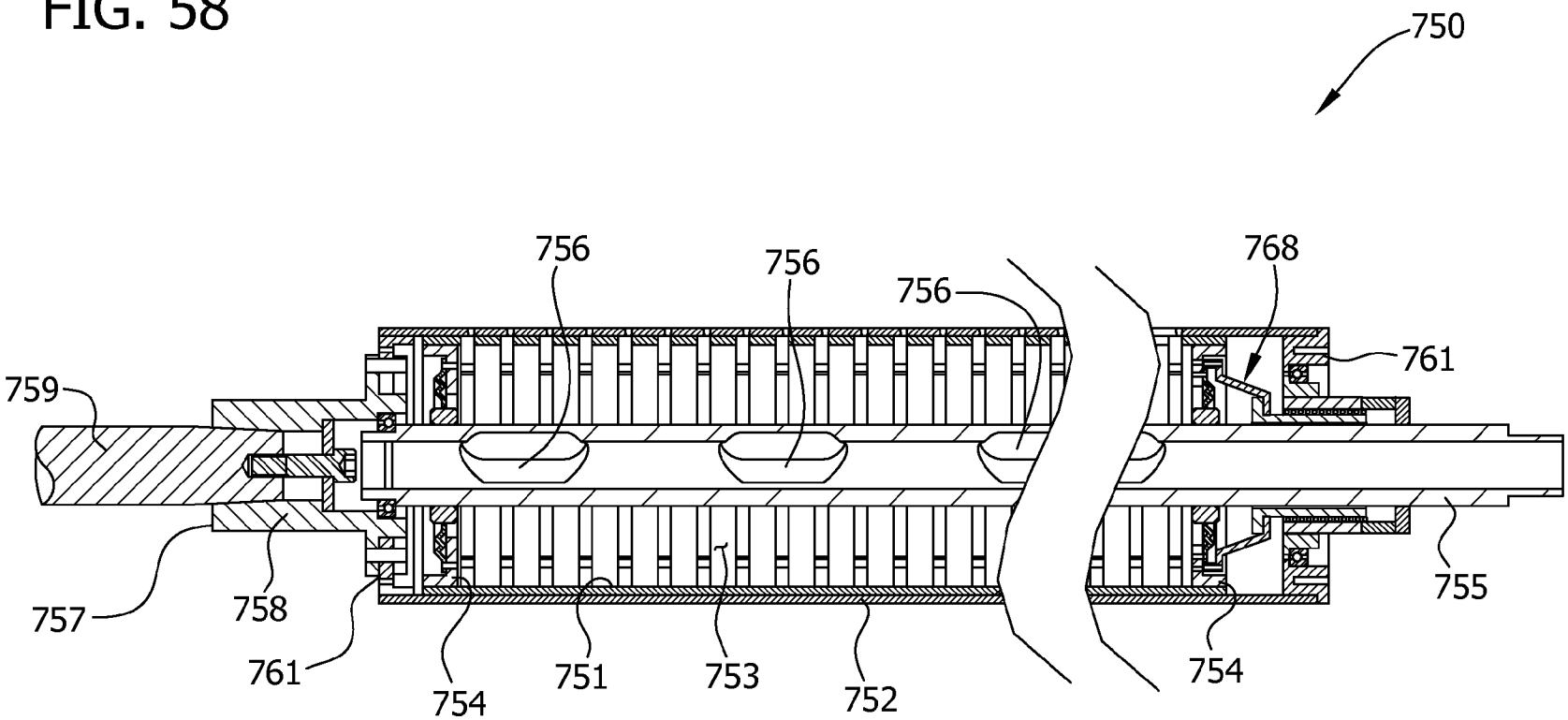
FIG. 58 is a vertical cross-section of the vacuum winding roll.
Figure 59:
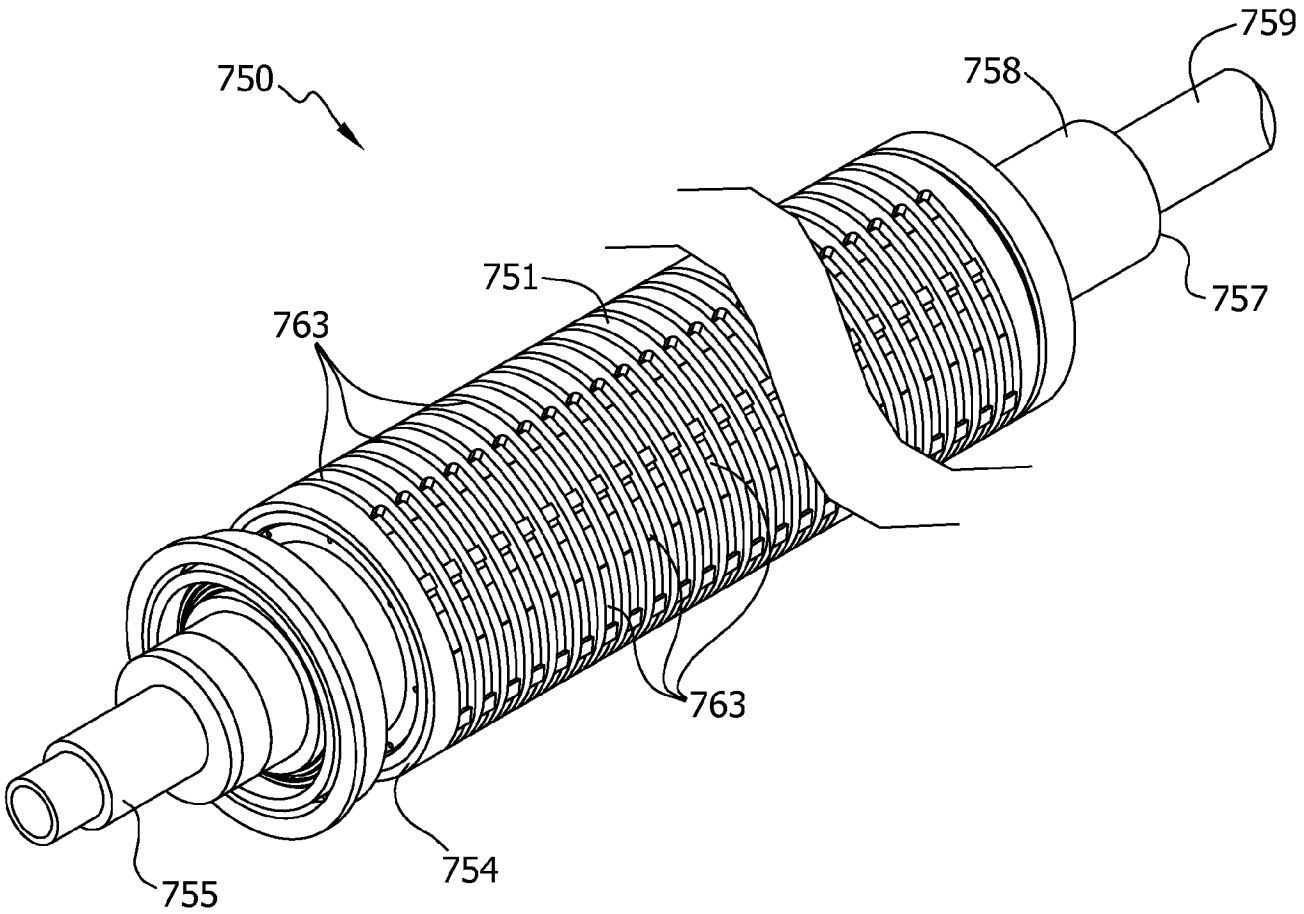
FIG. 59 is a perspective of the vacuum winding roll with an outer cylinder of the vacuum winding roll removed.
Figure 60:
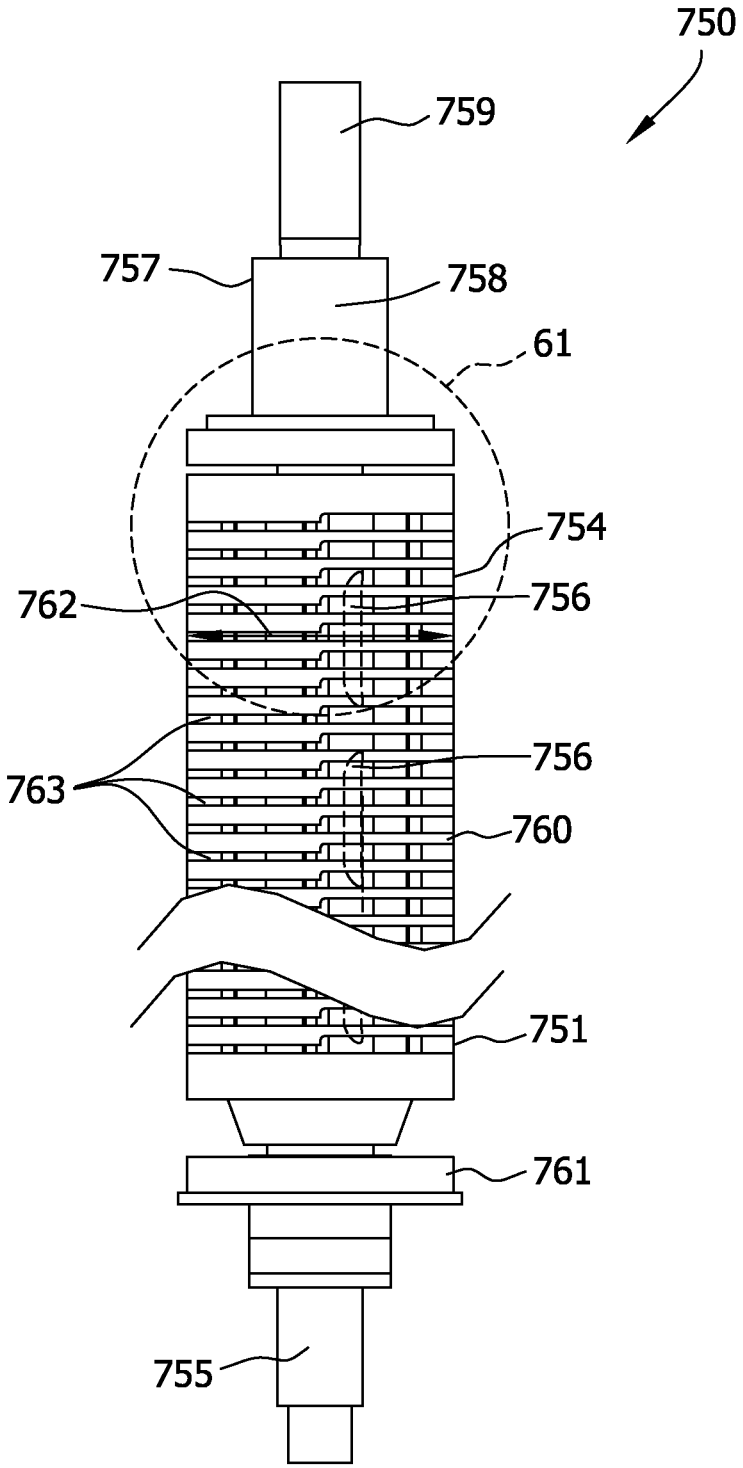
FIG. 60 is a top view of the vacuum winding roll with the outer cylinder removed as seen in FIG. 59.
Figure 61:
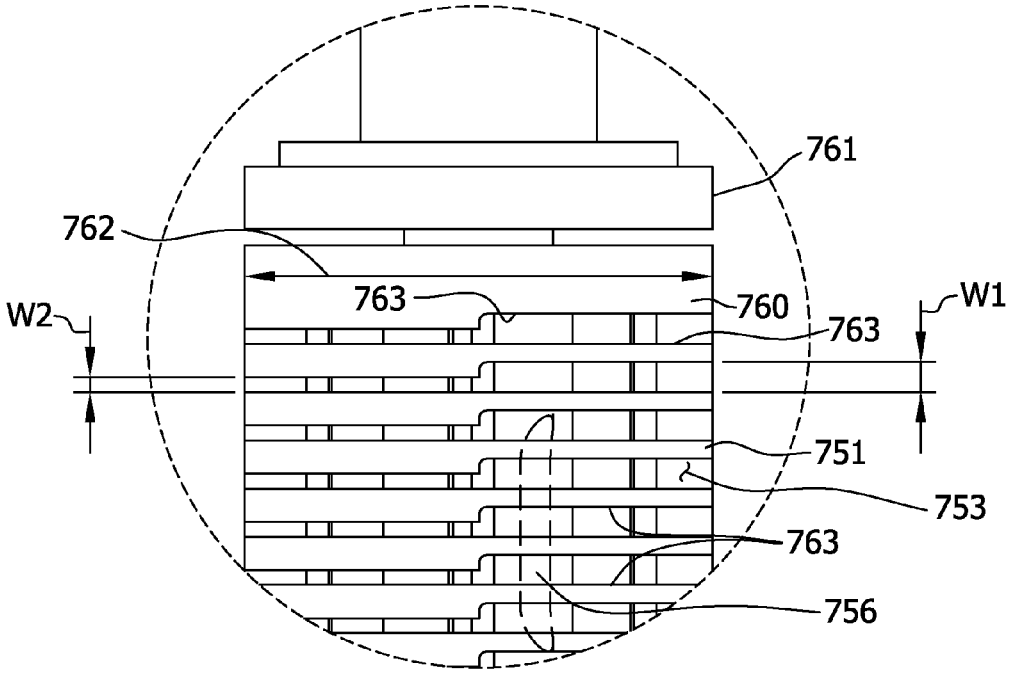
FIG. 61 is an enlarged view of a portion of the vacuum winding roll of FIG. 60.
Figure 62:
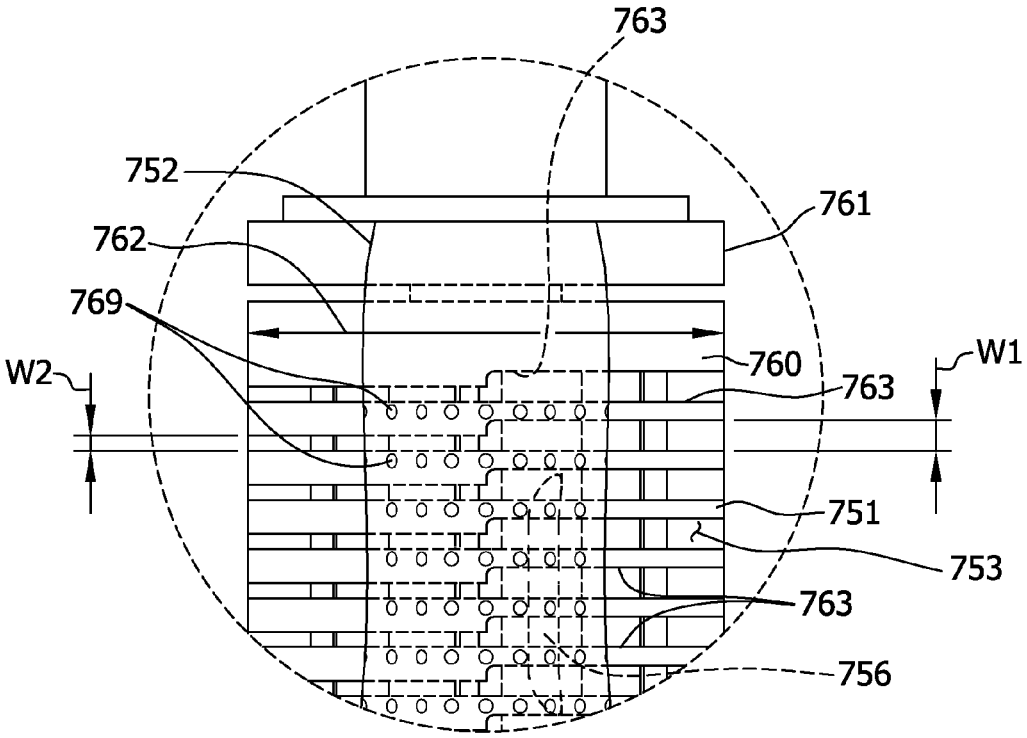
FIG. 62 is a view similar to FIG. 61 but showing the outer cylinder overlying the inner cylinder, the inner cylinder being in a first position and a portion of the outer cylinder being cut away.
Figure 63:
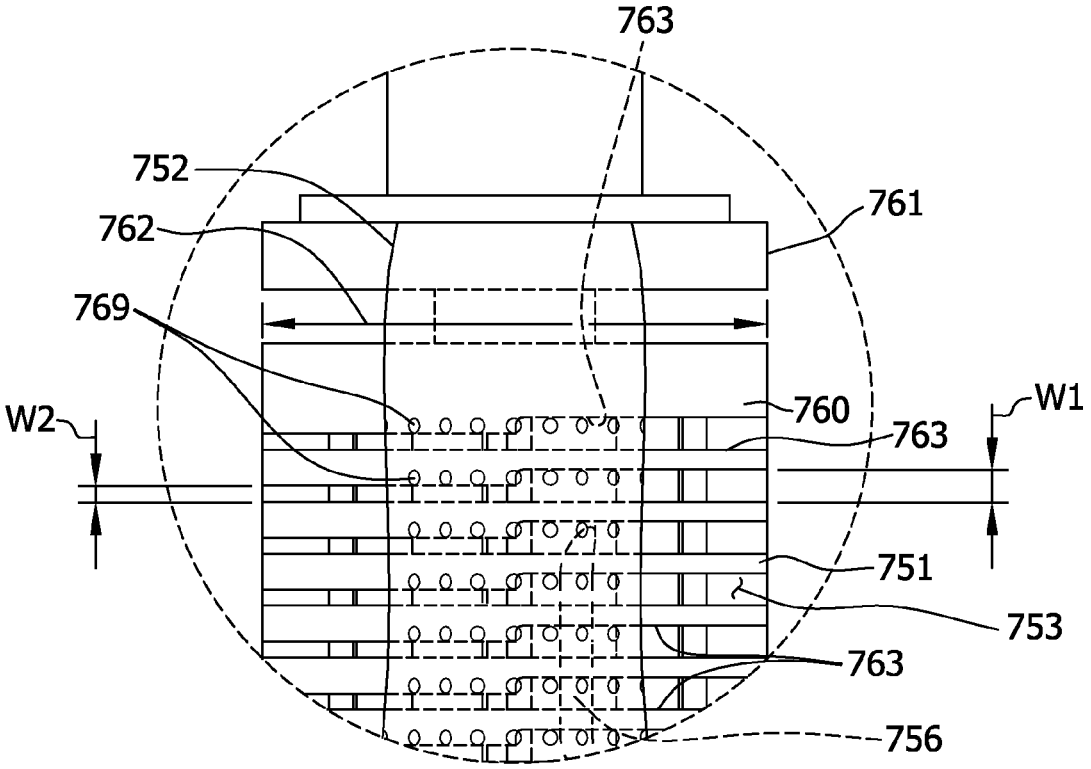
FIG. 63 is a view similar to FIG. 62 but showing the inner cylinder moved relative to the outer cylinder to a second position.

In the illustrated embodiment, the inner cylinder 751 does not rotate and defines an interior chamber 753 (FIGS. 58 and 62). With reference to FIGS. 58-62, the inner cylinder 751 comprises a wall 760 having a plurality of slots 763. Each of the slots 763 varies along its length from a first width W1 to a narrower second width W2 (FIG. 62). A pair of end plates 754 is disposed adjacent the ends of the inner cylinder 751 and closes the interior chamber 753 (FIG. 58). A conduit 755 extends into and is in fluid communication with the interior chamber 753 for allowing a suitable vacuum source (not shown) to apply a vacuum thereto. In one suitable embodiment, the conduit 755 extends through the interior chamber 753 and has a plurality of oval openings 756 that open within the interior chamber (FIG. 58). It is understood that the conduit 755 may extend only partially into the interior chamber 753 and that the openings 756 in the conduit can vary in shape, size and number.

A drive assembly 757 is operatively connected to the outer cylinder 752 for rotating the outer cylinder with respect to the inner cylinder 751. The drive assembly 757 includes a hub 758, a shaft 759 coupled to the hub and a suitable drive mechanism (not shown) capable of rotating the shaft and the hub. In the illustrated embodiment, the drive assembly 757 is adapted to rotate the outer cylinder 752 at approximately 7,640 RPM (about 0.00785 second per revolution). It is understood, however, that the drive assembly can be adapted to rotate the outer cylinder 752 at any suitable speed.

With reference now to FIGS. 58 and 62-64, an actuator 768 is provided within the interior chamber 753 of the inner cylinder 751 of the vacuum winding roll 750 for selectively translating the inner cylinder with respect to the outer cylinder 752 between a first position, a second position, and a third position. In the illustrated embodiment, the actuator is adapted to translate the inner cylinder 751 axially (toward the bottom of the sheet as viewed in FIGS. 62-64) with respect to the outer cylinder 752. In the first position of the inner cylinder 751, which is illustrated in FIG. 62, the apertures 769 in the outer cylinder 752 are out of alignment with the slots 763 in the inner cylinder. As a result, the apertures 769 in the outer cylinder 752 are not in fluid communication with the vacuum applied by the vacuum source to the interior chamber 753 of the inner cylinder 751.

In the second position (FIG. 63), the apertures 769 in the outer cylinder 752 only align with the wider portion of slots 763 in the inner cylinder 751. Thus, the apertures 769 in the outer cylinder 752 do not align with the narrower portions of the slots 163 when the inner cylinder is in the second position. In the third position, the apertures 769 in the outer cylinder 752 are aligned with the slots 763 in the inner cylinder 751 along the entire circumference of the inner cylinder. That is, the apertures 769 in the outer cylinder 752 align with both the narrower and wider portions of the slots 763.

As a result, the vacuum winding roll 750 has a first vacuum profile with the inner cylinder 751 in the first position, a second vacuum profile with the inner cylinder in the second position, and a third vacuum profile with the inner cylinder in the third position. That is, the rotational positions where the vacuum is applied by the vacuum winding roll 750 to the material is different when the inner cylinder is in each of the various positions.

In the illustrated embodiment, the actuator 768 comprises a voice coil motor (FIG. 58). The voice coil motor is capable of developing force in either direction depending upon the polarity of the current applied thereto. Thus, the voice coil motor is capable of braking, damping, and holding forces. In one suitable embodiment, the voice coil motor is capable of displacing more than 15 mm at frequencies up to 40 or 50 Hz. In the illustrated embodiment, for example, input currents are preset so that the voice coil motor displaces the inner cylinder 751 approximately 5 mm and 10 mm. More specifically, the voice coil motor is illustrated in its normal position in FIG. 62, which corresponds to the first position of the inner cylinder 751. When a first preset input current is applied to the voice coil motor, the voice coil motor acts on the inner cylinder 751 to translate the inner cylinder to the second position and, when a second preset input current is applied to the voice coil motor, the voice coil motor acts on the inner cylinder to slide the inner cylinder to the third position.

It is contemplated that the inner cylinder 751 can move more or less than 10 mm with respect to the outer cylinder 752. It is understood that other types of suitable actuators besides voice coil motors can be used to move the inner cylinder 751 relative to the outer cylinder 752.

In this embodiment and as illustrated in FIG. 52, the web of toilet paper 900 is delivered by the first conveying member 680 to one of the vacuum winding rolls 750 of the winding apparatus 700 at a rate of approximately 3000 feet per minute. Since all six of the illustrated vacuum winding rolls 750 are the same, the operation of only one of them will be described herein. The vacuum winding roll 750 is aligned with respect to the conveying member 680 such that the leading end of the wider portions of each of the slots 763 in the inner cylinder 751 being adjacent the first conveying member 680.

The actuator 768 is actuated to move and hold the inner cylinder 752 in the second position (FIG. 63), the vacuum source is operated to apply a vacuum to the interior chamber 753 of the inner cylinder 751, and the drive assembly 757 is activated to rotate the outer cylinder 752 with respect to the inner cylinder at approximately 7,640 RPM. As a result, the apertures 769 in the engagement portion 764 of the outer cylinder 752 align with the wider portion of the slots 763 as they rotate past the wider portions of the slots during each revolution of the outer cylinder. Thus, the apertures 769 in the engagement portion 764 of the outer cylinder 752 are subjected to vacuum when they pass by the wider portion of the slots 763 in the inner cylinder 751 by the vacuum source applying vacuum to the interior chamber.

The web of toilet paper 900 is delivered to the vacuum winding roll 750 in such a manner that the leading edge is generally aligned with the apertures 769 in the engagement portion 764 of the outer cylinder 752. Thus, when a leading edge of the web of toilet paper 900 reaches the vacuum winding roll 750, the leading edge aligns with and is grasped by engagement portion 764 of the outer cylinder 752. As the outer cylinder 752 rotates away from the conveying member 680, the leading edge of the web of toilet paper 900 is lifted off of the conveying member and transferred to the vacuum winding roll.

With vacuum holding the leading edge of the web of toilet paper 900 to the engagement portion 764 of the outer cylinder 752, the actuator 768 is actuated by applying the preset input current to cause the inner cylinder 751 to translate relative to the outer cylinder to the third position. In the illustrated embodiment, the actuator 768 moves the inner cylinder 751 to the third position before the leading edge of the web of toilet paper 900 rotates 180 degrees. More specifically, the actuator 768 moves the inner cylinder 751 approximately 4 milliseconds after the leading edge of the web of toilet paper 900 was grasped by the vacuum winding roll 750.

Figure 64:
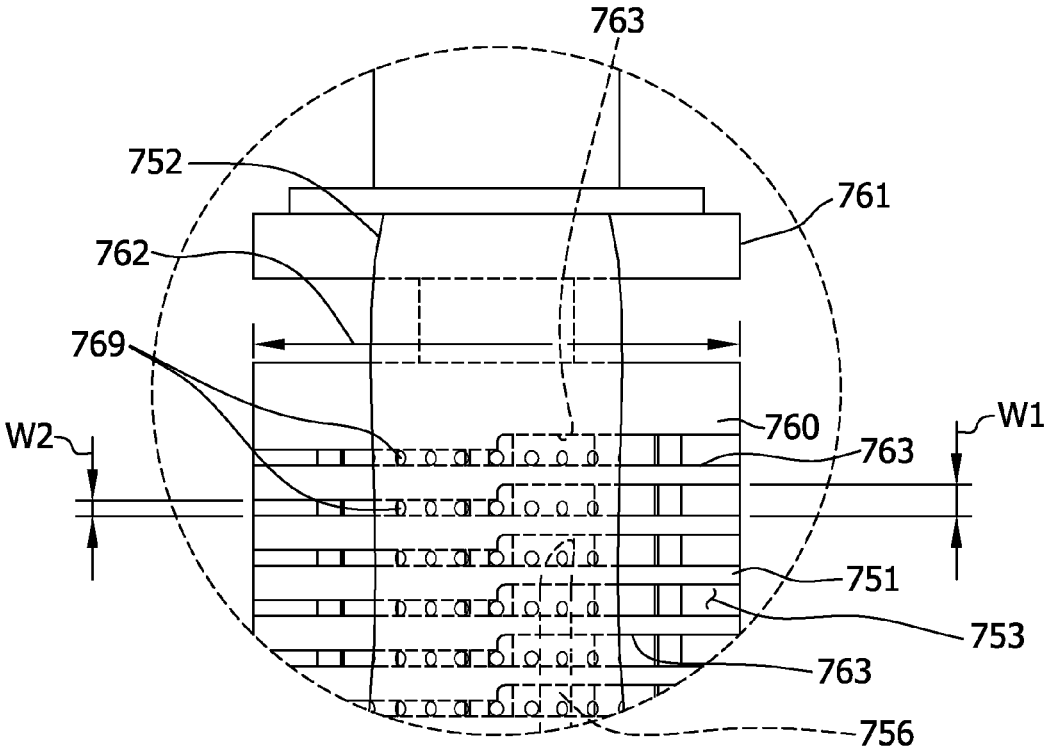
FIG. 64 is a view similar to FIGS. 62 and 63 but showing the inner cylinder moved relative to the outer cylinder to a third position.

As seen in FIG. 64, the apertures 769 in the outer cylinder 752 are aligned with the slots 763 in the inner cylinder 751 along their entire length. That is, the apertures 769 in the outer cylinder 752 align with both the narrower and wider portions of the slots 763. Thus, with the inner cylinder in the third position, the apertures 769 in the engagement portion 764 of the outer cylinder 752 remain in fluid communication with the vacuum being applied to the interior chamber 753 of the inner cylinder 751 by the vacuum source.

The drive assembly 757 continues to rotate the outer cylinder 752 with the inner cylinder 751 in the third position until the desired log of toilet paper 950 is formed. In the illustrated embodiment, the drive assembly 757 rotates the outer cylinder 752 for approximately 0.87 seconds per log of toilet paper 950.

After the desired log of toilet paper 950 is formed, the web of toilet paper 900 is cut by the cutting apparatus 690 and the web winding apparatus 700 is indexed to move the vacuum winding roll 750 away from the conveying member 680 and to bring the next vacuum winding roll adjacent to the conveying member. In one suitable embodiment, a trailing edge of the web of toilet paper 900 is adhered or otherwise bonded to the log of toilet paper 950. It is understood, that the trailing edge of the web of toilet paper 900 can be secured in other ways (e.g., tape) or can remain loose, i.e., unsecured.

At one of the indexing positions following the formation of the log of toilet paper 950, the actuator 768 is actuated to move the inner cylinder 751 to the first position. In the first position, the apertures 769 in the outer cylinder 752 are out of alignment with the slots 763 in the inner cylinder (FIG. 62). As a result, the apertures 769 in the outer cylinder 752 are not in fluid communication with the vacuum applied by the vacuum source to the interior chamber 753 of the inner cylinder 751 and thus the log of toilet paper 950 located on the vacuum winding roll 750 is not subject to the vacuum. With no vacuum holding the log of toilet paper 950 to the winding vacuum roll 750, the log is removed from the web winding system 600 and, more specifically, the winding vacuum roll 750.

After the log of toilet paper 950 is removed from the web winding system 600, it can be cut into individual rolls of toilet paper and packaged. As mentioned above a core is not used in the winding process and, accordingly, each of the resulting rolls of toilet paper does not contain a core. The resulting rolls of toilet paper can be packaged individually or packaged in groups.

While the oscillating member 150 was described in the context of a folding apparatus and the vacuum winding roll 750 was described in the context of a winding apparatus, it is understood that these vacuum rolls can be used individually or in combination with other known apparatus to hold, control, transfer, fold, wind or otherwise handle materials. As described above, both the oscillating member 150 and the vacuum winding roll 750 are capable of handling materials at high line speeds and of changing their vacuum profile (i.e., vacuum pattern) during operation.

Other apparatus suitable for holding, controlling, transferring, folding, winding and/or otherwise handling flexible materials and articles (including training pants) are described in U.S. patent application Ser. No. 12/972,012 entitled FOLDING APPARATUS AND METHOD OF FOLDING A PRODUCT; U.S. patent application Ser. No. 12/971,999 entitled FOLDING APPARATUS AND METHOD OF FOLDING A PRODUCT; and U.S. patent application Ser. No. 12/972,037 entitled FOLDING APPARATUS HAVING ROLLS WITH VARIABLE SURFACE SPEEDS AND A METHOD OF FOLDING A PRODUCT. Each of these applications is incorporated herein by reference in their entireties.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A vacuum roll having a longitudinal axis, the vacuum roll comprising:

an inner cylinder defining an interior chamber, the interior chamber being fluidly connected to a vacuum source for applying a vacuum thereto;

an outer cylinder rotatable about the inner cylinder, the outer cylinder having a plurality of apertures therein; and an actuator configured to translate the inner cylinder relative to the outer cylinder along the longitudinal axis of the vacuum roll between a first position and a second position, the vacuum roll having a first vacuum profile with the inner cylinder in the first position, and a second vacuum profile with the inner cylinder in the second position.

2. The vacuum roll as set forth in claim 1 wherein the inner cylinder comprises a plurality of slots, each of the slots having a narrow portion and a wide portion, the apertures in the outer cylinder being aligned with the narrow portions of the slots in the first position and out of alignment with the narrow portions of the slots in the second position.

3. The vacuum roll as set forth in claim 2 wherein the apertures in the outer cylinder are aligned with the wider portions of the slots in the inner cylinder in both the first and second positions.

4. The vacuum roll as set forth in claim 1 further comprising a drive assembly operatively connected to the outer cylinder for rotating the outer cylinder about the inner cylinder.

5. The vacuum roll as set forth in claim 4 wherein the drive assembly is capable of rotating the outer cylinder about the inner cylinder in both the clockwise and counterclockwise directions.

6. The vacuum roll as set forth in claim 1 wherein the actuator is disposed within the interior chamber of the inner cylinder.

7. The vacuum roll as set forth in claim 1 wherein the actuator comprises a voice coil motor.

8. The vacuum roll as set forth in claim 7 wherein the voice coil motor is capable of translating the inner cylinder about 5 mm.

9. The vacuum roll as set forth in claim 8 wherein the outer cylinder comprises a puck, the apertures in the outer cylinder being disposed on the puck.

10. A vacuum roll comprising:

an inner cylinder defining an interior chamber, the interior chamber being fluidly connected to a vacuum source for applying a vacuum thereto, the inner cylinder comprising a plurality of slots, each of the slots having a narrow portion and a wide portion;

an outer cylinder rotatable about the inner cylinder, the outer cylinder having a plurality of apertures therein; and an actuator configured to move the inner cylinder between a first position, a second position and a third position, the vacuum roll having a first vacuum profile with the inner cylinder in the first position, and a second vacuum profile with the inner cylinder in the second position, the apertures in the outer cylinder being aligned with the narrow portions of the slots in the first position and out of alignment with the narrow portions of the slots in the second position, the apertures in the outer cylinder being aligned with the wider portions of the slots in the inner cylinder in both the first and second positions, the apertures in the outer cylinder being out of alignment with the slots in the inner cylinder when the inner cylinder is in the third position.

11. A vacuum roll having a longitudinal axis, the vacuum roll comprising:

an inner cylinder defining an interior chamber, the interior chamber being fluidly connected to a vacuum source for applying a vacuum thereto; and an outer cylinder rotatable about the inner cylinder, the outer cylinder having a plurality of apertures therein;

the vacuum roll having a first vacuum profile and a second vacuum profile, the inner cylinder being moveable relative to the outer cylinder along the longitudinal axis of the vacuum roll to change the profile of the vacuum roll from the first vacuum profile to the second vacuum profile.

12. The vacuum roll as set forth in claim 11 wherein the actuator is disposed within the interior chamber of the inner cylinder.

13. The vacuum roll as set forth in claim 11 further comprising an actuator configured to move the inner cylinder between a first position and a second position, the first position corresponding the first vacuum profile of the vacuum roll and the second position corresponding to the second vacuum profile of the vacuum roll.

14. The vacuum roll as set forth in claim 13 wherein the inner cylinder includes a plurality of slots, each of the slots having a narrow portion and a wide portion, the apertures in the outer cylinder being aligned with the narrow portions of the slots in the first position and out of alignment with the narrow portions of the slots in the second position.

15. The vacuum roll as set forth in claim 14 wherein the apertures in the outer cylinder are aligned with the wider portions of the slots in the inner cylinder in both the first and second positions.

16. The vacuum roll as set forth in claim 13 wherein the actuator is a voice coil motor.

17. The vacuum roll as set forth in claim 13 wherein the actuator is configured to translate the inner cylinder about 5 mm relative to the outer cylinder.

18. A vacuum roll comprising:

an inner cylinder defining an interior chamber, the interior chamber being fluidly connected to a vacuum source for applying a vacuum thereto, the inner cylinder including a plurality of slots, each of the slots having a narrow portion and a wide portion; and an outer cylinder rotatable about the inner cylinder, the outer cylinder having a plurality of apertures therein;

the vacuum roll having a first vacuum profile and a second vacuum profile, the inner cylinder being moveable relative to the outer cylinder to change the profile of the vacuum roll from the first vacuum profile to the second vacuum profile.

an actuator configured to move the inner cylinder between a first position, a second position and a third position, the first position corresponding the first vacuum profile of the vacuum roll and the second position corresponding to the second vacuum profile of the vacuum roll, the apertures in the outer cylinder being aligned with the narrow portions of the slots in the first position and out of alignment with the narrow portions of the slots in the second position, the apertures in the outer cylinder being aligned with the wider portions of the slots in the inner cylinder in both the first and second positions, the third position corresponding to a third vacuum profile of the vacuum roll.

19. The vacuum roll as set forth in claim 18 wherein the apertures in the outer cylinder are out of alignment with slots in the inner cylinder in the third position of the inner cylinder.

20. A method of handling a material, the method comprising:

directing a material to a vacuum roll having a longitudinal axis, the vacuum roll comprising an inner cylinder and an outer cylinder rotating about the inner cylinder, the inner cylinder defining an interior chamber, the outer cylinder having a plurality of apertures therein;

applying a vacuum to the interior chamber of the inner cylinder;

fluidly connecting at least some of the plurality of apertures in the outer cylinder with the interior chamber of the inner cylinder to define a first vacuum profile;

contacting at least a portion of the material with the outer cylinder while the at least some of the plurality of apertures in the outer cylinder are fluidly connected with the interior chamber so that the vacuum applied thereto grasps and holds the portion of the material to the outer cylinder; and moving the inner cylinder relative to the outer cylinder along the longitudinal axis of the vacuum roll to change the vacuum profile of the vacuum roll from the first vacuum profile to a second vacuum profile.

21. The method set forth in claim 20 wherein moving the inner cylinder relative to the outer cylinder to change the vacuum profile of the vacuum roll from the first vacuum profile to the second vacuum profile comprises actuating an actuator to move the inner cylinder from a first position to a second position.

22. The method set forth in claim 21 wherein actuating the actuator comprises actuating a voice coil motor.

23. A method of handling a material, the method comprising:

directing a material to a vacuum roll, the vacuum roll comprising an inner cylinder and an outer cylinder rotating about the inner cylinder, the inner cylinder defining an interior chamber and comprising a plurality of slots, each of the slots having a narrow portion and a wide portion, the outer cylinder having a plurality of apertures therein;

applying a vacuum to the interior chamber of the inner cylinder;

fluidly connecting at least some of the plurality of apertures in the outer cylinder with the interior chamber of the inner cylinder to define a first vacuum profile;

contacting at least a portion of the material with the outer cylinder while the at least some of the plurality of apertures in the outer cylinder are fluidly connected with the interior chamber so that the vacuum applied thereto grasps and holds the portion of the material to the outer cylinder; and moving the inner cylinder relative to the outer cylinder to change the vacuum profile of the vacuum roll from the first vacuum profile to a second vacuum profile, wherein moving the inner cylinder relative to the outer cylinder to change the vacuum profile of the vacuum roll from the first vacuum profile to the second vacuum profile comprises moving the inner cylinder relative to the outer cylinder so that the narrow portions of the slots in the inner cylinder move out of alignment with the apertures in the outer cylinder.

* * * * *